US006891554B2

(12) United States Patent
Takeyama et al.

(10) Patent No.: US 6,891,554 B2
(45) Date of Patent: May 10, 2005

(54) METHOD AND DEVICE FOR WRITING CONTROL AND IMAGE FORMING DEVICE

(75) Inventors: Yoshinobu Takeyama, Kanagawa-ken (JP); Nobuyuki Yanagawa, Kanagawa-ken (JP); Nekka Matsuura, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/379,533

(22) Filed: Mar. 6, 2003

(65) Prior Publication Data

US 2003/0169325 A1 Sep. 11, 2003

(30) Foreign Application Priority Data

Mar. 6, 2002 (JP) ..... 2002-060145
May 23, 2002 (JP) ..... 2002-149171

(51) Int. Cl.[7] ..... G03G 15/01
(52) U.S. Cl. ..... 347/116; 347/234
(58) Field of Search ..... 347/250, 249, 347/233, 235, 116, 234; 399/66, 76, 228, 301, 308

(56) References Cited

U.S. PATENT DOCUMENTS 5,294,944 A 3/1994 Takeyama et al.
6,052,205 A 4/2000 Matsuura
6,108,501 A * 8/2000 Nagai ..... 399/116
6,157,797 A 12/2000 Saito et al.
6,222,566 B1 4/2001 Takeyama et al.
6,256,461 B1 7/2001 Takeyama et al.
6,263,178 B1 7/2001 Takeyama et al.
6,269,228 B1 * 7/2001 Kayahara et al. ..... 399/37
6,292,641 B1 9/2001 Takeyama et al.
6,459,816 B2 10/2002 Matsuura et al.
6,493,011 B1 * 12/2002 Shioya ..... 347/116
6,496,677 B2 * 12/2002 Fujimori ..... 399/298
6,507,674 B1 1/2003 Yagishita et al.
6,519,052 B1 2/2003 Oneda et al.
6,556,707 B1 4/2003 Yagishita et al.
6,571,071 B2 5/2003 Kanoshima et al.

* cited by examiner

*Primary Examiner*—Andrew H. Hirshfeld
*Assistant Examiner*—Leo T. Hinze
(74) *Attorney, Agent, or Firm*—Oblon, Spivak, McClelland, Maier & Neustadt, P.C.

(57) ABSTRACT

An image forming device is provides, which comprises a body to be scanned that moves in a sub-scanning direction; a writing means for scanning the body in a main scanning direction with a light beam according to image information to form a reference image on the body and repeating the scanning plural times to form plural images; and a second body on which the plural images are overlaid to form a color image. The writing means starts writing the reference image at a start time ty1 when a main scanning synchronizing signal is firstly generated by the writing means after a time tx1 when a predetermined time has lapsed from detection of an image forming start signal of the sub-scanning direction for the reference image. A start time for an image other than the reference image is changed depending on the start time of the reference image.

34 Claims, 28 Drawing Sheets p1
T
p2
T/2
t11
pe
t12
t1min
t1max
t21
pg1
pg2
pg3
t22
ph1
ph2
ph3

T/2
T
tr
D1
t2a
D2
T3a
D3
t2b'
D4
t2b
t3b
D5

T/2
T

J1
J2
J1

T/2
t101
T
t102
t201
pd2
t202
F1
F2
G1
G2
H1
H2
I1
I2
J1
J2

METHOD AND DEVICE FOR WRITING CONTROL AND IMAGE FORMING DEVICE

CROSS-REFERENCE TO RELATED APPLICATION

This application claims the priority benefit of Japanese applications serial no. 2002-060145, filed on Mar. 6, 2002 and serial no. 2002-149171, filed on May 23, 2002.

BACKGROUND OF THE INVENTION

1. Field of the Invention

This invention relates in general to a writing control method, a writing control device and an image forming device. More particularly, the invention relates to an image forming device using an intermediate transcriber, such as a copy machine, a printer or a facsimile, etc.

2. Description of the Related Art

An image forming device, such as a copy machine, a printer or a facsimile, etc., is well known in the conventional art. The image forming device includes a scanning and writing device that is used to perform a scanning operation in a main scanning direction for image information according to a main scanning synchronizing signal that is detected after an image forming start signal in the sub-scanning direction is detected, and then to write an image to an image supporter moving in a sub-scanning direction. FIG. 1 shows an example of the above image forming device.

Referring to FIG. 1, the image forming device comprises a optical writing device 100, a drum-shaped photosensor 102, a cleaning device 104 used to clean the photosensor 102, an electrifying device 106 used to electrify the photosensor 102 uniformly, developing devices 5K, 5C, 5M, 5Y, a transfer drum 110, a fixing device 112, transfer paper 114 used as a recording medium, a controller 116 and a paper-feeding device (10) used to feed paper 114. The image forming device further comprises a detecting means (61) used as a means for generating an image forming start signal of the sub-scanning direction. The optical writing device 100 is used as a scanning and writing device, i.e., an exposure device. The drum-shaped photosensor 102, used as an image supporter (a scanned object), is rotationally driven by a photosensor driving means (not shown) to move along the sub-scanning direction to an image writing position, so that an image is scanned by optical writing device 100 in the main scanning direction according to image information and then written onto the photosensor 102. The developing devices 5K, 5C, 5M, 5Y are respectively used to develop an electrostatic latent image on the photosensor 102 into toner images in black, cyan, magenta and yellow. The transfer drum 110 is used as an intermediate transcriber, wherein the transfer drum 110 is rotated by a driving means (not shown) with a rotational speed the same as the photosensor 102 and a mark M is formed thereon. The detecting means (61) is used to detect the mark M on the transfer device 110 so as to generate an image forming start signal of the sub-scanning direction, i.e., the image forming start signal of the sub-scanning direction. The controller 116 receives the image forming start signal of the sub-scanning direction from the detecting means (61) and controls the entire image forming device.

Next, operations related to the aforementioned image forming device is further described. As an image forming operation begins, the surface of the photosensor 102 is electrified to a prescribed potential by the electrifying device 106. The photosensor 102 is rotated in the arrow direction as shown in FIG. 1, and the electrified surface of the photosensor 102 is then repeatedly scanned and exposed in the main scanning direction by a modulated light beams by the optical writing device 100 according to image information of black, cyan, magenta and yellow sequentially. At this time, the photosensor 102 is discharged in a manner that an exposed portion becomes conductive and then the electrified charges flow from an inner face of the photosensor 102 to the ground. An electrostatic line image corresponding to image information each color is sequentially formed on the photosensor 102 by defining that an exposed portion is an image portion and a non-exposed portion is a non-image portion.

Next, the electrostatic latent images corresponding to image information of each color on the photosensor are respectively developed by the developing devices 5K, 5C, 5M and 5Y. Each of the developing devices 5K, 5C, 5M and 5Y has a developer supporter for supporting developer that contains toner of black, cyan magenta and yellow respectively. By applying an immediate potential between a non-image potential and an image potential of the electrostatic latent image on the photosensor 102 from a power device (not shown) to the developer supporter, the selected color toner on the developer supporter is adhered onto the image portion of the photosensor 102. In the example, the developing devices 5K, 5C, 5M and 5Y are installed in a revolving manner. Thus, the four developing devices 5K, 5C, 5M, 5Y are rotated all together by a revolver mechanism (not shown), and in this way, the developing device opposite to the photosensor 102 is circularly altered. By the rotation of the developing devices, one developing device selected develops the electrostatic latent image on the photosensor 102 to form a toner image.

The first color toner image, formed on the photosensor 102 by one selected developing device, is transferred to the transfer drum 110 by a first transfer mechanism (not shown) at a first transfer section, i.e., a close region between the photosensor 102 and the transfer drum 110. As the revolver mechanism (not shown), which is to rotate the developing devices 5K, 5C, 5M, 5Y at one time, finishes the development of the electrostatic latent image corresponding to first color image information on the photosensor 102, the developing devices 5K, 5C, 5M, 5Y are then rotated all together to make one developing device, which is to develop an electrostatic latent image corresponding to second color image information on the photosensor 102, to be opposite to the photosensor 102.

The first color toner image on the transfer drum 110 is further transported to the first transfer section by rotating the transfer drum 110. At this time, each elements of the image forming device in this example is controlled by the controller 116 in such a manner that the second color toner image formed by the developing device on the photosensor 102 reaches the first transfer section, and the second color toner image on the photosensor 102 is transferred at the first transfer section by the first transfer mechanism (not shown) onto the transfer drum 110 so as to overlap with the first color toner image.

When the revolver mechanism (not shown) finishes the development of the electrostatic latent image corresponding to second color image information on the photosensor 102, the developing devices 5K, 5C, 5M, 5Y are then rotated all together to make one developing device, which is to develop an electrostatic latent image corresponding to third color image information on the photosensor 102, to be opposite to the photosensor 102. At this time, each elements of the image forming device in this example is controlled by the controller 116 in such a manner that the third color toner image formed by the developing device on the photosensor 102 reaches the first transfer section, and the third color toner image on the photosensor 102 is transferred at the first transfer section by the first transfer mechanism (not shown) onto the transfer drum 110 so as to overlap with the second color toner image.

When the revolver mechanism (not shown) finishes the development of the electrostatic latent image corresponding to third color image information on the photosensor 102, the developing devices 5K, 5C, 5M, 5Y are then rotated all together to make one developing device, which is to develop an electrostatic latent image corresponding to fourth color image information on the photosensor 102, to be opposite to the photosensor 102. At this time, each elements of the image forming device in this example is controlled by the controller 116 in such a manner that the fourth color toner image formed by the developing device on the photosensor 102 reaches the first transfer section, and the fourth color toner image on the photosensor 102 is transferred at the first transfer section by the first transfer mechanism (not shown) onto the transfer drum 110 so as to overlap with the third color toner image.

On the other hand, a transfer paper 114 is fed to resist rollers from a paper feeding device (10), and the resist rollers send out the transfer paper 114 accompanying with the full color image on the transfer drum 110. As a full color image is formed on the transfer drum 110, a receded or stopped secondary transfer mechanism (not shown) is activated, and then the full color image on the transfer drum 110 is entirely transferred to the transfer paper 114 (from the resist roller) by the secondary transfer mechanism. The full color image that has been transferred on the transfer paper 114 is fixed by the fixing device 112, and then the transfer paper 114 is ejected out of the image forming device.

FIG. 2 shows a structure of the optical writing device 100 in FIG. 1. The optical writing device 100 comprises a light source 120. The light source 100 is sequentially modulated by a modulating means (not shown) according to image information of prime colors, such as black, cyan, magenta and yellow. Then, a laser beam, which is sequentially modulated by image information of black, cyan, magenta and yellow, is emitted.

The laser beam from the light source 120 is collimated by a collimator lens (15), and then deflected by a deflection reflection surface of a rotational polygon mirror 122 (as a scanning means). The rotational polygon mirror 122 is rotationally driven by a driving means (not shown) to scan repeatedly in the main scanning direction. The laser beam from the rotational polygon mirror 122 is converged by an imaging lens 124 and then is imaged on the photosensor 102 as a laser spot. By using that the rotational polygon mirror 122 is rotationally driven by the driving means (not shown), the laser spot scans the photosensor 102 repeatedly in the main scanning direction to form an electrostatic latent image on the photosensor 102.

An light receiving element 126 as a main scanning synchronizing signal generating means is arranged out of an image range that is within a laser beam scanning range. The light receiving element 126 receives a laser beam from a polygon mirror 122 and then detects it, so as to generate a main scanning synchronizing signal that determines a recording start position (lateral resist) in the main scanning direction.

On the other hand, an image forming start signal of the sub-scanning direction (i.e., an image forming start signal of the sub-scanning direction), which determines a recording start position (vertical resist) in the sub-scanning direction (i.e., an image forming start position in the sub-scanning direction), is detected and generated by such as a light receiving means to detect a reflection light or a transmission light that is obtained by irradiate a light beam to the mark formed on the transfer drum 110 and the mark formed on the photosensor 102, a rotation start timing of the resist roller, a detection signal from a paper detecting sensor that is used to detect the transfer paper 114 right after the resist roller, a rotary encoder built in a photosensor driving means, etc. There are many methods to generate the image forming start signal of the sub-scanning direction, but in this example, the image forming start signal of the sub-scanning direction is generated by that the detecting means (61) detects the mark M formed on the transfer drum 110.

The main scanning synchronizing signal from the light receiving element 126 and the recoding start signal of the sub-scanning direction that comes from the detecting means (61) are transmitted to the controller 116. Then, the controller 116 instructs the optical writing device 100 to perform an optical writing (exposure) operation onto the photosensor 102 according to the main scanning synchronizing signal from the light receiving element 126 and the recoding start signal of the sub-scanning direction from the detecting means (61).

FIG. 3 shows a timing diagram of an operation in the above exemplary description. For convenience, t represents time, a time when the image forming start signal of the sub-scanning direction from the detecting means (61) is detected by the controlled 116 together with the optical writing operations corresponding to image information of colors is defined as t=0, and a time interval for the light receiving element 126 to generate the main scanning signal is represented by T. When an optical writing operation corresponding to first color image information is performed by the optical writing device 100, a time when the controlled 116 detects initially the main scanning synchronizing signal from the light receiving element 126 after t=0 is represented by t1. When an optical writing operation corresponding to second color image information is performed by the optical writing device 100, a time when the controlled 116 detects initially the main scanning synchronizing signal from the light receiving element 126 after t=0 is represented by t2. When an optical writing operation corresponding to third color image information is performed by the optical writing device 100, a time when the controlled 116 detects initially the main scanning synchronizing signal from the light receiving element 126 after t=0 is represented by t3. When an optical writing operation corresponding to fourth color image information is performed by the optical writing device 100, a time when the controlled 116 detects initially the main scanning synchronizing signal from the light receiving element 126 after t=0 is represented by t4. In this description, the transmission time for each signal is ignored.

As an initial main scanning synchronizing signal from the light receiving element 126 is detected after the image forming start signal of the sub-scanning direction from the detecting means (61) is detected, the controller 116 instructs an optical writing (exposure) operation to the optical writing device 100. FIG. 5 shows an operation flow chart in the above example. At Step 1, the controller 116 checks regularly the image forming start signal of the sub-scanning direction coming from the detecting means (61) to determines as to whether the image forming start signal of the sub-scanning direction is detected. At Step 2, if the image forming start signal of the sub-scanning direction is detected, this time t is set as 0. Next, at Step 3, the controller 116 checks regularly the main scanning synchronizing signal coming from the light receiving element 126 to determines as to whether the main scanning synchronizing signal is detected. At Step 4, if the main scanning synchronizing signal is detected, the controller 116 instructs an optical writing (exposure) operation to the optical writing device 100. The above operation flow is independently performed with an optical writing operation corresponding to image information of each color.

In the image forming device described above, because the main scanning synchronizing signal and the image forming start signal of the sub-scanning direction are not synchronized in general, when the image forming start signal of the sub-scanning direction from the detecting means (61) reaches the controller 116, angles of the rotational polygon mirror 122, which are respectively for when the optical writing corresponding to image information of the first color is started and for when the optical writing corresponding to image information of the second color is started, are different. Namely, when the image forming start signal of the sub-scanning direction from the detecting means (61) reaches the controller 116, the angles of the rotational polygon mirror 122 when the optical writing corresponding to image information of each color is started are not equal to each other.

Therefore, as shown in FIG. 3, t1, t2, t3 and t4 are not same, and ranges between t=0 and t=T. As a result, the toner image of each color in the sub-scanning direction occurs in a color deviation. For example, as shown in FIG. 3, when the time difference between t1 and t2 is large, such as the optical writing corresponding to image information of the first color and the optical writing corresponding to image information of the second color, the start time of the optical writing is shifted close to T. As a result, the toner image of the first color and the toner image of the second color are shifted close to one line as shown in the lower part of FIG. 3.

In addition, in the specification, "line" means a pixel set that the positions in the sub-scanning direction are equal among the pixels forming image information. During the image formation, from the first scanned line to the subsequently scanned lines, these lines are represented by the first line, the second line, the third line, etc. Even though a scanning and writing device to form a plurality of lines by scanning once, each of lines is represented by the first line, the second line, the third line, etc. as shown in FIG. 21.

As a technology to avoid the aforementioned color deviation, there is a method to control the exposure by determining as to whether t1 to t4 are equal to or larger than a prescribed value. In this method, for example, when t1 is equal to or larger than T/2, the optical writing (the exposure) is started at time t1. When t1 is less than T/2, the optical writing (the exposure) is started at time t1+T. When the exposure is started at time t1+T, the optical writing device can be stopped at time t1, or the optical writing device can be still activated without emitting a laser beam.

When this conventional method is applied to a situation shown in FIG. 3, the position relationship of each color is as shown in FIG. 4. When the exposure is started at time t1+T, the dot represented by dash line shown in FIG. 4 is a dot at the time t1 that the exposure is not performed. However, according to this method, when time t1 is right before time T/2 and time t2 is right after time T/2, the toner image of the first color and the toner image of the second color cannot be avoided from being shifted close to one line.

In addition, there is a disclosed image forming device in Japanese Laid Open No. 11-212009, in which the above method and a multi-beam technology are combined together. However, this image forming device is to reduce a position shift of image information of the first line, rather than to avoid toner image of each color from being shifted close to one line.

In the conventional image forming device, when the electrostatic latent image is formed by the writing device, a dot position shift occurs easily in the sub-scanning direction. As the dot position shift occurs, a color deviation occurs when overlapping each of the color images on the intermedium transfer body. Therefore, the image quality is degraded and the original image cannot be truly reproduced.

SUMMARY OF THE INVENTION

According to the foregoing description, an object of this invention is to provide a writing control method, a writing control device and an image forming device capable of avoiding a color deviation of a toner image, caused by that the main scanning synchronizing signal and the image forming start signal of the sub-scanning direction are not synchronized.

Another object of this invention is to provide an image forming device capable of suppressing a dot position shift in a sub-scanning direction to improve the image quality.

According to the objects mentioned above, the present invention provides an image forming device, comprising: a body to be scanned that moves in a sub-scanning direction; a writing means for scanning the body in a main scanning direction with a light beam according to image information to form a reference image on the body and repeating the scanning plural times to form plural images; and a second body on which the plural images are overlaid to form a color image. The writing means starts writing the reference image at a start time ty1 when a main scanning synchronizing signal is firstly generated by the writing means after a time tx1 when a predetermined time has lapsed from detection of an image forming start signal of the sub-scanning direction for the reference image. A start time for an image other than the reference image is changed depending on the start time of the reference image.

In the above image forming device, the predetermined time is T/2 where T is a period of the main scanning synchronizing signal of the writing means, and wherein the writing means delays starting writing the image other than the reference image by T when the following relationship is satisfied:

$$(t1-t2)>0$$

wherein t1=(ty1−tx1) and t2=(ty2−tx2) where tx2 represents a time when an image forming start signal of the sub-scanning direction for the image other than the reference image is detected, and ty2 represents a start time when the main scanning synchronizing signal is firstly generated by the writing means after the time tx2.

In the above image forming device, an assumptive image obtained by averaging start positions in the sub-scanning direction of a plurality of images that have been written is used as the reference image, and wherein the writing means delays starting writing a following image other than the reference image by T when the following relationship is satisfied:

$$(t3-t2)>0$$

wherein t3 represents a time from the time when the image forming start signal of the sub-scanning direction for the assumptive image is detected to the time when the writing means starts writing the assumptive image.

The image forming device further comprises a mark detecting means. The second body is an intermediate transfer body on which the plural images formed on the body are transferred and which has a mark thereon. The image forming start signal of the sub-scanning direction is generated when the mark is detected by the mark detecting means. The writing means comprises a first measuring means for measuring a first lapse time after the image forming start signal is detected; a storing means for storing the predetermined time T/2; a first determining means for comparing the first lapse time measured by the first measuring means with the predetermined time T/2 to determine whether the first lapse time is larger than the predetermined time T/2; a second measuring means for measuring and storing a second lapse time from a time when the lapse time measured by the first measuring means reaches the predetermined time T/2 to a time when the writing means generates a main scanning synchronizing signal; a calculating means for calculating a time difference between the first lapse time measured by the first measuring means and the second lapse time measured by the second measuring means, when forming the image other than the reference image; and a second determining means for determining as to whether the time difference is positive or negative. At a time point that the first lapse time is determined to be larger than the predetermined time T/2 by the first determining means, the writing means starts writing the reference image while synchronizing with the main scanning synchronizing signal, and the start time of the image other than the reference image is delayed depending on a result of the second determining means.

In the above image forming device, the writing means further comprises a counting means for counting a number of the main scanning synchronizing signal after the first lapse time reaches the predetermined time T/2 when forming the reference image, and for counting a number of the main scanning synchronizing signal after the image forming start signal is detected when forming the image other than the reference image. When the number of the main scanning synchronizing signal when forming the reference image is n, the writing means starts writing the reference image. When the second determining means determines that the time difference is negative, the writing means starts writing the image other than the reference image while synchronizing with the n-th synchronizing signal after the image forming start signal is detected, and when the second determining means determines that the time difference is positive, the writing means starts writing the image other than the reference image while synchronizing with the (n+1)-th synchronizing signal after the image forming start signal is detected.

In the above image forming device, if the image formation of the reference image is performed from m-th (m is a positive integer) line thereof, the image formation of the plural images other than the reference image is output from the m-th line thereof such that the m-th line is output as a first line of the plural images when the second determining means determines that the time difference is negative, and the image formation of the plural images other than the 'reference image Is output from the m-th line thereof such that the m-th line is output as a second line while outputting empty data in the first line when the second determining means determines that the time difference is positive.

In the above image forming device, the reference image is changeable.

The present invention further provides a writing control device, comprising: a scanning and writing device for scanning in a main scanning direction a body that moves in a sub-scanning direction with light beams according to image information when a main scanning synchronizing signal generated by the scanning and writing device is detected after an image forming start signal of the sub-scanning direction is detected, to write an image on the body, and repeating the scanning plural times to form plural images including a reference image, which are overlaid on a second body to form a color image thereon, wherein the scanning and writing device performs n (n>0) line scanning per one scanning. In a case of $t1<t2$, in which t1 represents a time lapsing from the detection of the image forming start signal to the detection of the main scanning synchronizing signal when the scanning and writing device starts writing the reference image; and t2 represents a time lapsing from the detection of the image forming start signal to the detection of the main scanning synchronizing signal when the scanning and writing device starts writing an image other than the reference image, the scanning and writing device starts writing the image other than the reference image from a (i+1)-th line where i represents an integer so as to minimize $|t1+T\times(i/n)-t2|$ where T represents a time interval at which the main scanning synchronizing signal is generated.

In the above writing control device, in a case of $t1>t2$, the scanning and writing device starts writing the image other than the reference image while delaying the scanning by (−m) lines where m represents an integer so as to minimize $|t1+T\times(m/n)-t2|$.

In the above writing control device, the scanning and writing device start writing the reference image from a (j+1)-th line where j represents a non-negative integer so as to minimize $|t1-T\times(j/n)|$ and the scanning and writing device starts writing the image other than the reference image from a (k+1)-th line where k represents an integer so as to minimize $|t1-T\times(j/n)+T\times(k/n)-t2|$.

In addition, a first image of the plural images can be used as the reference image. An assumptive image can also be used as the reference image, and wherein the assumptive image is obtained by averaging positions in the sub-scanning direction of images of the plural images that have been written.

Alternatively, when the plural images include at least two chromatic color images, one of the at least two chromatic color images is used as the reference image.

The plural images include at least three images, and wherein one of two images of the three images, which have a higher correlation with each other than any other combinations of the three images, is used as the reference image.

Furthermore, the reference image is changeable.

The present invention further provides a writing control device, comprising: a scanning and writing device for scanning in a main scanning direction a body that moves in a sub-scanning direction with light beams according to image information when a main scanning synchronizing signal generated by the scanning and writing device is detected after an image forming start signal of the sub-scanning direction is detected, to write an image on the body, and repeating the scanning plural times to form plural images including a reference image, which are overlaid on a second body to form a color image thereon. A time lapsing from the detection of the image forming start signal to the first detection of the main scanning synchronizing signal is t1 when the scanning and writing device writes the reference image, and a time lapsing from the detection of the image forming start signal to the first detection of the main scanning synchronizing signal is t2 when the scanning and writing device writes an image other than reference image.

The scanning and writing device starts writing the reference image at a time when the time t1 has lapsed from the detection of the image forming start signal for the reference image. The scanning and writing device starts writing an image other than the reference image from a first line at a time when the time t2 has lapsed from the detection of the image forming start signal for the image when t1 is less than a first predetermined time and |t1−t2| is less than a second predetermined time; when t1 is less than the first predetermined time and |t1−t2| is not less than the second predetermined time, the scanning and writing device starts writing the image other than the reference image from a second line at the time when t2 has lapsed from the detection of the image forming start signal for the image; when t1 is not less than the first predetermined time and |t1−t2| is less than the second predetermined time, the scanning and writing device starts writing the image other than the reference image from the first line at the time when t2 has lapsed from the detection of the image forming start signal for the image; and when t1 is not less than the first predetermined time and |t1−t2| is not less than the second predetermined time, the scanning and writing device starts writing the image other than the reference image from the first line at a time when t2+T has lapsed from the detection of the image forming start signal for the image, where T represents a time interval at which the main scanning synchronizing signal is generated.

In the above writing control device, the time t1 is an average time from the detection of the image forming start signals to the write starting times of images of the plural images that have been written.

In the above writing control device, a first image of the plural images can be is used as the reference image.

Alternatively, an assumptive image is used as the reference image, and wherein the assumptive image is obtained by averaging positions in the sub-scanning direction of images of the plural images that have been written.

When the plural images include at least two chromatic color images, one of the at least two chromatic color images is used as the reference image. The plural images include at least three images, and wherein one of two images of the three images, which have a higher correlation with each other than any other combinations of the three images, is used as the reference image. The first predetermined time can be T/2.

The present invention further provides a writing control device, comprising: a scanning and writing device for scanning in a main scanning direction a body that moves in a sub-scanning direction with light beams according to image information when a main scanning synchronizing signal generated by the scanning and writing device is detected after an image forming start signal of the sub-scanning direction is detected, to write an image on the body, and repeating the scanning plural times to form plural images including a reference image, which are overlaid on a second body to form a color image thereon. A time lapsing from the detection of the image forming start signal to the first detection of the main scanning synchronizing signal is t1 when the scanning and writing device writes the reference image, and a time lapsing from the detection of the image forming start signal to the first detection of the main scanning synchronizing signal is t2 when the scanning and writing device writes an image other theft reference image. The scanning and writing device starts writing the reference image from a first line at a time when the time t1 has lapsed from the detection of the image forming start signal for the reference image when the time t1 is less than a first predetermined time, and the scanning and writing device starts writing the reference image from a second line at the time when the time t1 has lapsed from the detection of the image forming start signal for the reference image when t1 is not less than a first predetermined time. The scanning and writing device starts writing an image other than the reference image from a first line at a time when the time t2 has lapsed from the detection of the image forming start signal for the image when the time t1 is less than a first predetermined time and |t1−t2| is less than a second predetermined time; when the time t1 is less than the first predetermined time and |t1−t2| is not less than the second predetermined time, the scanning and writing device starts writing the image other than the reference image from a second line at the time when the time t2 has lapsed from the detection of the image forming start signal for the image. When t1 is not less than the first predetermined time and |t1−t2| is less than the second predetermined time, the scanning and writing device starts writing the image other than the reference image from the second line at the time when the time t2 has lapsed from the detection of the image forming start signal for the 'image; and when t1 is not less than the first predetermined time and |t1−t2| is not less than the second predetermined time, the scanning and writing device starts writing the image other than the reference image from the first line at a time when the time t2 has lapsed from the detection of the image forming start signal for the image.

In the above writing control device, the time t1 is an average time from the detection of the image forming start signals to the write starting times of images of the plural images that have been written.

In the above writing control device, a first image of the plural images can be used as the reference image.

Alternatively, an assumptive image is used as the reference image, and wherein the assumptive image is obtained by averaging positions in the sub-scanning direction of images of the plural images that have been written. When the plural images include at least two chromatic color images, one of the at least two chromatic color images is used as the reference image. The plural images include at least three images, and wherein one of two images of the three images, which have a higher correlation with each other than any other combinations of the three images, is used as the reference image. In addition, the first predetermined time is T/2 where T represents a time interval at which the main scanning synchronizing signal is generated.

The present invention further provides an image forming device comprising: a body to be scanned by a scanning and writing device; any one of the writing control devices described above; and a second body on which the color image is formed.

The present invention further provides an image forming device comprising: any one of the writing control devices described above; a converting means for converting image information in a first color space into image information m a second color space; and a determining means for determining a correlation strength among color images in the second color space depending on an amount of the image information in the first color space. The color image is formed using the image information in the second color space.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

FIG. 27 is control block diagram according to another embodiment of the present invention;

DESCRIPTION OF THE PREFERRED EMBODIMENT

Figure 1:
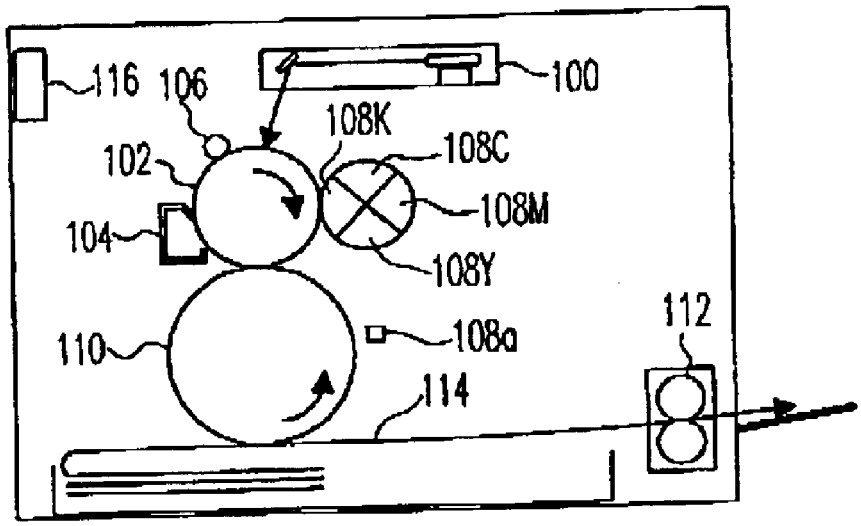
FIG. 1 (PRIOR ART)
FIG. 1 shows an example of a conventional image forming device.
Figure 6:
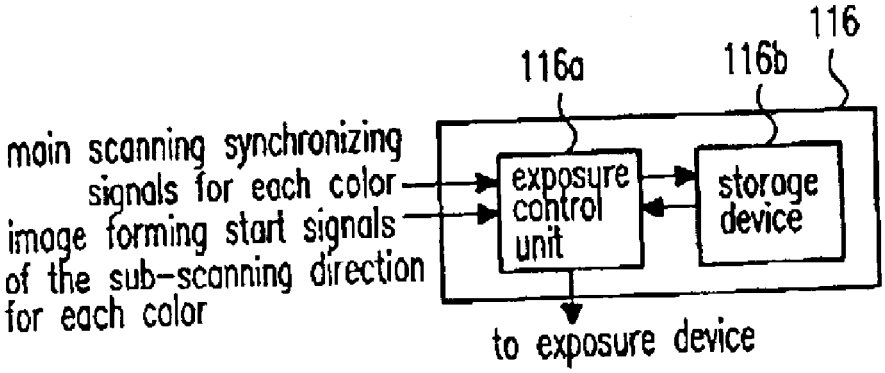
FIG. 6 is a block diagram of a controller according to embodiments of the present invention.

According to the embodiment of the present invention, referring to FIG. 6, the controller 116 in the image forming device shown in FIG. 1 comprises a writing control unit (exposure control unit) 116*a* for performing a writing (exposure) control and a storage device 116*b*, such as a memory device. The exposure control unit 116*a* and the storage device 116*b* forms a writing control device for controlling an optical writing operation of the optical writing device 100 shown in FIG. 2.

The exposure control unit 50 is connected to the storage device 54 to store data into the storage device 54 and to obtain data from the storage device 54 if necessary. A main scanning synchronizing signal (a main scanning synchronizing signal from the light receiving element 126) used when starting the optical writing operation for each color and an image forming start signal of the sub-scanning direction (an image forming start signal of the sub-scanning direction from the detecting means (61)) used when starting the optical writing operation for each color are input to the exposure control unit 116*a*. The exposure control unit 116*a* transmits an optical writing (exposure) start signal to the optical writing device 100 according to the main scanning synchronizing signal and image forming start signal of the sub-scanning direction.

Figure 7A:
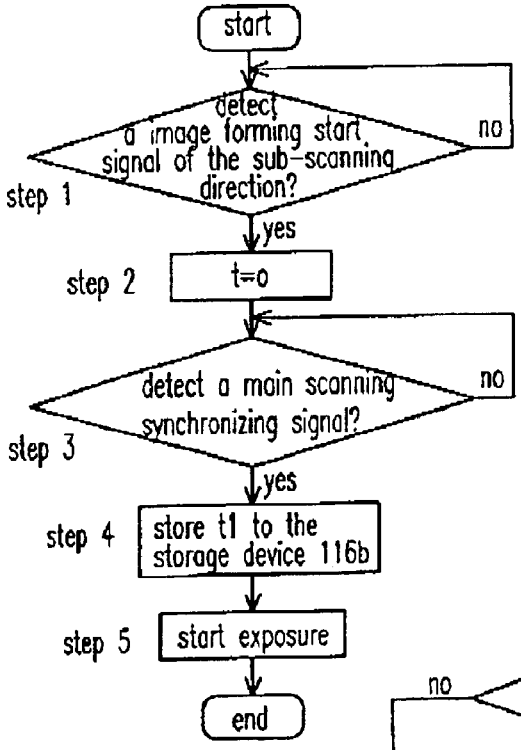
FIGS. 7A and 7B are flow charts of operations of the exposure control unit 52 according to one embodiment of the present invention.
Figure 7B:
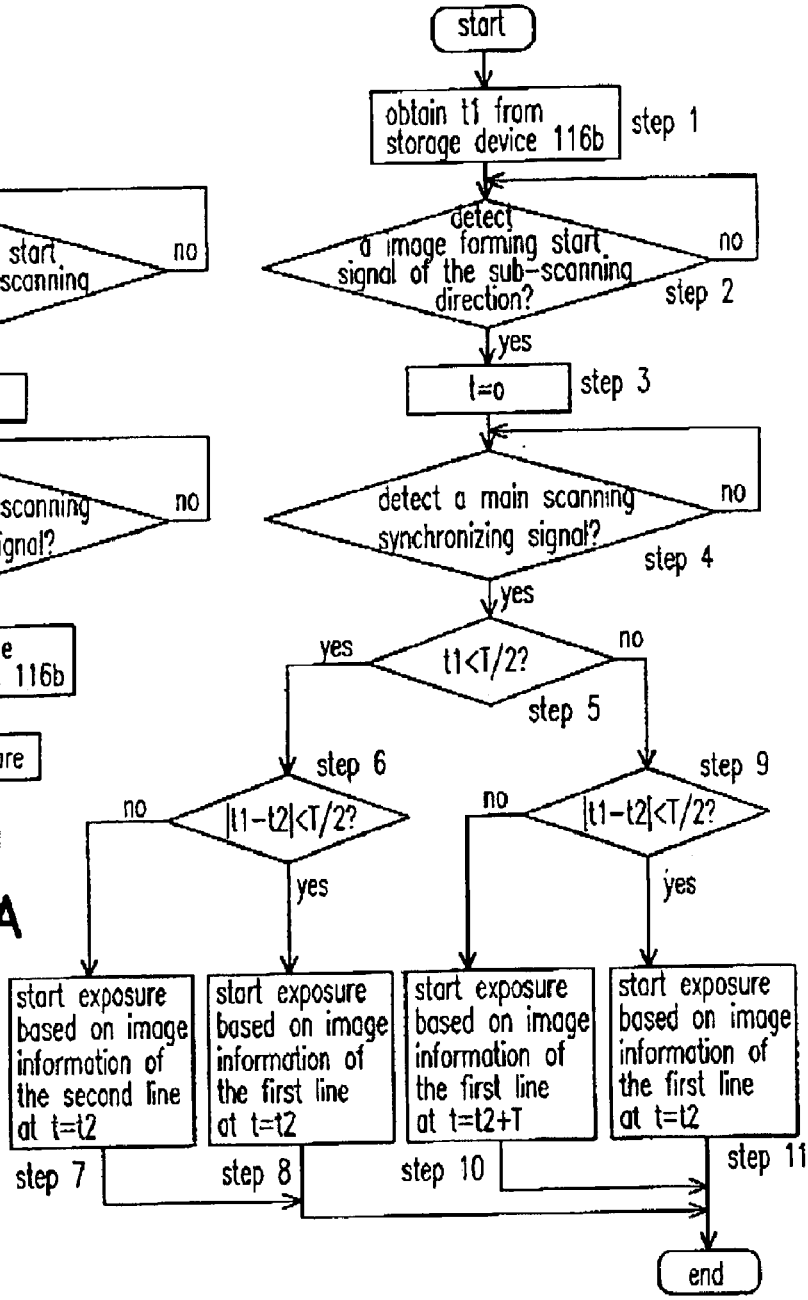

FIGS. 7A and 7B are flow charts of operations of the exposure control unit 116*a* according to one embodiment of the present invention. FIG. 7A is a flow chart related to an exposure control corresponding to image information of the first color, and FIG. 7B is a flow chart related to an exposure control corresponding to image information of the second color, the third color or the fourth color. Because the exposure control for the second, the third or the fourth color are the same, time t2 is also used to represent time t2, t3 and t4 depicted in FIG. 7B.

As shown in FIG. 7A, when an exposure control corresponding to image information of the first color is performed, the exposure control unit 116*a* checks regularly the image forming start signal of the sub-scanning direction that comes from the detecting means (61) and then determines as to whether the image forming start signal of the sub-scanning direction is detected (Step 1). If the image forming start signal of the sub-scanning direction is detected, time t is set as t=0 (Step 2). Next, the exposure control unit 116*a* checks regularly the main scanning synchronizing signal that comes from the light receiving means 126 and then determines as to whether the main scanning synchronizing signal is detected (Step 3). If the main scanning synchronizing signal is detected, time t1 at which the main scanning synchronizing signal is detected is stored in the storage device 116*b* (Step 4) and the optical writing device 100 is made to start the exposure operation.

On the other hand, as shown in FIG. 7B, when an exposure control corresponding to image information of the second, the third or the fourth color is performed, the exposure control unit 116*a* obtains time t1, at which the main scanning synchronizing signal is detected when starting the exposure corresponding to image information of the first color, from the storage device 116*b* (Step 1). Then, the exposure control unit 116*a* checks regularly the image forming start signal of the sub-scanning direction that comes from the detecting means (61) and then determines as to whether the image forming start signal of the sub-scanning direction is detected (Step 2). If the image forming start signal of the sub-scanning direction is detected, time t is set as t=0 (Step 3). Next, the exposure control unit 116*a* checks regularly the main scanning synchronizing signal that comes from the light receiving means 126 and then determines as to whether the main scanning synchronizing signal is detected (Step 4). If the main scanning synchronizing signal is detected, the exposure control unit 116*a* determines whether time t1 is smaller than a prescribed time, for example, T/2 (Step 5).

If time t1<T/2, the exposure control unit 116*a* uses times t1 and t2, at which corresponding main scanning synchronizing signals are detected, to determines as to whether |t1−t2| is smaller than a prescribed time, for example, T/2 (Step 6). When |t1−t2|<T/2 is determined at Step 6, the optical writing device 100 is made to start the exposure operation from image information of the first line at time t=t2 (Step 8). When |t1−t2| is equal to or larger than T/2 at Step 6, the optical writing device 100 is made to start the exposure operation from image information of the second line at time t=t2 (Step 7). Namely, at Step 7, the image formation due to the exposure corresponding to image information of the first line is not processed. In addition, in the image forming device of the embodiment, image information sent from a scanner or a computer is stored with a bitmap format in a image information storage means (not shown) within the controller 116. A control of the exposure control unit 116*a*, which is to start the exposure from image information of the first line or to start the exposure from image information of the second line, is to read image information from the image information storage means and controlled by an image information reading start address in the image information storage means when transmitting information to the optical writing device 100.

On the other hand, if time t1≧T/2, the exposure control unit 116*a* determines as to whether |t1−t2| is smaller than a prescribed time, for example, T/2 (Step 9). When |t1−t2|<T/2 is determined at Step 9, the optical writing device 100 is made to start the exposure operation from image information of the first line at time t=t2 (Step 11). When |t1−t2| is equal to or larger than T/2 at Step 9, the optical writing device 100 is made to start the exposure operation from image information of the second line at time t=t2+T (Step 10). In the situation at Step 10, the optical writing device 100 delays image information by only one line to perform the scanning operation. As could be understood from the above description, at Steps 10 and 11, an exposure start time is selected in such a manner that dots formed by the exposure corresponding to image information of the second, the third and the forth colors at positions closer to dots formed by the exposure corresponding to image information of the first color.

Figure 3:
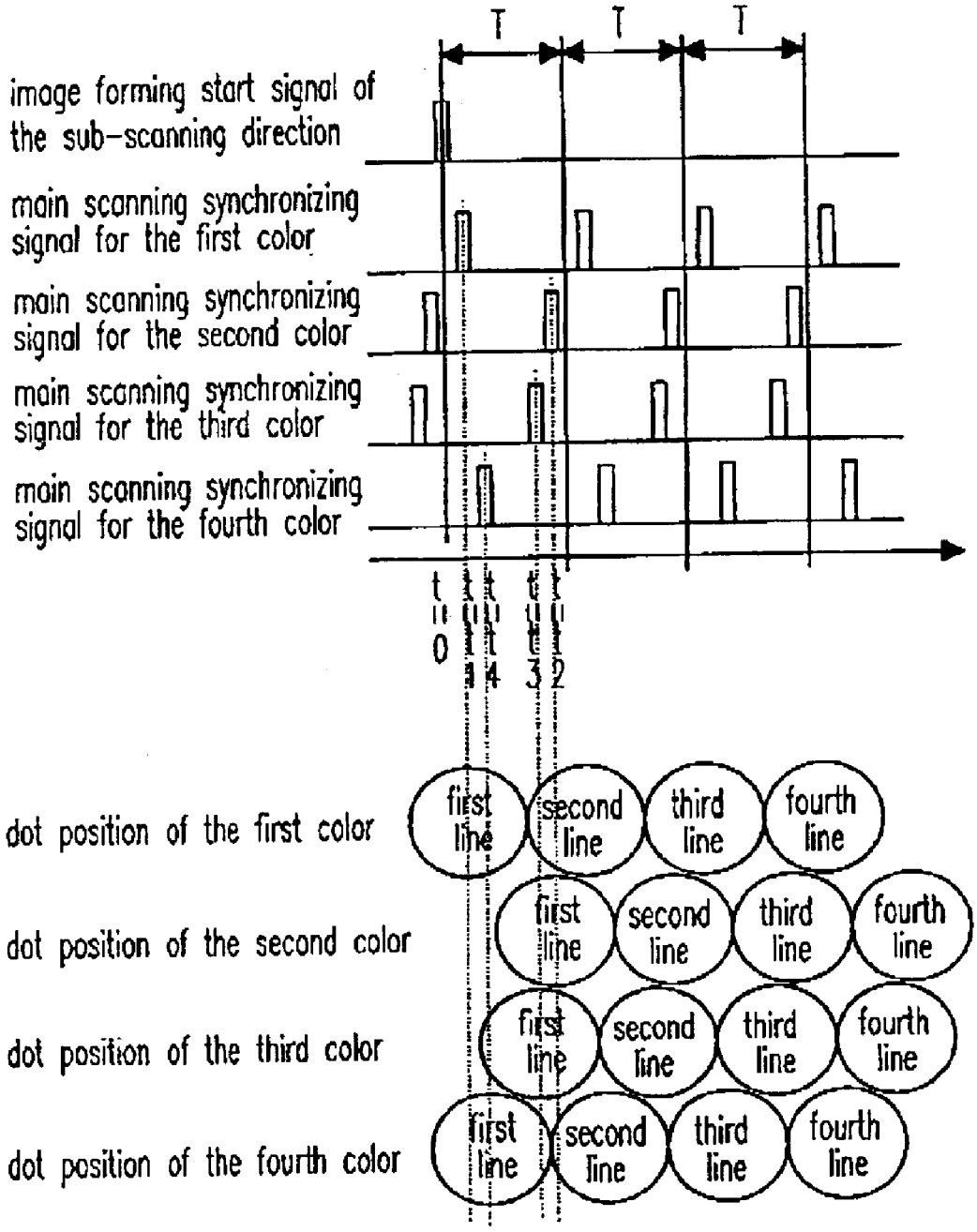
FIG. 3 (PRIOR ART)
FIG. 3 is a timing diagram showing an operation of the image forming device in FIG. 1.
Figure 4:
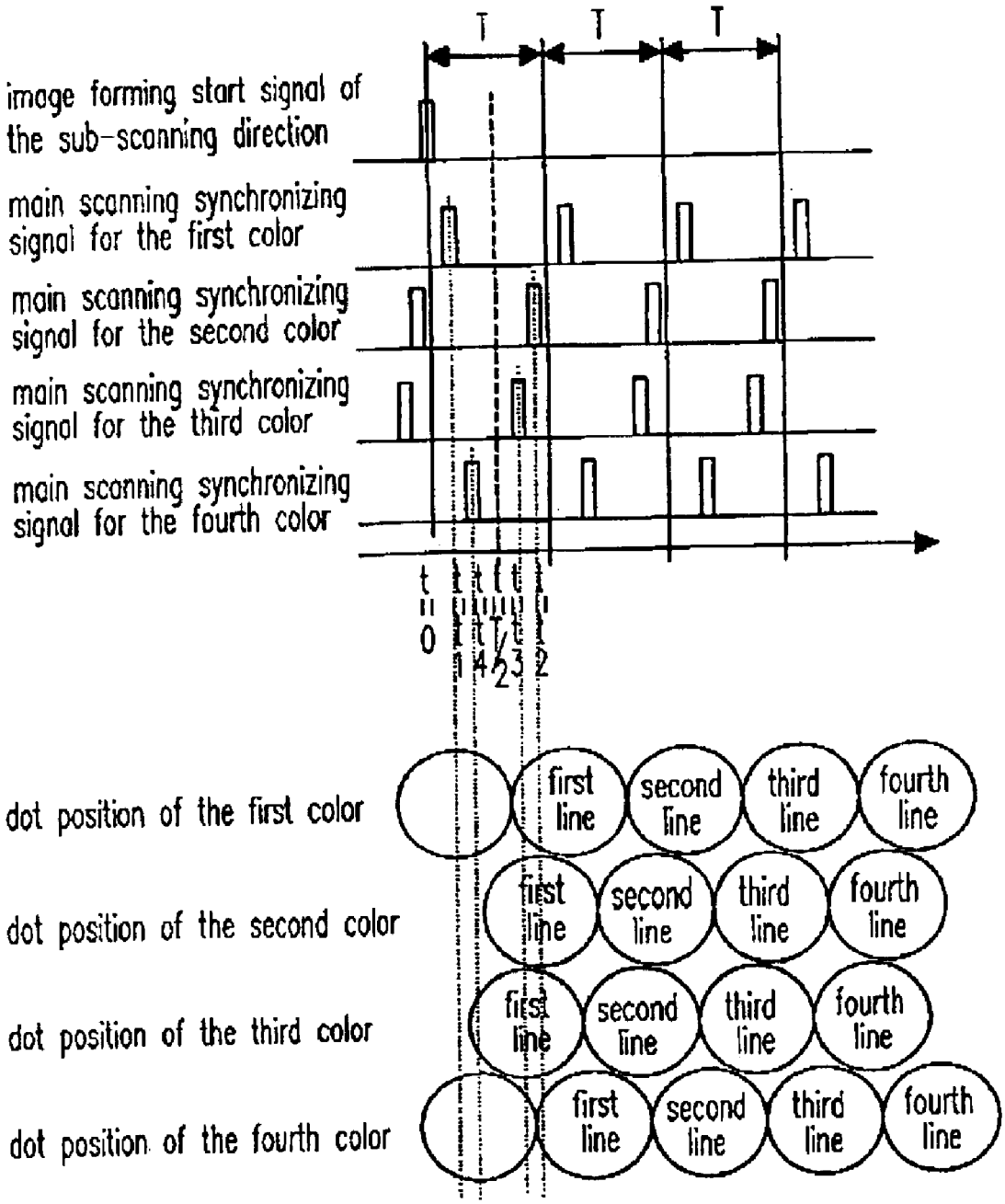
FIG. 4 (PRIOR ART)
FIG. 4 shows dot positions of each color according to the conventional method.
Figure 5:
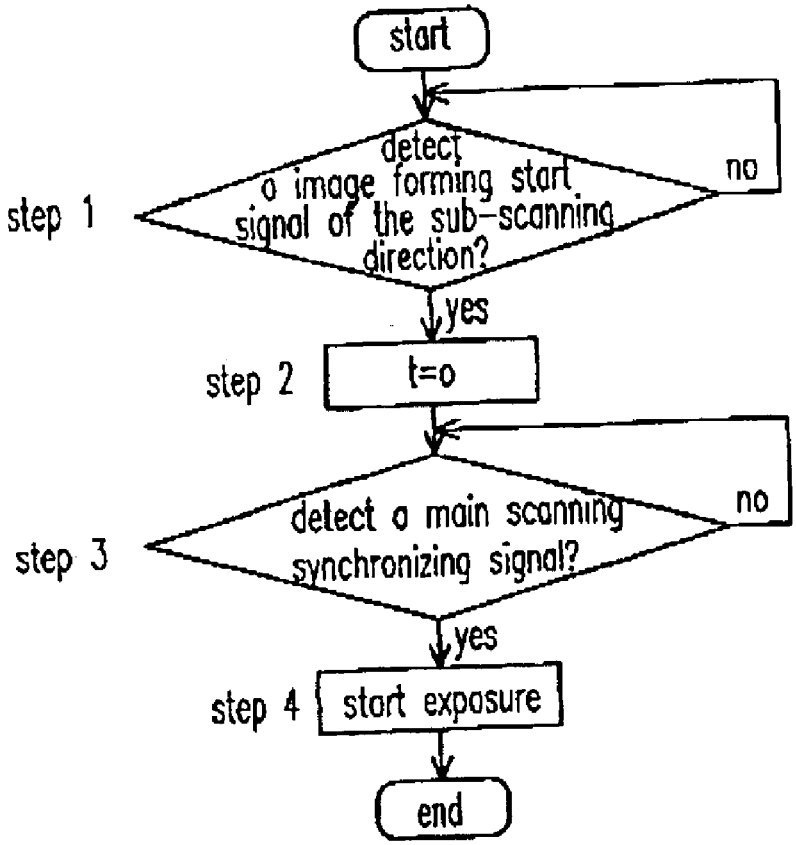
FIG. 5 (PRIOR ART)
FIG. 5 is a flow chart showing an operation of the image forming device in FIG. 1.
Figure 8:
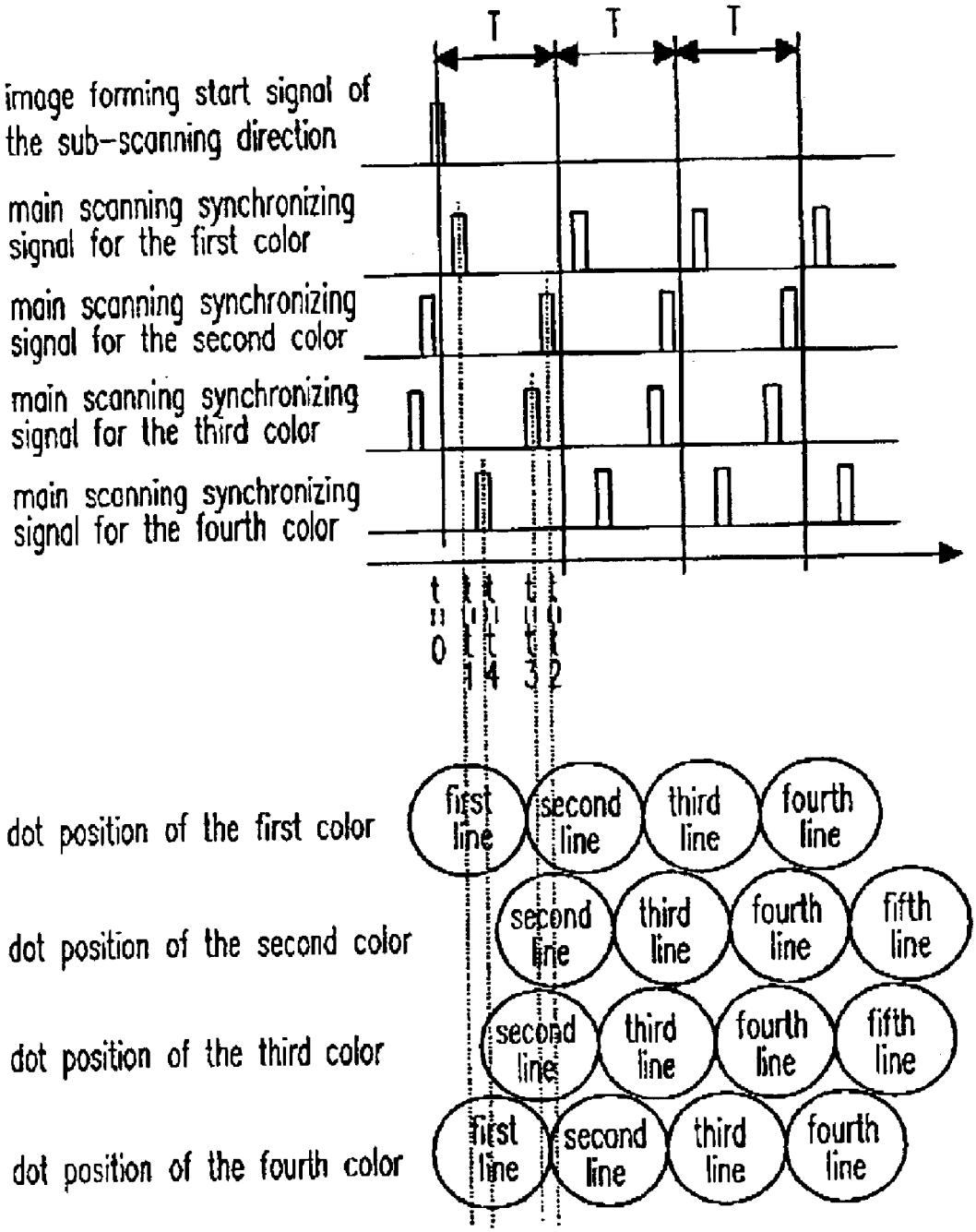
FIG. 8 shows dot positions formed according to present embodiment with respect to a situation shown in FIG. 3.

FIG. 8 shows dot positions formed according to present embodiment with respect to a situation shown in FIG. 3. In the situation shown in FIG. 8, time t1 is smaller than T/2 in the exposure for the first color, |t1−t2| is equal to or larger than T/2 in the exposures for the second and the third colors, and time t4 is smaller than T/2 in the exposure for the fourth color. Therefore, by implementing Steps 6, 7 and 8, the exposure for the second color and the exposure for the third color start from image information of the second line, and the exposure for the first color and the exposure for the fourth color start from image information of the first line. By performing an exposure control in the aforementioned manner, when time t1 is smaller than T/2, position shifts of image information of the second line and after the second line of the second, the third and the fourth colors can be suppressed to half of a dot pitch with respect to image information of the first color.

In the present embodiment, by further arranging Steps 5, 8, 10 and 11, even though time t1 is equal to or greater than T/2, position shifts of image information of the second line and after the second line of the second, the third and the fourth colors can also be suppressed to half of a dot pitch with respect to image information of the first color. In this way, for all situation, position shifts of image information of the second line and after the second line of the second, the third and the fourth colors can also be suppressed to half of a dot pitch with respect to image information of the first color.

Figure 9:
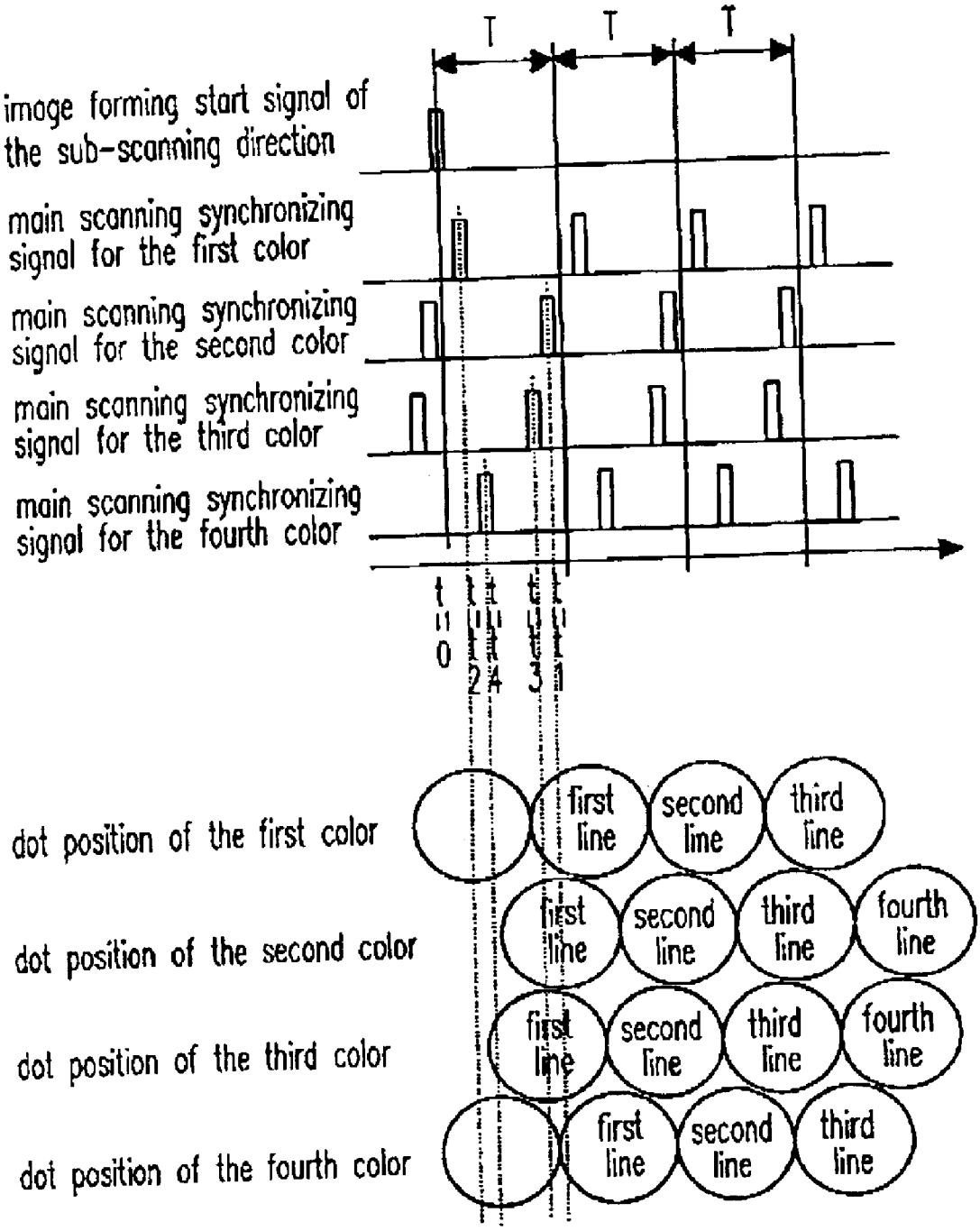
FIG. 9 shows an implementing result of Steps 9, 10 and 11 according to the present embodiment.

FIG. 9 shows an implementing result of Steps 9, 10 and 11 according to the present embodiment. For the situation shown in FIG. 9, time t1 is equal to or larger than T/2, |t1−t2| is equal to or larger than T/2 in the exposures for the second and the fourth colors, |t1−t2| is smaller than T/2 in the exposures for the third color. Therefore, by implementing Steps 9, 10 and 11, the exposure times for the second color and the fourth color start at time t2+T and at time t4+T respectively. Namely, in the exposures for the second and the fourth colors, the scanning operation is performed by delaying image information by only one line. By performing an exposure control in the aforementioned manner, when time t1 is smaller than T/2, position shifts of image information of the second line and after the second line of the second, the third and the fourth colors can be suppressed to half of a dot pitch with respect to image information of the first color.

According to the above embodiment, position shifts of image information of other colors can be suppressed to half of a dot pitch with respect to image information of the first color or the second color that is used as a reference color. Additionally, a color deviation of the toner image, which is caused by that the main scanning synchronizing signal and image forming start signal of the sub-scanning direction are not synchronized, can also be avoided. At Steps 5, 6 and 9, the prescribed time used to compare with t1 and |t1−t2| is set T/2, but a value around T/2 can also be used to obtain substantially the same effect and result. Furthermore, at Steps 5, 6 and 9, even though the prescribed time used to compare with t1 and |t1−t2| is larger than 0 and smaller than T, position shifts of image information of other colors can be reduced to half of a dot pitch with respect to image information of the reference color.

Figure 10A:
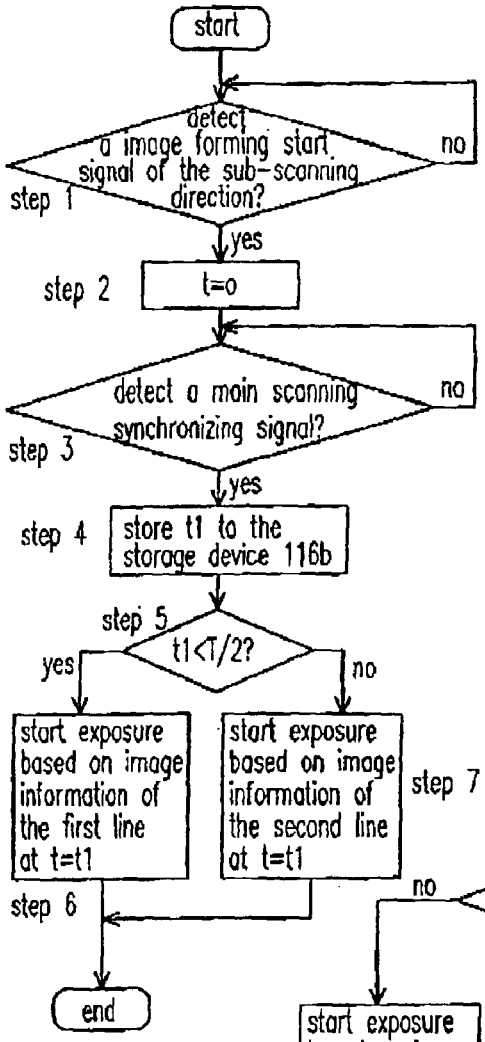
FIGS. 10A and 10B are flow charts of operations of the exposure control unit 116*a* according to the second embodiment of the present invention.
Figure 10B:
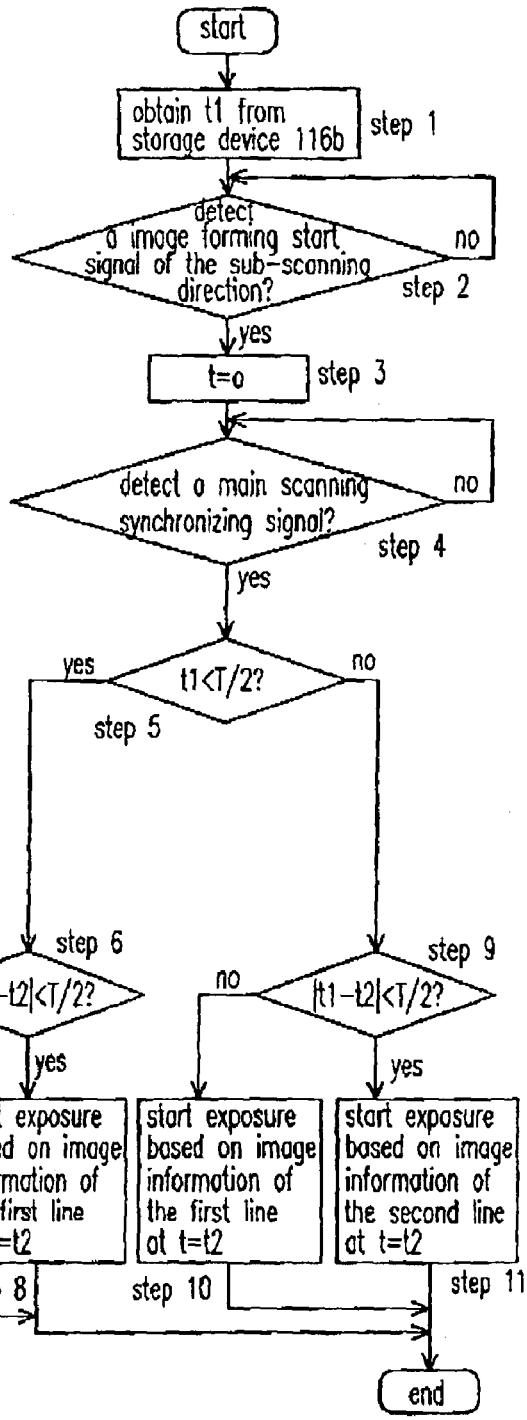

Next, the second embodiment according to the present invention is described in detail. In the image forming device of the second embodiment, the exposure control unit 116*a* performs following processes. FIGS. 10A and 10B are flow charts of operations of the exposure control unit 116*a* according to the second embodiment of the present invention. FIG. 10A is a flow chart related to an optical writing (exposure) operation corresponding to image information of the first color, and FIG. 10B is a flow chart related to an optical writing (exposure) operation corresponding to image information of the second color, the third color or the fourth color. Because the exposure control for the second, the third or the fourth color are the same, time t2 is also used to represent time t2, t3 and t4 depicted in FIG. 10B.

As shown in FIG. 10A, when an exposure control corresponding to image information of the first color is performed, the exposure control unit 116*a* checks regularly the image forming start signal of the sub-scanning direction that comes from the detecting means (61) and then determines as to whether the image forming start signal of the sub-scanning direction is detected (Step 1). If the image forming start signal of the sub-scanning direction is detected, time t is set as t=0 (Step 2). Next, the exposure control unit 116*a* checks regularly the main scanning synchronizing signal that comes from the light receiving means 126 and then determines as to whether the main scanning synchronizing signal is detected (Step 3). If the main scanning synchronizing signal is detected, time t1, at which the main scanning synchronizing signal is detected, is stored to the storage device 116*b* (Step 4).

Next, the exposure control unit 116*a* determines as to whether time t1 is smaller than T/2 (Step 5). When time t1 is smaller than T/2, the optical writing device 100 starts an exposure operation corresponding to image information from image information of the first line. In addition, if time t1 is equal to or larger than T/2, the exposure control unit 116*a* controls the optical writing device 100 to start an exposure operation corresponding to image information from image information of the second line at time t1 (Step 7). Namely, at Step 7, the image formation due to the exposure corresponding to image information of the first line is not processed.

On the other hand, when an exposure control corresponding to image information of the second, the third or the fourth color is performed, the exposure control unit 116*a* obtains time t1, at which the main scanning synchronizing signal is detected when starting the exposure corresponding to image information of the first color, from the storage device 116*b* (Step 1). Then, the exposure control unit 116*a* checks regularly the image forming start signal of the sub-scanning direction that comes from the detecting means (61) and then determines as to whether the image forming start signal of the sub-scanning direction is detected (Step 2). If the image forming start signal of the sub-scanning direction is detected, time t is set t=0 (Step 3). Next, the exposure control unit 116*a* checks regularly the main scanning synchronizing signal that comes from the light receiving means 126 and then determines as to whether the main scanning synchronizing signal is detected (Step 4). If the main scanning synchronizing signal is detected, the exposure control unit 116*a* determines as to whether time t1 is smaller than a prescribed time, for example, T/2 (Step 5).

If time t1<T/2, the exposure control unit 116*a* uses times t1 and t2, at which corresponding main scanning synchronizing signals are detected respectively, to determines as to whether |t1−t2| is smaller than a prescribed time, for example, T/2 (Step 6). When |t1−t2|<T/2 is determined at Step 6, the optical writing device 100 is made to start the exposure operation from image information of the first line at time t=t2 (Step 8). When |t1−t2| is equal to or larger than T/2 at Step 6, the optical writing device 100 is made to start the exposure operation from image information of the second line at time t=t2 (Step 7). Namely, at Step 7, the image formation due to the exposure corresponding to image information of the first line is not processed.

Additionally, if time t1≧T/2, the exposure control unit 116*a* determines as to whether |t1−t2| is smaller than T/2 (Step 9). When |t1−t2|<T/2 is determined at Step 9, the optical writing device 100 is made to start the exposure operation from image information of the second line at time t=t2 (Step 11). When |t1−t2| is equal to or larger than T/2 at Step 9, the optical writing device 100 is made to start the exposure operation from image information of the first line at time t=t2 (Step 10). Namely, at Steps 10 and 11, according to whether dots formed by the exposure corresponding to the image formations of the second, the third and the forth colors are formed at positions closer to dots of the second line of the first color, the image formations of the second, the third and the forth colors are selected from the first line or the second line.

Figure 11:
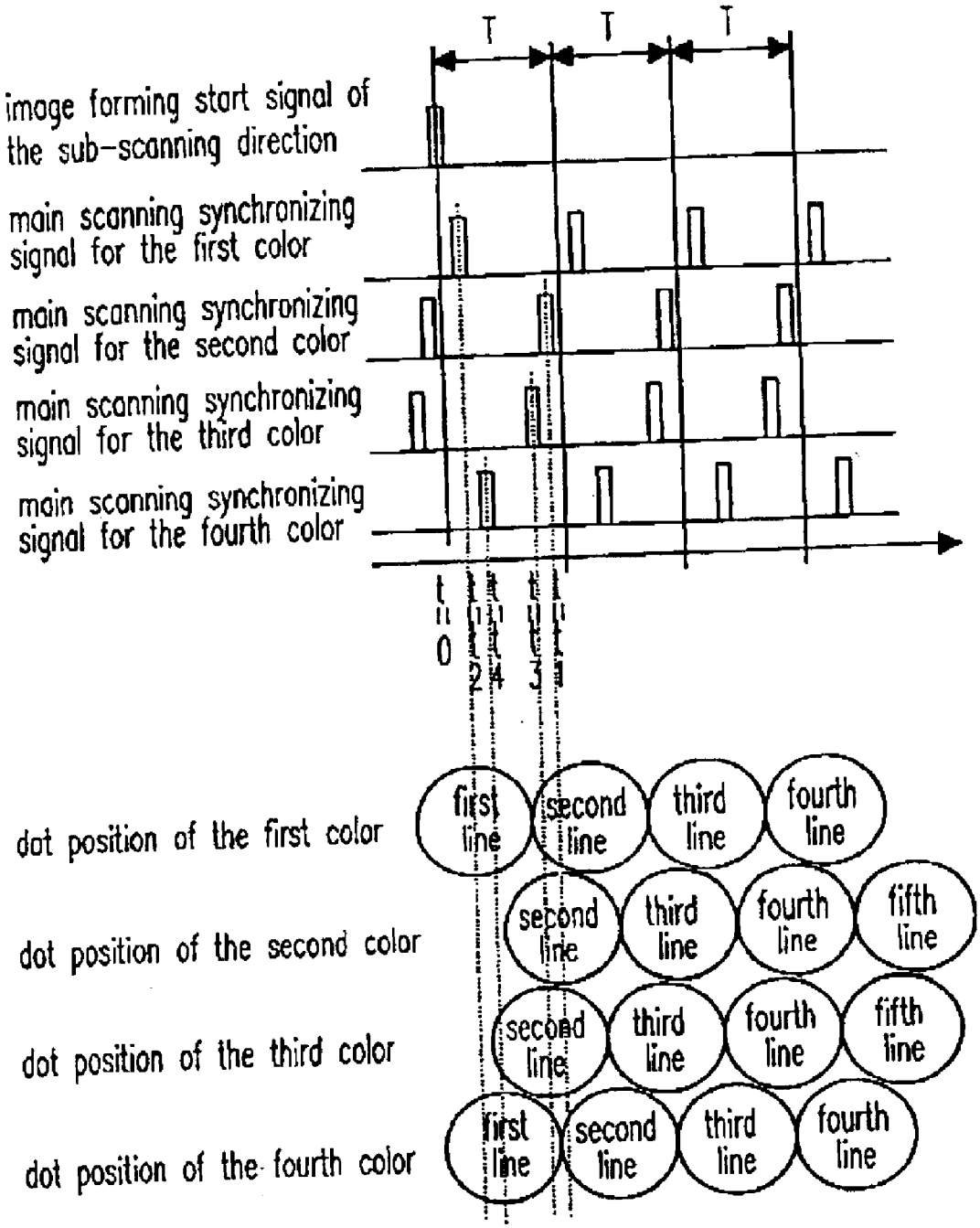
FIG. 11 shows dot positions formed according to the second embodiment.

FIG. 11 shows dot positions formed according to the second embodiment. In the situation shown in FIG. 8, time t1 is equal to or larger than T/2 in the exposure for the first color, |t1−t2| is equal to or larger than T/2 in the exposures for the second and the fourth colors, and time |t1−t2| is smaller than T/2 in the exposure for the third color. Therefore, by implementing Steps 5, 6 and 7 shown in FIG. 10A, the exposure for the first color starts from image information of the second line. In addition, by implementing Steps 9, 10 and 11 shown in FIG. 10B, the exposure for the second and the fourth colors start from image information of the first line. The exposure for the third color starts from image information of the second line. By performing an exposure control in the aforementioned manner, when time t1 is equal to or larger than T/2, position shifts of image information of the second line and after the second line of the second, the third and the fourth colors can be suppressed to half of a dot pitch with respect to image information of the first color.

In the second embodiment, by further arranging Steps 6, 7 and 8 in FIG. 10B, even though time t1 is smaller than T/2, position shifts can also be suppressed to half of a dot pitch. In this way, for all situations, position shifts can also be suppressed to half of a dot pitch. In the second embodiment, for the situation shown in FIG. 11, the second color is first adopted to perform the image formation and the first color is the secondly adopted to perform the image formation. Time t1 is a timing that the main scanning synchronizing signal has been reached when performing the exposure corresponding to image information of the second color, and time t2 is a timing that the main scanning synchronizing signal has been reached when performing the exposure corresponding to image information of the first color. A bottom part shown in FIG. 11 is a result of implementing Steps 6, 7 and 8.

As shown in FIG. 11, when the image formation is processed with a sequence of the second color, the first color, the third color and the fourth color, time t2 is smaller than T/2, |t1−t2| is equal to or larger than T/2 in the exposures for the first and the third colors, and |t1−t2| is smaller than T/2 in the exposures for the fourth color. Therefore, by implementing Steps 6, 7 and 8, the exposures corresponding image information start from the second line at time t1 and time t3 for the exposures corresponding to image information of the first color and the third color, and the exposure corresponding image information starts from the first line at time t3 for the exposure corresponding to image information of the fourth color. By performing an exposure control in the aforementioned manner, when time t1 is smaller than T/2, position shifts of image information of the first, the third and the fourth colors can be suppressed to half of a dot pitch with respect to image information of the second color.

According to the second embodiment, position shifts of image information of other colors can be suppressed to half of a dot pitch with respect to image information of the first color or the second color that is used as a reference color. Additionally, a color deviation of the toner image, which is caused by that the main scanning synchronizing signal and image forming start signal of the sub-scanning direction are not synchronized, can also be avoided. At Steps 5, 6 and 9, the prescribed time used to compare with t1 and |t1−t2| is set T/2, but a value around T/2 can also be used to obtain substantially the same effect and result. Furthermore, at Steps 5, 6 and 9, even though the prescribed time used to compare with t1 and |t1−t2| is larger than 0 and smaller than T, position shifts of image information of other colors can be reduced to half of a dot pitch with respect to image information of the reference color.

Figure 12:
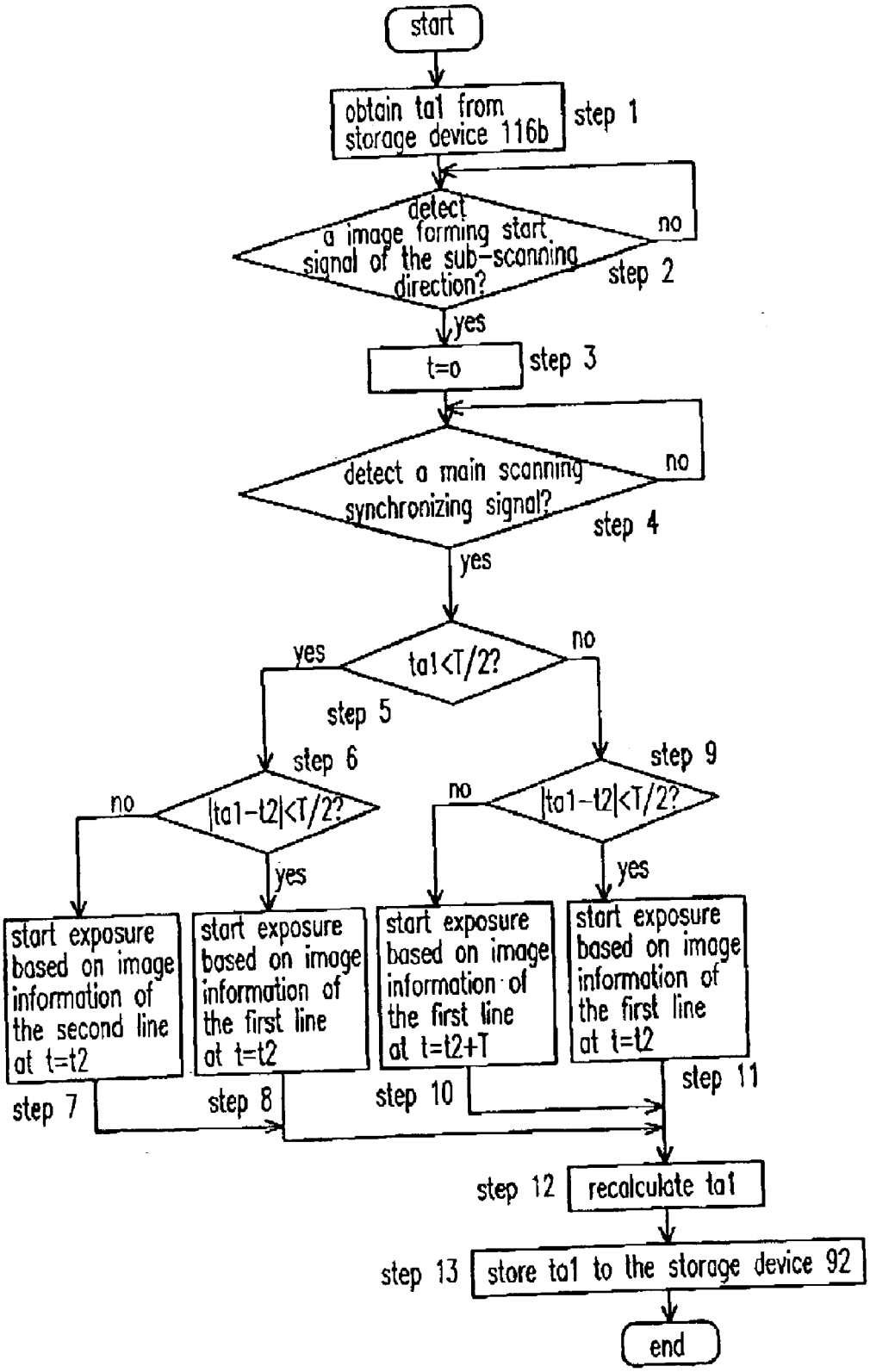
FIG. 12 is a flow chart of an optical writing (exposure) control corresponding to image information of the second, the third and the fourth colors according to the third embodiment of the present invention.

Next, the third embodiment according to the present invention is described in detail. The image forming device of the third embodiment is different from the first embodiment in a control method of the exposure control unit 116*a* for an optical writing (exposure) control corresponding to image information of the second color. FIG. 12 is a flow chart of an optical writing (exposure) control corresponding to image information of the second, the third and the fourth colors according to the third embodiment of the present invention. The flow chart shown in FIG. 12 is substantially the same as the flow chart shown in FIG. 7B. In the flow chart shown in FIG. 12, only Steps 1, 12 and 13 are different from the flow chart shown in FIG. 7B. In addition, the exposure control corresponding to image information of the second, the third or the fourth color are the same, and therefore, time t2 is also used to represent time t2, t3 and t4 depicted in FIG. 12.

As shown in FIG. 12, the exposure control unit 116*a* obtains time ta1 from the storage device 116*b* to replace time t1 at Step 1. ta1 is an average value corresponding to image information of the first line of colors whose corresponding image formation has to be executed. When the currently existing image formation is an image of the second color, ta1 is t1. When the currently existing image formation is an image of the third color, ta1 is an average value of t1 and t2. When the currently existing image formation is an image of the fourth color, ta1 is an average value of t1, t2 and t3.

Namely, according to the third embodiment, the exposure control unit 116*a* uses an average time as a reference, in which the average time is an average of exposure times corresponding to image information of the first line of colors whose corresponding image formation has been executed. Then, an exposure control corresponding to image information of the second, the third and the fourth colors is initiated. In the third embodiment, as compared with the first embodiment in which time t1 is used as the reference, position shifts of dots of the third and the fourth colors can be further reduced. In this embodiment, for a sake of a common circuit to calculate the average value ta1, a circuit same as the circuit for the exposure corresponding to image information of the second, the third and the fourth colors is used to calculate the average value ta1.

Proceeding to Step 12 from Steps 7, 8, 10 and 11, at Step 12 the exposure control unit 116*a* uses an exposure start time corresponding to image information of a new first line determined by Steps 7, 8, 10 and 11 to recalculate the average value ta1. When calculating the average value ta1, the exposure control unit 116*a* can execute imaginarily an exposure corresponding to image information of the first line to obtain an exposure start time, even though for a color that an exposure corresponding to image information of the first line is not actually performed. Therefore, a negative value can be obtained for the average value. Next, the exposure control unit 116*a* stores the newly calculated average value ta1 to the storage device 116*b*.

Figure 13:
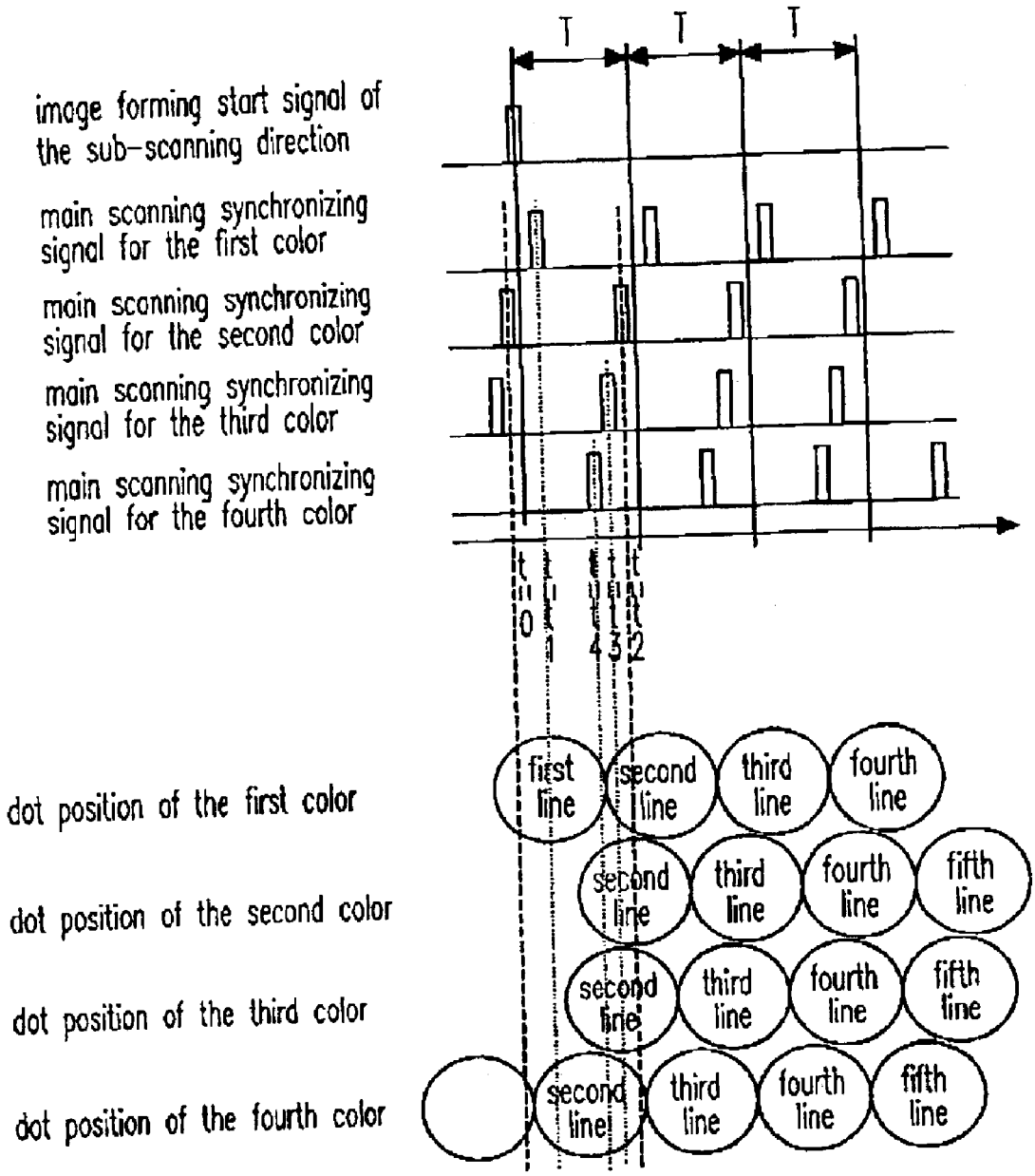
FIG. 13 shows dot positions formed according to the third embodiment.

FIG. 13 shows dot positions formed according to the third embodiment. In this example, during an image formation to perform an exposure corresponding to image information of the fourth color, ta1 is smaller than T/2, |t1−t4| is smaller than T/2, and |ta1−t4| is larger than T/2. In the first embodiment, during an image formation to perform an exposure corresponding to image information of the fourth color, performing an exposure at time t4 is image information of the first line for |t1−t4| is smaller that T/2. However, in fact, time t4 is closer to ta1+T than ta1, wherein ta1+T is an average time of an exposure start time corresponding to image information of the second line and ta1 is an average time of an exposure start time corresponding to image information of the first line. In the third embodiment, Step 7 is executed for |ta1−t4| is larger than T2 and the exposure starts from the second line. Namely, image information is delayed by only one line. Therefore, a position shift of the fourth color image is reduced with respect to an average position shift of an image of the first, the second and the third colors, and the color deviation is also reduced.

According to the third embodiment, a color deviation of the toner image, which is caused by that the main scanning synchronizing signal and image forming start signal of the sub-scanning direction are not synchronized, can be avoided. Furthermore, by using an assumptive image, which averages positions in the sub-scanning direction of the image where the scanning operation has been started by the optical writing device, as a reference image, position shifts of image where scan starts from the third one can be further reduced.

Next, the fourth embodiment according to the present invention is described in detail. In the image forming device of the fourth embodiment, only an exposure control corresponding to image information of the second, the third and the fourth colors, which is implemented by the exposure control unit 116*a*, is different from the second embodiment. In the fourth embodiment, the exposure control unit 116*a* executes substantially the flow chart shown in FIG. 7B, but two steps the same as Steps 12 and 13 in FIG. 12 are added right before END and these two steps are executed after Steps 7, 8, 10 and 11 in FIG. 7B.

In this way, the exposure control unit 116*a* uses a time, which averages the exposure start times corresponding to the first line of colors whose corresponding image formation is already finished, as a reference to perform an exposure control corresponding to image information of the second, the third and the fourth colors. Therefore, in the fourth embodiment, as compared with the first embodiment that time t1 is used as a reference, dot position shifts of dots formed by the exposure corresponding to image information of the third and the fourth colors can be further reduced. According to the fourth embodiment, a color deviation of the toner image, which is caused by that the main scanning synchronizing signal and image forming start signal of the sub-scanning direction are not synchronized, can be avoided.

Next, the fifth embodiment according to the present invention is described in detail. In the fifth embodiment, the light source 120 of the optical writing device 100 in the first embodiment uses a multi-beam light source. This single light source can generate n light beams (n>0). For convenience, n light beams that form the multi-beam are sequentially represented by the first beam, the second beam, . . . , and n-th beam, etc. along the sub-scanning direction, starting from a light beam that performs a scanning operation corresponding to image information whose line number is small.

Figure 2:
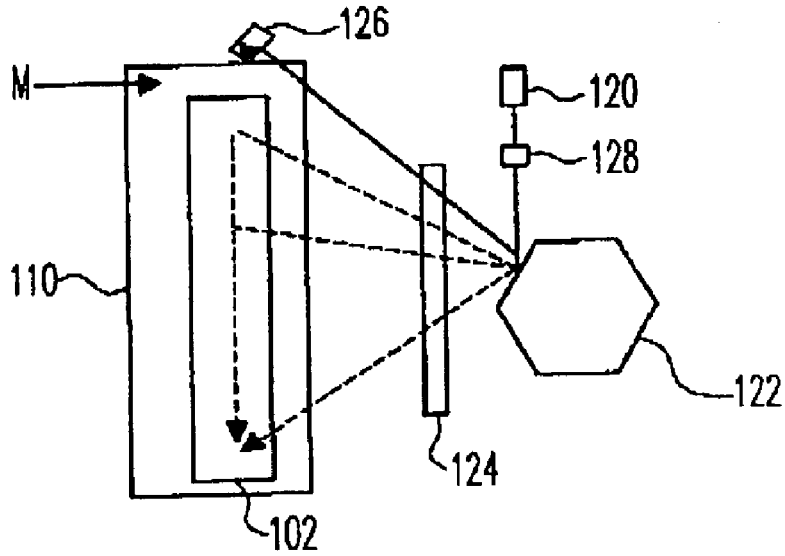
FIG. 2 (PRIOR ART)
FIG. 2 is a top view showing a portion of a structure of an optical writing device in the image forming device in FIG. 1.

In the optical writing device 100, the light source 120 is modulated according to image information by a modulating means (not shown). n lease beams, which are repeatedly modulated in sequence by image information of the same color, are emitted. Performing this operation sequentially according to image information of the black color, the magenta color, the cyan color and the yellow color, n laser beams, which are sequentially modulated by image information of the black color, the magenta color, the cyan color and the yellow color are emitted. As shown in FIG. 2, n light beams from the light source 120 are collimated by a collimator lens (15), and then defected by a deflection face of the rotational polygon mirror 122 (as a scanning means). The polygon mirror 122 is rotationally driven by a driving means (not shown) so as to scan repeatedly in the main scanning direction. The laser beams from the polygon mirror 122 are throttled by an imaging lens 124 and then imaged as laser spots with a fixed interval on the photosensor 102 in the sub-scanning direction. By the rotational polygon mirror 122 being rotationally driven by a driving means (not shown), the laser spots scan the photosensor 102 repeatedly in the main scanning direction to form an electrostatic latent image on the photosensor 102.

Figure 17:
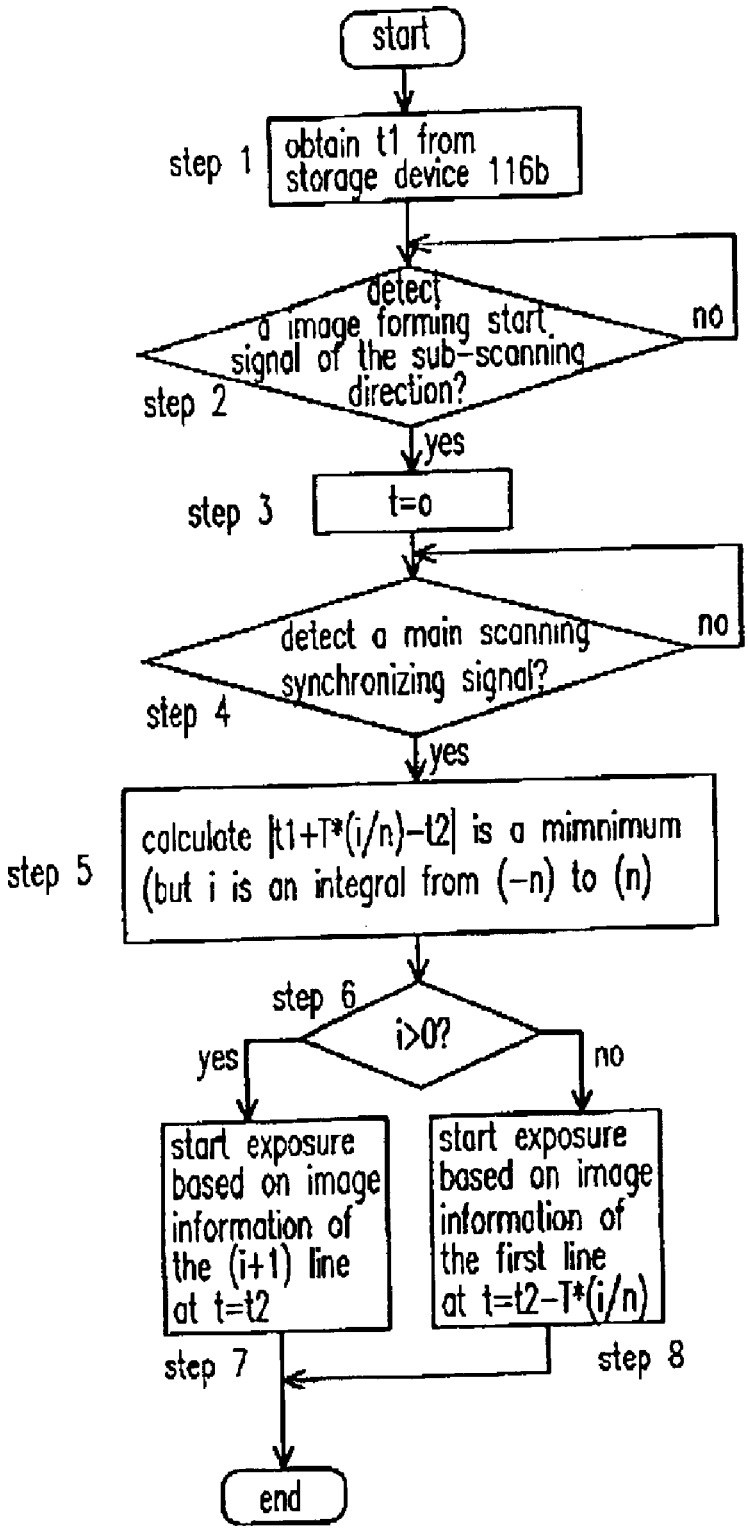
FIG. 17 is a flow chart showing a control flow of the exposure control unit according to the fifth embodiment of the present invention.

FIG. 17 is a flow chart showing a control flow of the exposure control unit 116*a* according to the fifth embodiment of the present invention. A control flow related to the optical writing (exposure) control corresponding to image information of the first color is the same as the flow chart shown in FIG. 7A. The exposure control unit 116*a* controls the optical writing device 100 to perform an optical writing control corresponding to image information of the first color by each laser beam, and this control scheme is the same as the first embodiment.

FIG. 17 shows an optical writing (exposure) control flow corresponding to image information of the second, the third and the fourth colors. Because the exposure control for the second, the third or the fourth color are the same, time t2 is also used to represent time t2, t3 and t4 depicted in FIG. 7B.

When performing the exposure control for the second, the third and the fourth colors, the exposure control unit 116*a* performs the optical writing (exposure) control flow corresponding to image information of second, the third and the fourth colors as shown in FIG. 17. First, the exposure control unit 116*a* obtains time t1 from the storage device 116*b*, wherein time t1 is a time where a main scanning synchronizing signal is detected when starting an exposure corresponding to image information of the first color (Step 1). The exposure control unit 116*a* checks regularly the image forming start signal of the sub-scanning direction that comes from the detecting means (61) and then determines as to whether the image forming start signal of the sub-scanning direction is detected (Step 2). If the image forming start signal of the sub-scanning direction is detected, time t is set t=0 (Step 3).

Next, the exposure control unit 116*a* checks regularly the main scanning synchronizing signal that comes from the light receiving means 126 and then determines as to whether the main scanning synchronizing signal is detected (Step 4). If the main scanning synchronizing signal is detected, a recursion calculation is executed in order to obtain an integer i such that $|t1+T\times(i/n)-t2|$ is a minimum (Step 5), wherein i is an integer from −n+1 to n−1.

Next, the exposure control unit 116*a* determines as to whether i is larger than 0 (Step 6). If i>0, because the exposure start time corresponding to image information of the second color is later than the exposure start time corresponding to image information of the first color, the image of the second color should be formed from a line where the position shift is least overlaid with the image of the first color. Therefore, if i>0, the exposure control unit 116*a* makes the optical writing device 100 to start at time t2 an exposure corresponding to image information of the (i+1)-th line (Step 7). In the multi-beam light source, in order that the laser beams modulated by image information are emitted to perform exposure processes from image information of the (i+1)-th line, the line can correspond to the light source suitable. For example, for i=0, the exposure control unit 116*a* is to write image information of the first line with he first laser beam, and for i=1, to write image information of the second line with the first laser beam.

On the other hand, if i≦0, the exposure start time corresponding to image information of the first color is later than the exposure start time corresponding to image information of the first color or substantially the same. Therefore, the exposure corresponding to image information of the second color is delayed according to a requirement and the exposure corresponding to image information of the second color must start at a time where the position shift is smallest. If i≦0, the exposure control unit 116*a* makes the optical writing device 100 to start the exposure corresponding to image information at time $t2-T\times(i/n)$ from image information of the first line (Step 8). In the case of Step 8, the optical writing device 100 delays image information by only one line to perform the scanning process.

Figure 18:
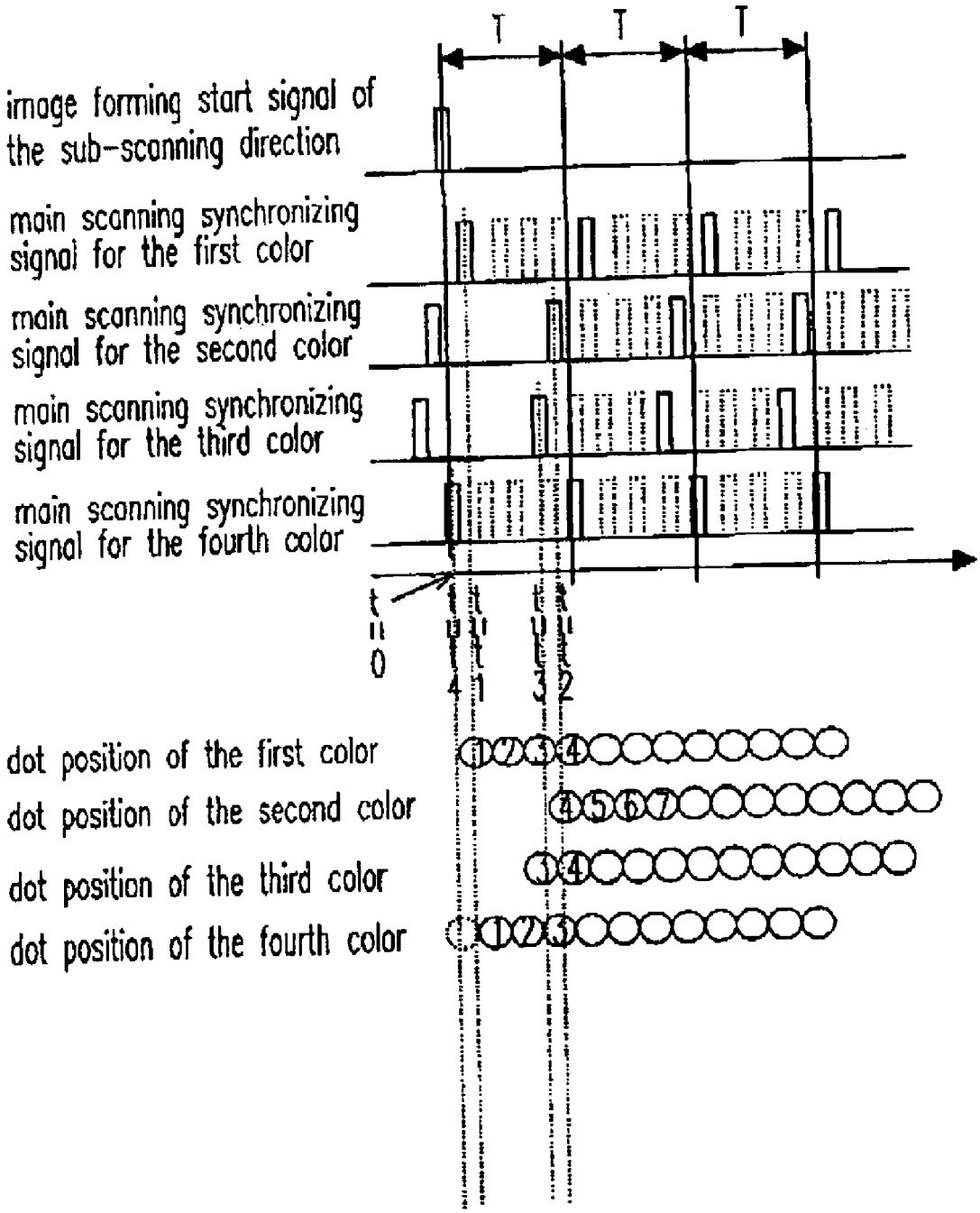
FIG. 18 is an example of dot positions formed according to the fifth embodiment of the present invention.

FIG. 18 is an example of dot positions formed according to the fifth embodiment of the present invention. FIG. 18 depicts a case of n=4, and a signal with the solid line and its subsequent three signals with dash lines represent dot positions by the optical writing with four beams. In the drawing, dash line portions and solid line portions are separated depicted. However, in fact, what kind of the main scanning synchronizing signal is detected depends on a detecting device for the main scanning synchronizing signal and the exposure control method. Namely, the detection of the main scanning synchronizing signal depends on whether all four beams are emitted. When plural beams are emitted during the detection of the main scanning synchronizing signal, the main scanning synchronizing signal detecting means depends in detecting all emitted beams or only a portion of beams. In the drawing, the main scanning synchronizing signal is input once only is divided into the dash line part and the solid line part for understanding only. For the exposures of the second and the third colors starting at times t2, t3 respectively later than time t1, by Step 7 the optical writing dots at time t2 and time t3 are optical writing dots of the fourth line (i=3) and the third line (i=2) respectively. The line ordinal number is marked within the dots in FIG. 18.

On the other hand, for the exposure of the fourth color starting at time t4 earlier than time t1, by Step 8 the exposure is started from the second beam among the four beams (i=−1, image information is delayed by one line). In the sixth embodiment, according to the process of the exposure control unit 116*a*, position shifts of image information of the second, the third and the fourth colors can be suppressed below as half as the dot pitch with respect to image information of the first color.

In addition, in order to start the image recording with the exposure from the prescribed line as described above, the exposure control unit 116*a* selects an image formation start line by an address selection of the bitmap image stored in the image forming device. Furthermore, a proper beam is selected among the n beams forming the multi-beam as an actual exposure start beam. In addition, when determining a dot forming positions of the third and its subsequent colors, the fifth embodiment uses time t1 as a reference, but as described in the third embodiment, an average time ta1 of the first lines of colors formed till now can also be uses as a reference.

According to the fifth embodiment, even though a time lapse in detecting the image forming start signal of the sub-scanning direction for detecting the main scanning signal when performing the optical writing other than the reference image is longer than a time lapse in detecting the image forming start signal of the sub-scanning direction for detecting the main scanning signal when performing the optical writing of the first color image as the prescribed reference image, the position shift of image other than the reference image can be suppressed to below half of the dot diameter with respect to the reference image. Moreover, a color deviation of the toner image, which is caused by that the main scanning synchronizing signal and image forming start signal of the sub-scanning direction are not synchronized, can be avoided.

In addition, even though a time lapse for detecting the image forming start signal of the sub-scanning direction to detecting the main scanning signal when performing the optical writing other than the reference image is shorter than a time lapse for detecting the image forming start signal of the sub-scanning direction to detect the main scanning signal when performing the optical writing of the first color image as the prescribed reference image, the position shift of image other than the reference image can be suppressed to below half of the dot diameter with respect to the reference image. Moreover, a color deviation of the toner image, which is caused by that the main scanning synchronizing signal and image forming start signal of the sub-scanning direction are not synchronized, can be avoided.

Next, the sixth embodiment of the present invention is described in detail as follows. In the sixth embodiment, an optical writing device with a multi-beam light source is same as the fifth embodiment is used. n beams are emitted from one single light source.

Figure 19A:
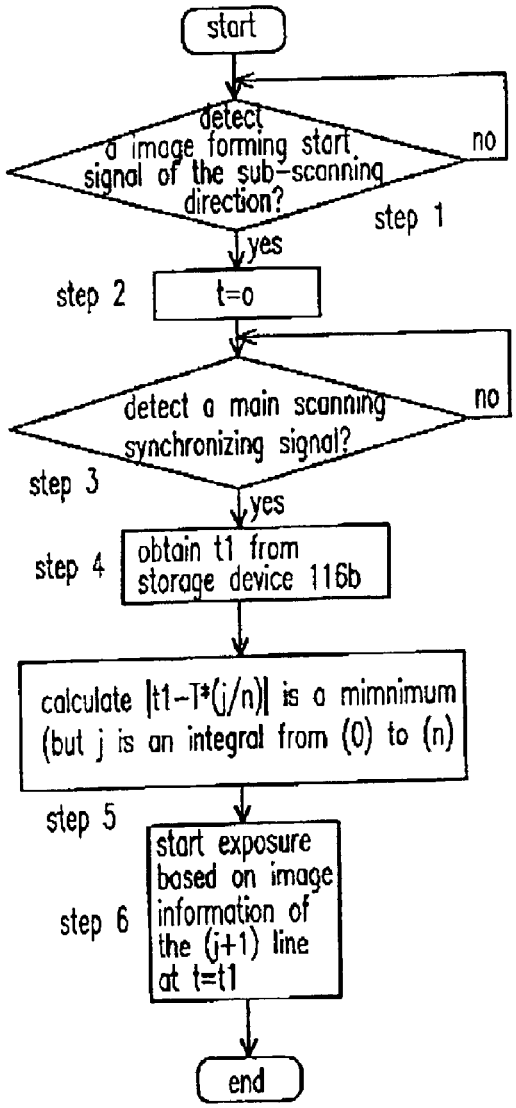
FIGS. 19A and 19B are flow charts showing a control flow of the exposure control unit according to the sixth embodiment of the present invention.
Figure 19B:
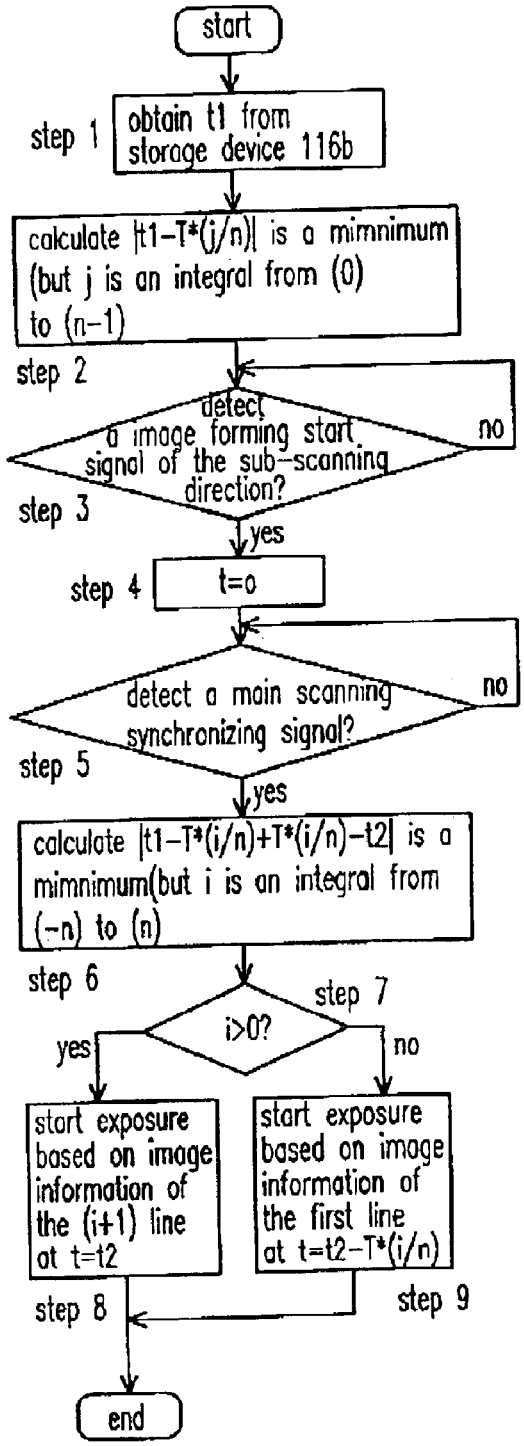

FIGS. 19A and 19B are flow charts showing a control flow of the exposure control unit 116*a* according to the sixth embodiment of the present invention. FIG. 19A is a flow chart related to an optical writing (exposure) control corresponding to image information of the first color, and FIG. 19B is a flow chart related to an optical writing (exposure) control corresponding to image information of the second color, the third color or the fourth color. Because the exposure control for the second, the third or the fourth color are the same, time t2 is also used to represent time t2, t3 and t4 as depicted in FIG. 19B.

As shown in FIG. 19A, when performing a control of an optical writing (exposure) corresponding to image information of the first color, the exposure control unit 116*a* time where a main scanning synchronizing signal is detected when starting an exposure corresponding to image information of the first color (Step 1). The exposure control unit 116*a* checks regularly the image forming start signal of the sub-scanning direction that comes from the detecting means (61) and then determines as to whether the image forming start signal of the sub-scanning direction is detected (Step 2). If the image forming start signal of the sub-scanning direction is detected, time t is set as t=0 (Step 3).

Next, the exposure control unit 116*a* checks regularly the main scanning synchronizing signal that comes from the light receiving means 126 and then determines as to whether the main scanning synchronizing signal is detected (Step 3). If the main scanning synchronizing signal is detected, a time t1 where the main scanning synchronizing signal is detected is stored into the storage device 116*b*. Next, the exposure control unit 116*a* performs a recursion calculation to obtain an integer j such that $|t1-T\times(j/n)-t2|$ is a minimum (Step 5), wherein j is from 0 to n−1. By using j obtained by above calculation, the optical writing device 100 starts the exposure corresponding to image information form image information of the (j+1)-th line at time t1.

As shown in FIG. 19B, when performing a control of the exposure corresponding to image of the second, the third and the fourth colors, the exposure control unit 116*a* obtain time t1 from the storage device 116*b* at Step 1, where time t1 is a time where a main scanning synchronizing signal is detected when starting an exposure corresponding to image information of the first color (Step 1). Then, the exposure control unit 116*a* performs a recursion calculation in order to obtain j such that $|t1-T\times(j/n)|$ is a minimum (Step 2), wherein j is from 0 to n−1. Afterwards, the exposure control unit 116*a* checks regularly the image forming start signal of the sub-scanning direction that comes from the detecting means (61) and then determines as to whether the image forming start signal of the sub-scanning direction is detected (Step 3). If the image forming start signal of the sub-scanning direction is detected, time t is set as t=0 (Step 4). Next, the exposure control unit 116*a* checks regularly the main scanning synchronizing signal that comes from the light receiving means 126 and then determines as to whether the main scanning synchronizing signal is detected (Step 5).

If the main scanning synchronizing signal is detected, the exposure control unit 116*a* performs a recursion calculation in order to obtain an integer i such that $|t1-T\times(j/n)+T\times(i/n)-t2|$ is a minimum (Step 6), wherein i an integer from −n+1 to n−1.

Next, the exposure control unit 116*a* determines as to whether i is larger than 0 (Step 6). If i>0, because the exposure start time corresponding to image information of the second color is later than the time $t1-T\times(j/n)$ where the dot formation corresponding to the first line by using the exposure based on image information of the first color is started, the image of the second color should be formed from a line where the position shift is least overlaid with the image of the first color. Therefore, if i>0, the exposure control unit 116*a* makes the optical writing device 100 to start an exposure corresponding to image information from image information of the (i+1)-th line at time t2 (Step 8). In the multi-beam light source, in order that the laser beams modulated by image information are emitted to perform exposure processes from image information of the (i+1)-th line, the line can correspond to the light source suitably. For example, for i=0, image information of the first line is written with the first laser beam, and for i=1, to write image information of the second line is written with the first laser beam.

On the other hand, if i≦0, because the exposure start time corresponding to image information of the second color is earlier than or the same as the time t1−T×(j/n) where the dot formation corresponding to the first line by using the exposure based on image information of the first color is started. Therefore, if necessary, the exposure corresponding to image information of the second color is delayed according to a requirement and the exposure corresponding to image information of the second color should start at a time where the position shift is smallest. The exposure control unit 116*a* makes the optical writing device 100 to start the exposure corresponding to image information at time t2−T×(i/n) from image information of the first line (Step 9). In the case of Step 9, the optical writing device 100 delays image information by only one line to perform the scanning process.

Figure 20:
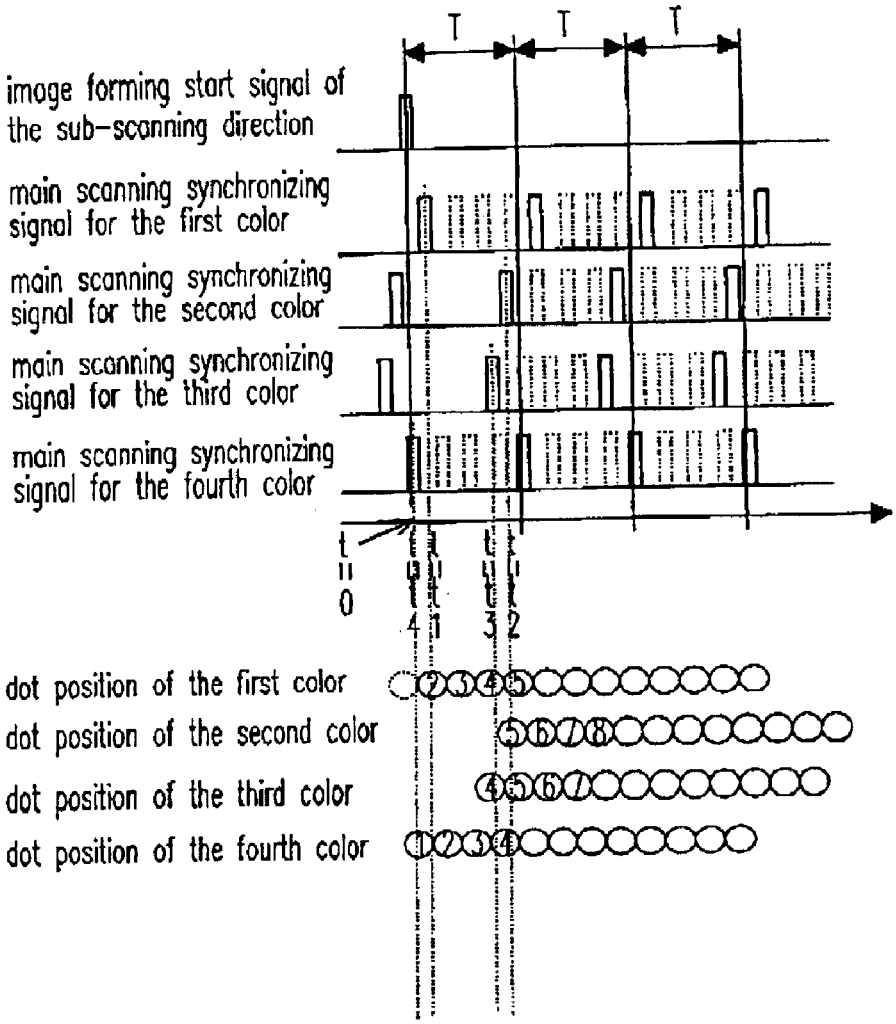
FIG. 20 is an example of dot positions formed according to the sixth embodiment of the present invention.
Figure 21:
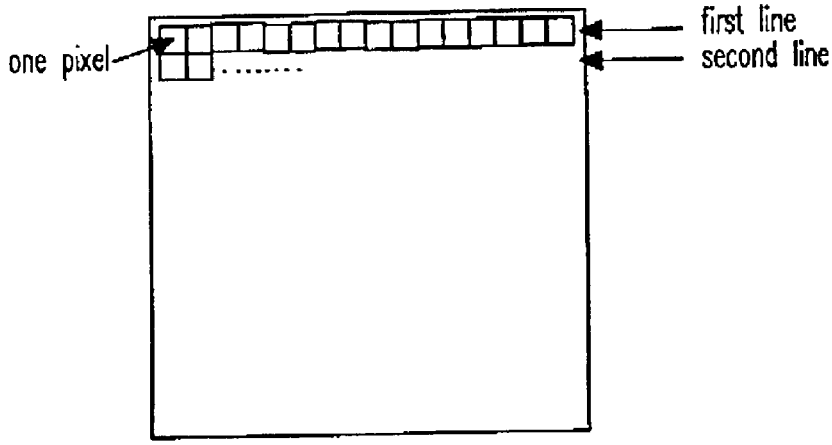
FIG. 21 is a diagram to describe image lines.

FIG. 20 is an example of dot positions formed according to the sixth embodiment of the present invention. FIG. 20 depicts a case of n=4, and a signal with the solid line and its subsequent three signals with dash liens represent dot positions by the optical writing with four beams. According to the execution of Step 6 in FIG. 19A, dots of first color are formed by the second beam (j=1). In the drawing, dash line portions and solid line portions are separated depicted. However, in fact, what kind of the main scanning synchronizing signal is detected depends on a detecting device for the main scanning synchronizing signal and the exposure control method. Namely, the detection of the main scanning synchronizing signal depends on whether all four beams are emitted. When plural beams are emitted during the detection of the main scanning synchronizing signal, the main scanning synchronizing signal detecting means depends in detecting all emitted beams or only a portion of beams. In the drawing, the main scanning synchronizing signal is input once only is divided into the dash line part and the solid line part for understanding only. For the exposures of the second and the third colors starting at times t2, t3 respectively later than time t1, by executing Step 8 in FIG. 19B, the optical writing dots at time t2 and time t3 are optical writing dots of the fifth line (i=4) and the fourth line (i=3) respectively. The line ordinal number is marked within the dots in FIG. 20.

On the other hand, the exposure of the fourth color starting at time t4 earlier than time t1 is started by executing Step 9 shown in FIG. 19B from the first line of the fourth beam (i=0). In the fifth embodiment, according to the process of the exposure control unit 116*a*, position shifts of image information of the second, the third and the fourth colors can be suppressed to below half of the dot pitch with respect to image information of the first color. The image forming position in the sub-scanning direction can become stable.

In addition, in order to start the image recording with the exposure from the prescribed line as described above, the exposure control unit 116*a* selects an image formation start line by an address selection of the bitmap image stored in the image forming device. Furthermore, a proper beam is selected among the n beams forming the multi-beam as an actual exposure start beam. In addition, when determining a dot forming positions of the third and its subsequent colors, the sixth embodiment uses time t1 as a reference, but as described in the fourth embodiment, an average time ta1 of the first lines of colors formed so far can also be used as a reference. In the fifth and the sixth embodiments, by using an assumptive image whose image (the optical writing device has started scanning) positions in the sub-scanning direction are averaged as the reference image, the position shift of the image where the scanning is started from the third one can be further reduced. In addition, in the fifth and the sixth embodiments, n is an integer equal to or larger than 1.

According to the sixth embodiment, the image position shifts of the second, the third and the fourth colors other than the reference can be suppressed below as half as the dot pitch of the image of the first color that is used as the reference image. In addition, the image forming position in the sub-scanning direction can become stable.

Next, the seventh embodiment according to the present invention is described in detail as follows. In the seventh embodiment, when the control objects for the optical writing (exposure) are exposures corresponding to image information of the cyan color, the magenta color and the yellow color, the method for selecting the reference image is different from the first embodiment. For example, during the exposures corresponding to image information of the cyan color, the magenta color and the yellow color, the reference image is selected in a manner that image information amounts of the red (R) color, the green (G) color and the black (B) color are used to minimize an influence of the position shift of image information.

Figure 22:
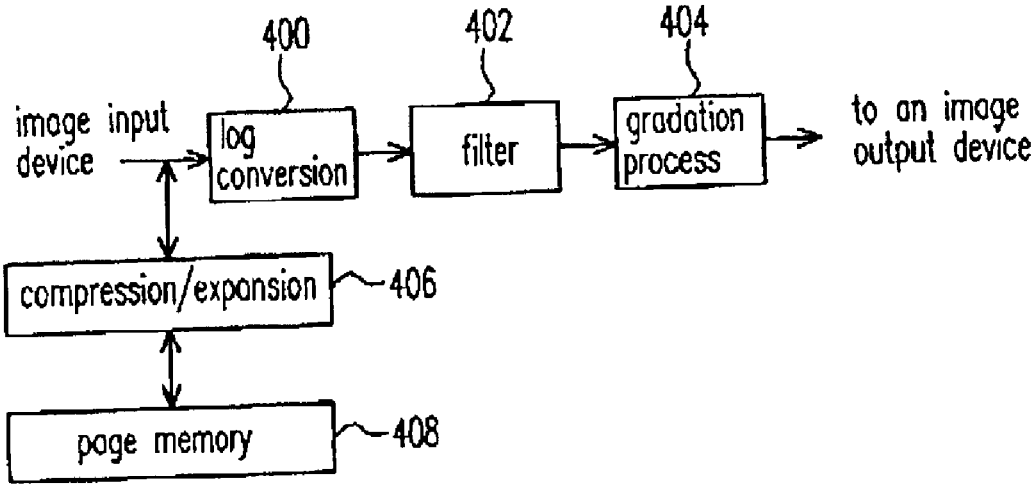
FIG. 22 shows an image processing circuit comprising a controller according to the seventh embodiment.

FIG. 22 shows an image processing circuit comprising a controller 116 according to the seventh embodiment. Referring to FIG. 22, the image processing circuit comprises a compression/expansion circuit 406, a page memory 408, a logarithm conversion circuit 400, a filter circuit 402 and a gradation processing circuit 404. The compression/expansion circuit 406 is used for entropy coding and compressing data, and for expanding to original data. The page memory 408 is used for storing data compressed by the compression/expansion circuit 406. The logarithm conversion circuit 400 is used for converting a linear signal with respect to a reflection rate into a linear signal with respect to a concentration. The filter circuit 402 comprises smoothening filters to smoothen signals. The gradation processing circuit 404 is used for processing image to show an intermedium gradation by using an error diffusion, for example.

Digital image information read from a network image input device or a scanner comprises an R (red) color signal, a g (green) color signal and a B (blue) signal, which are transmitted to the compression/expansion circuit 406. The compression/expansion circuit 406 compresses image information read from the image input device by using a compression format such as a JPEG2000 format or a JBIG format. Codes compressed by the compression/expansion circuit 406 are stored to the page memory 408. When making the second edition, the compression codes are read from the page memory 408, decoded by the compression/expansion circuit 406 with a process reverse to the compression, and transmitted to the next process. The logarithm conversion circuit 400 performs a table conversion to convert the characteristic of signals decoded by the compression/expansion circuit 406 from a reflection rate space (as a first color space) to a concentration space (as a second color space). In this way, image information of the R, the G and the B signals are converted into image information of the cyan color, the magenta color, the yellow color and the black color. The filter circuit 402 performs various filtering processes to image information from the logarithm conversion circuit 400. The gradation processing circuit 404 prepares a dither table and then perform an intermedium gradation process to image information from the logarithm conversion circuit 400. After image information is processed by the gradation processing circuit 404, processed image information is transmitted to the optical writing device 100.

Figure 23:
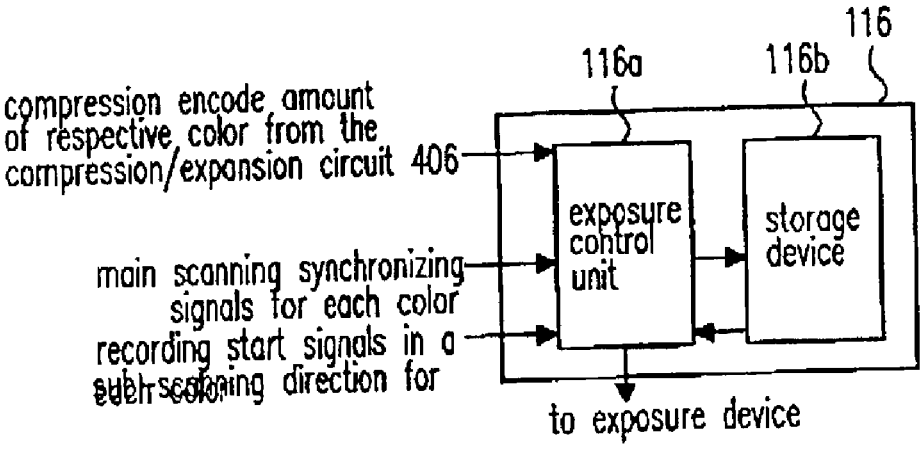
FIG. 23 is a block diagram showing a controller according to the seventh embodiment.

With respect to that the exposure start timing is determined from a recording start signal of the present embodiment, a compression encoding amount of color species from the compression/expansion circuit 406 is further obtained to determine an exposure start timing (referring to FIG. 23). For example, the exposure control unit 116*a* obtains a compression encoding amount Fr of the red color, a compression encoding amount Fg of the green color and a compression encoding amount Fb of the blue color from the compression/expansion circuit 406. The compression encoding amount is a size in the page memory 408 for a compression code obtained by a compression process of the compression/expansion circuit 406. The larger the image information amount is, the larger the compression encoding amount is.

In the seventh embodiment, regarding the exposures corresponding to image information of all colors that have been started by the exposure control unit 116*a*, the storage device 116*b* stores times where the main scanning synchronizing signals are detected. For example, when the exposure corresponding to image information of the third color, the storage device 92 stores times t1, t2 where the main scanning synchronizing signals are detected when the exposures of the first and the second colors start. When the exposure corresponding to image information of the fourth color, the storage device 92 stores times t1, t2 and t3 where the main scanning synchronizing signals are detected when the exposures of the first, the second and the third colors start.

In the seventh embodiment, a control of an exposure start timing corresponding to image information of black color can use any one of the controls of the exposure start timing described in each of the aforementioned embodiments. Controls of exposure start timings corresponding to image information of the cyan (C) color, the magenta (M) color and the yellow (Y) color are executed according to a control flow shown in FIG. 24.

Figure 24:
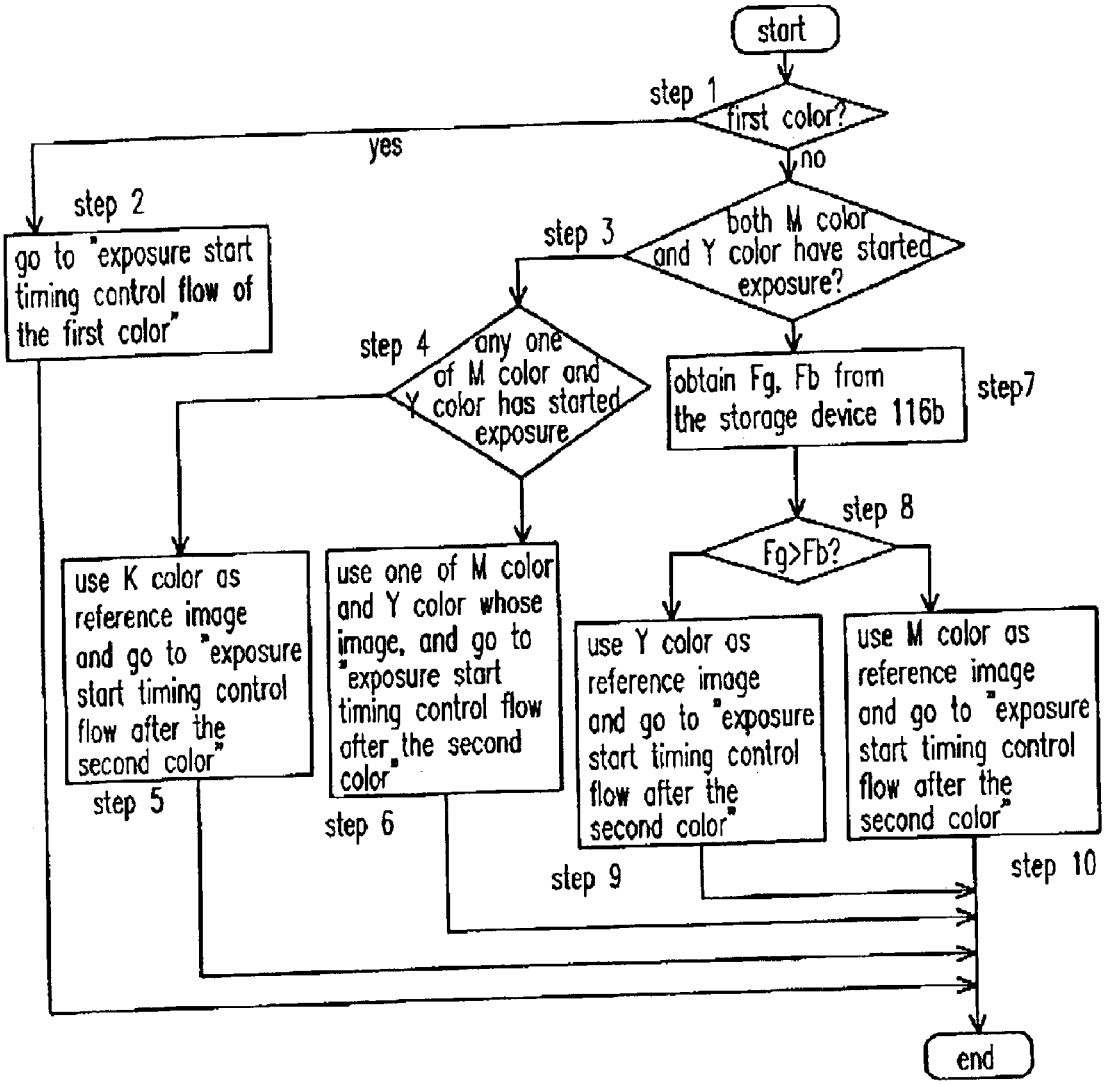
FIG. 24 is a flow chart showing a control flow of the exposure control unit according to the seventh embodiment.

FIG. 24 is a flow chart showing a control flow of an exposure start time corresponding to the C color, the M color and the Y color performed by the exposure control unit 116*a*. In addition, FIG. 24 shows a control flow whose control object is an exposure corresponding to image information of the M color. However, n FIG. 24 where the control object is an exposure corresponding to image information of the M color, the C color can be taken for the M color and the parameter Fr can be taken for the parameter Fg. Similarly, in FIG. 24 where the control object is an exposure corresponding to image information of the Y color, the C color can be taken for the Y color and the parameter Fr can be taken for the parameter Fb.

Referring to FIG. 24, at the beginning, the exposure control unit 116*a* determines as to whether the control object is the exposure corresponding to image information of the first color at Step 1 (an exposure corresponding to image information of a color starting first does not exist). When the control object is the exposure corresponding to image information of the first color, a control flow for an exposure start timing, such as "the control flow for the exposure start timing corresponding to the first color as shown in FIG. 10B, is performed (Step 2). When the control object is not the exposure corresponding to image information of the first color, the exposure control unit 116*a* determines as to whether both the exposures corresponding to image information of the M color and the Y color have started (Step 3).

When a result of the determination Step 3 is NO (both the exposures corresponding to image information of the M color and the Y color have not started), the exposure control unit 116*a* determines as to which one of the exposures corresponding to image information of the M color and the Y color have started (Step 4). When a result of the determination Step 4 is NO (both the exposures corresponding to image information of the M color and the Y color have not started), the exposure control unit 116*a* uses the image of the K color as a reference color and performs an exposure control, such as "the control flow for the exposure start timing corresponding to the second color as shown in FIG. 10B (Step 5).

When a result of the determination Step 4 is YES (one of the exposures corresponding to image information of the M color and the Y color has started), the exposure control unit 116*a* uses one optical writing image, whose exposure corresponding image information of the M color or the Y color has started, as a reference image. Then, the exposure control unit 116*a* performs an exposure control, such as "the control flow for the exposure start timing corresponding to the second and its subsequent colors as shown in FIG. 10B (Step 6).

Steps 4, 5 and 6 are one of the features of the present invention. For the exposure control unit 116*a* performs a control in such a manner that other color image is used as the reference image as if there are color images. Because one color image overlaps another color image to form an objective color image, the color deviation can not be so obvious by using the other color image as the reference image as possible.

On the other hand, when a result of the determination Step 3 is YES (both the exposures corresponding to image information of the M color and the Y color have started), the exposure control unit 116*a* obtains parameters Fg, Fb from the storage device 116*b* (Step 7), and then compares the two parameters Fg, Fb in order to determine as to whether Fg>Fb (Step 8). When a result of the determination Step 8 is Yes (Fg>Fb), the exposure control unit 116*a* uses the Y color image as the reference image, and then performs an exposure control, such as "the control flow for the exposure start timing corresponding to the second and its subsequent colors" as shown in FIG. 10B (Step 9).

When a result of the determination Step 8 is NO (Fg≦Fb), the exposure control unit 116*a* uses the M color image as the reference image, and then performs an exposure control, such as "the control flow for the exposure start timing corresponding to the second and its subsequent colors" as shown in FIG. 10B (Step 9).

Steps 8, 9 and 10 are the features of the embodiment, which is to perform a control for selecting a higher related color image as a reference image. In detail, Fg>Fb means that the image information amount of the G color is larger than the image information amount of the B color. In contrast, Fg<Fb means that the image information amount of the G color is smaller than the mage information amount of the B color. For example, when the image is made of only the G color, the amount of the G color in the image information is large, but the amount of the B color in the image information is 0 (for the compression code, in general, there exists information such as a header, and therefore, the image information amount is not 0). Therefore, when Fg is larger than Fb (Fg>Fb), prevention of a color deviation of image information of the G color rather than the image information of the B color can effectively reduce a degradation of an image quality.

The R color is formed from the M color and the Y color, the G color is formed from the C color and the Y color, and the B color is formed from the C color and the M color.

Therefore, when the exposure corresponding to image information of the C color starts, the color deviation of the G color image is reduced if the Y color image is used as the reference image, and the color deviation of the B color image is reduced if the M color image is used as the reference image. Therefore, in the case that Fg is larger than Fb (Fg>Fb), when the exposure corresponding to image information of the C color starts, the method is effective in a view of a color deviation reduction while using the Y color image as the reference image. As a result, in the seventh embodiment, a higher related color image is selected as the reference image. In addition, as described above, when the exposure corresponding to image information of the M color is the control object, C can be taken for M and Fr can be taken for Fg. Similarly, when the exposure corresponding to image information of the Y color is the control object, C can be taken for Y and Fr can be taken for Fb.

According to the seventh embodiment, by using an image, where the optical writing device starts first to scan the image, as the reference image, the process becomes simpler and the image whose position shift is reduced can be easy to increase to the most. In addition, when the writing object other than the reference image is a color image, by selecting other color image priorly as the reference, the position shift of the color image is reduced and the image quality can be improved. Furthermore, by selecting an image highly related to an image of the writing object other than the reference image as the reference image, the position shift of the highly related image can be reduced and the image quality can be improved.

In the second to the sixth embodiment mentioned above, similar to the seventh embodiment, the method to select the reference image when the exposure timing control objects are exposures corresponding to image information of the cyan color, the magenta color, the yellow color can use image information of the R color, the G color and the B color during the exposures corresponding to image information of the cyan color, the magenta color, the yellow color to select the reference image, so that an influence of the position shifts of the image information can be reduced to the least.

Next, the eighth embodiment of the present invention is described in detail as follows. Basically, the eighth embodiment is the same as the third embodiment except for two features as follows.

First, the method to select the reference image is different. For example, a previous color image whose corresponding exposure has started is always selected as the reference image. In this case, if ta1 is not used as the average value, but is replaced by a ta1 relating to a color whose exposure has started right before the exposure is to be started, the exposure start control flow is the same as the exposure start control flow shown in FIG. 12. For example, at Step 12 of the exposure start control flow shown in FIG. 12, a new ta1 can be taken for time t2. In this case, for the image of the first color and the image of the fourth color, or the image of the second color and the image of the fourth color, a color deviation of about one line may occur.

Second, the exposure start sequence is made by considering the color correlation. For example, if the exposure start sequence is the K color, the C color, the Y color and the M color, by the method for selecting the reference image described above, the color deviation of the C color with respect to the K color is reduced and the color deviation of the M color with respect to the Y color is reduced.

In the eighth embodiment, from a result of performing the above exposure start control, the color deviations of the C color and the Y color, which form the G color having great contribution to brightness information, is reduced, and furthermore, the color deviations of the G color and the K color is smaller since the color deviations of the C color and the K color. Therefore, a reproducibility of brightness information is good. As described above, each time the previous color image whose corresponding exposure has started is selected as the reference image and a color sequence is previously selected in such a manner that the color deviation is reduced, by which the color deviation of the image can be reduced by an algorithm simpler than the seventh embodiment. In addition, because the exposure control corresponding to image information of all colors can be done by the same process, the circuit can be simplified and the processing time can also be reduced.

In addition, in the eighth embodiment, the previous color image whose exposure has started is selected as the reference image. However, from an exposure to be started, the color image prior to the previous color image whose exposure has started is selected as the reference image, and a corresponding exposure start sequence can be set in advance.

According to the eighth embodiment, by selecting an image, which is highly related to an image as a writing object other than the reference image, as the reference image, a high related image could be effectively selected. In addition, in the first, the second, and fourth to seventh embodiments, the method used for selecting the reference image is the same as the eighth embodiment, and similar to the eighth embodiment, the exposure start sequence can be a sequence by considering the color correlation.

Figure 14:
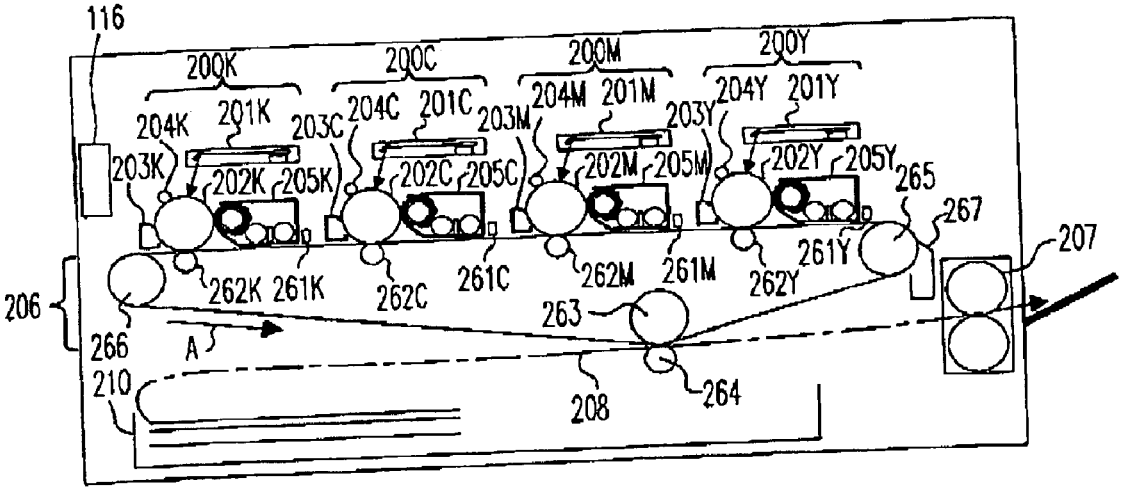
FIG. 14 is a cross-sectional view of another example of an image forming device.
Figure 16:
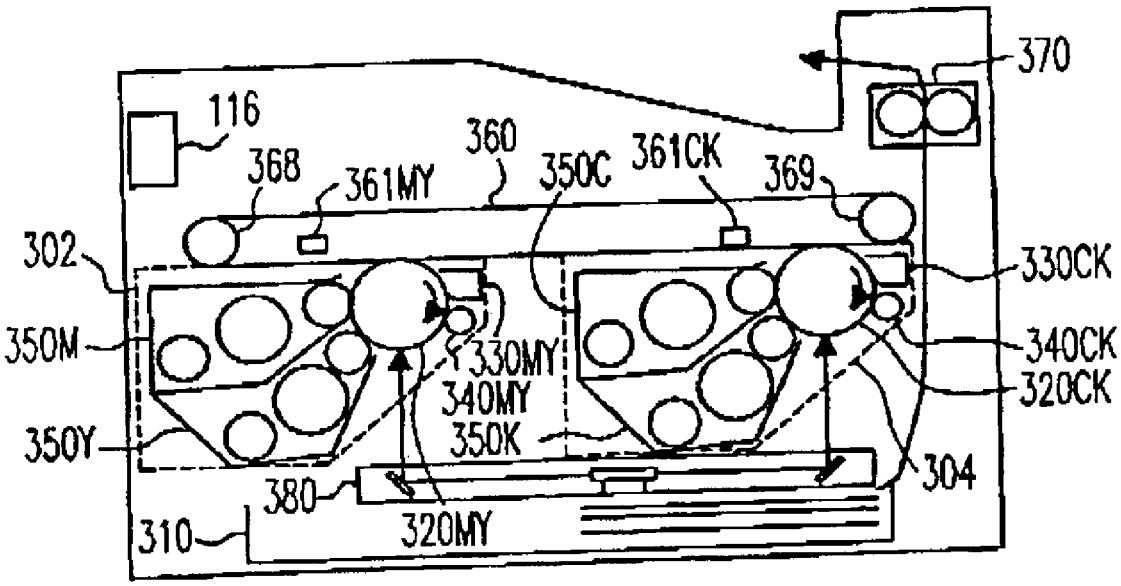
FIG. 16 a cross-sectional view of another example of an image forming device.

The present invention is applicable to image forming devices shown in FIGS. 14 and 16. A controller 116 the same as the controller in the aforementioned embodiments is used to perform the same exposure control.

Figure 15:
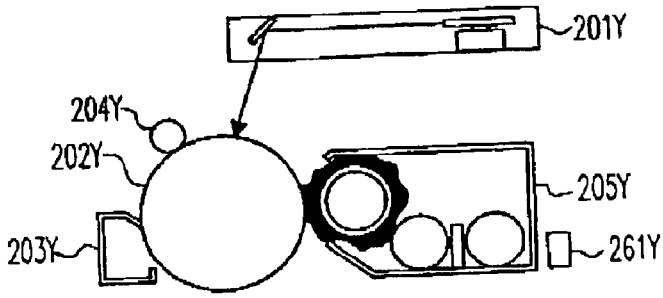
FIG. 15 is a cross-sectional view of one image station of the image forming device in FIG. 14.

The image forming device shown in FIG. 14 is a tandem type image forming device. In the image forming device, four image stations 200K, 200C, 200M and 200K are arranged on an intermedium transfer belt 206 (as an intermedium transcriber). Except for that the colors of the formed toner images are different, the four image stations 200K, 200C, 200M and 200K are the same. FIG. 15 shows one of the four image stations as an example. In the following description, elements with symbols C, M, Y and Y added to element numbers of the image station belong to the four image stations 200K, 200C, 200M and 200K respectively.

In FIGS. 14 and 15, the intermedium transfer belt 206 uses a seamless belt to be suspended by a driving roller 265, a tension roller 266 and an opposite roller 263 for a secondary transfer process. In addition, a cleaner 267 for removing residual toner after the secondary transfer process is arranged on the intermedium transfer belt 206. Furthermore, detection devices 261Y, 261M, 261C, 261K generate respectively image forming start signals of the sub-scanning direction by detection a marker on the intermedium transfer belt 206 with the detection devices 261Y, 261M, 261C, 261K, wherein the detection devices 261Y, 261M, 261C, 261K are used as detecting means and respectively set within the four image stations 200K, 200C, 200M and 200K. In addition, the exposure devices 201Y, 201M, 201C, 201K as the optical writing devices (scanning and writing devices), the marker and the detection devices 261Y, 261M, 261C, 261K are the same as the image forming device shown in FIG. 1.

As the marker on the intermedium transfer belt 206 is detected by the detection devices 261Y, 261M, 261C, 261K within the four image stations 200K, 200C, 200M and 200K, the controller 116 receives the main scanning synchronizing signals from optical receivers (the same optical receiver in the exposure device of the image forming device in FIG. 1) in the exposure devices 201Y, 201M, 201C, or 201K after the marker is respectively detected. Then, the controller 116 makes the exposure devices 201Y, 201M, 201C, or 201K to start respectively the exposures corresponding to the K color, the C color, the M color and the Y color as describe above.

For the image stations 200K, 200C, 200M and 200K, the electrifying devices 204Y), 204M), 204C, 204K uniformly electrify the photosensors 202Y, 202M, 202C, 202K as the image supporters (i.e., the scanned bodies) respectively until the exposures start. The exposure devices 201Y, 201M, 201C, 201K perform the exposures respectively corresponding to image information of the K color, the C color, the M color and the Y color, and then electrostatic latent images corresponding to image information of colors are respectively formed onto the electrified photosensors 202Y, 202M, 202C, 202K. Then, the developing devices 205Y, 205M, 205C, 205K develop the electrostatic latent images corresponding to image information of each of colors, and then toner images of the K color, the C color, the M color and the Y color are respectively formed on the photosensors 202Y, 202M, 202C, 202K. The toner images of the K color, the C color, the M color and the Y color respectively formed on the photosensors 202Y, 202M, 202C, 202K are consistently overlapped on the intermedium transfer belt 206 by primary transfer rollers 262Y, 262M, 262C, 262K (as transfer means) in a primary transfer process so as to form a full color image. In addition, the photosensors 202Y, 202M, 202C, 202K and the intermedium transfer belt 206 are rotationally driven with the same rotational speed by a driving source (not shown).

On the other hand, a transfer paper 208 (as a recording medium) is fed to a resist roller (not shown) from the paper-feeding device 210. The resist roller sends out the transfer paper accompanying with the full color image on the intermedium transfer belt 206. The full color image formed on the intermedium transfer belt 206 is secondarily transferred on the transfer paper 208 by an electric field formed between the secondary transfer roller 264 (as a transfer means) and the opposite roller 263. The full color image is fixed by a fixing device 207, and then, the transfer paper 208 where the full color image is transferred thereon by the secondary transfer process is then ejected out of the image forming device. Afterwards, the photosensors 202Y, 202M, 202C, 202K are cleaned up by the cleaning devices 203Y, 203M, 203C, 203K after the primary transfer process for the toner image and the intermedium belt 206 is cleaned up by the cleaning device 267 after the secondary transfer process for the full color image.

In the image forming device, the exposure start times for the exposure devices 201Y, 201M, 201C, 201K are selected with timings that the toner images for all colors are overlapped. The image forming sequence is from an upstream side to a downstream side in a moving direction of the intermedium transfer belt 206; namely, a sequence of the Y color toner image, the M color toner image, the C color toner image and the K color toner image. Therefore, the Y color toner image is set as the first color toner image, the M color toner image is set as the second color toner image, the C color toner image is set as the third color toner image and the K color toner image is set as the fourth color toner image, and thus the exposure start control the same as the first to the fourth embodiments are performed by the exposure control unit 116*a* in the controller 116, so as to be able to avoid the color deviation.

In the image forming device shown in FIG. 16, image stations 302, 303 and an exposure device 380 are arranged under an intermedium transfer belt 360 (used as an intermedium transcriber), and the image forming device further comprises a fixing device 370. Except for the toner colors are different, the image stations 302, 303 have the same structure. The image stations 302, 303 comprises respectively photosensors 320MY, 320CK as image supporters (i.e., scanned bodies), cleaning devices 320MY, 320CK, electrifying devices 340MY, 340CK, developing devices 350M, 350Y, 350C, 350K for forming toner images of the M color, the Y color, the C color and the K color respectively. The exposure device 380 is a known exposure in which light beams from two light sources (not shown) are reflected by rotational polygon mirrors (as one scanning means) to perform the exposure. Similar to the optical receiver 126 in the exposure device 100 of the aforementioned embodiment, the light beams from the rotational polygon mirrors are respectively detected by two optical receiver used as main scanning synchronizing signal generating means (although not shown in figure, numerals 314MY, 314CK are added to). The intermedium transfer belt 306*b* are suspended by rollers 368, 369, and the photosensors 320MY, 320CK and the intermedium transfer belt 360 is rotationally driven by a driving source (not shown) with the same rotational speed.

Next, the operation of the image forming device is briefly described as follows. A detecting device 361MY among detecting device 361MY, 361CK (as means for generating an image forming start signal of the sub-scanning direction) generates the image forming start signal of the sub-scanning direction by detecting a pre-formed mark on the intermedium transfer belt 360 to transmit to the controller 116. Next, when the main scanning synchronizing signal from the optical receiver 314MY is transmitted to the controller 116, the exposure of the exposure device (1MY) is started in the same way as described in the aforementioned embodiments. In this case, first of all, the light beam modulated by image information of the Y color or the M color (here, the Y color is used as an example) from the light source for the image station 302 at the upstream, and then the exposure device (1MY) starts the exposure corresponding to image information of the Y color for the photosensor 320MY in the image station 302.

In the image station 302, when the exposure is started, the surface of the photosensor 320MY is electrified by the electrifying device 340MY with a prescribed potential to comply with the exposure. The electrified surface of the photosensor 320MY is exposed by the exposure device 380 to form an electrostatic latent image corresponding to image information of the Y color. The electrostatic latent image on the photosensor 320MY is developed by any one of the developing devices 350M, 350Y. The developing devices 350M, 350Y can be controlled to or not to execute the developing operation either by that one of the developing devices 350M, 350Y is receded from the photosensor 320MY or by that one of the developing devices 350M, 350Y is advanced to a developing position and then a developing bias is applied to thereon from a power source device (not shown). In this example, the electrostatic latent image on the photosensor 320MY is first developed by the developing device 350Y to form a Y color toner image. Then, the Y color toner image formed on the photosensor 320MY is transferred onto the intermedium transfer belt 360 in the primary transfer process by a transfer means (not shown).

Next, the detecting device 361CK generates an image forming start signal of the sub-scanning direction by detecting the pre-formed mark on the intermedium belt 360, and then transmits the image forming start signal of the sub-scanning direction to the controller 116. Then, when the main scanning synchronizing signal reaches the controller 116 from the optical receiver 314CK, the exposure device 380 deflects the light beam by the rotational polygonal mirror to start the exposure of the photosensor 320CK in the image station 304, wherein the light beam is modulated by image information of the K color from the light source for the image station 304.

In the image station 304, when the exposure is started, the surface of the photosensor 320CK is electrified by the electrifying device 340CK with a prescribed potential to comply with the exposure. The electrified surface of the photosensor 320CK is exposed by the exposure device 380 to form an electrostatic latent image corresponding to image information of the K color. The electrostatic latent image on the photosensor 320CK is developed by any one of the developing devices 350C, 350K. The developing devices 350C, 350K can be controlled to or not to execute the developing operation either by that one of the developing devices 350C, 350K is receded from the photosensor 320CK or by that one of the developing devices 350C, 350K is advanced to a developing position and then a developing bias is applied to thereon from a power source device (not shown). In this example, the electrostatic latent image on the photosensor 320CK is first developed by the developing device 350C to form a K color toner image. Then, the K color toner image formed on the photosensor 320CK is transferred to overlap the Y color toner image on the intermedium transfer belt 360 in the primary transfer process by a transfer means (not shown).

The overlapped image of the Y color toner image and the K color toner image on the intermedium transfer belt 206 moves to reach the image station 302 again by the rotation of the intermedium transfer belt 206. At this time, in the image station 302, the developing device at the developing position is switched to the developing device 350M. Then, the detecting device 361MY generates an image forming start signal of the sub-scanning direction by detecting the pre-formed mark on the intermedium belt 360, and then transmits the image forming start signal of the sub-scanning direction to the controller 116.

When the main scanning synchronizing signal reaches the controller 116 from the optical receiver 314MY, the exposure device 380 deflects the light beam by the rotational polygonal mirror to start the exposure of the photosensor 320MY in the image station 302, wherein the light beam is modulated by image information of the M color from the light source for the image station 302.

In the image station 302, when the exposure is started, the surface of the photosensor 320MY is electrified by the electrifying device 340MY with a prescribed potential to comply with the exposure. The electrified surface of the photosensor 320MY is exposed by the exposure device 380 to form an electrostatic latent image corresponding to image information of the M color. The electrostatic latent image on the photosensor 320MY is developed by the developing devices 350M. Then, the electrostatic latent image on the photosensor 320MY is developed by the developing device 350M to form a M color toner image. Then, the M color toner image formed on the photosensor 320MY is transferred to overlap with the Y and the K color toner images on the intermedium transfer belt 360 in the primary transfer process by a transfer means (not shown).

The overlapped image of the Y, K and M color toner images on the intermedium transfer belt 360 moves to reach the image station 304 again by the rotation of the intermedium transfer belt 206. At this time, in the image station 304, the developing device at the developing position is switched to the developing device 350C. Then, the detecting device 361CK generates an image forming start signal of the sub-scanning direction by detecting the pre-formed mark on the intermedium belt 360, and then transmits the image forming start signal of the sub-scanning direction to the controller 116.

When the main scanning synchronizing signal reaches the controller 116 from the optical receiver 314CK, the exposure device 380 deflects the light beam by the rotational polygonal mirror to start the exposure of the photosensor 320CK in the image station 304, wherein the light beam is modulated by image information of the M color from the light source for the image station 304.

In the image station 304, when the exposure is started, the surface of the photosensor 320CK is electrified by the electrifying device 340CK with a prescribed potential to comply with the exposure. The electrified surface of the photosensor 320CK is exposed by the exposure device 380 to form an electrostatic latent image corresponding to image information of the C color. The electrostatic latent image on the photosensor 320CK is developed by the developing devices 350C. Then, the electrostatic latent image on the photosensor 320CK is developed by the developing device 350C to form a C color toner image. Then, the M color toner image formed on the photosensor 320CK is transferred to overlap with the Y, K and M color toner images on the intermedium transfer belt 360 in the primary transfer process by a transfer means (not shown), so as to form a full color image.

On the other hand, a transfer paper 114 (as a recording medium) is fed to a resist roller (not shown) from the paper-feeding device 310. The resist roller sends out the transfer paper accompanying with the full color image on the intermedium transfer belt 360. The full color image formed on the intermedium transfer belt 360 is secondarily transferred on the transfer paper (8) by a transfer means (not shown). The full color image is fixed by a fixing device 370, and then, the transfer paper (8) where the full color image is transferred thereon by the secondary transfer process is then ejected out of the image forming device. Afterwards, the photosensors 320MY, 320CK are cleaned up by the cleaning devices 330MY, 330CK after the primary transfer process for the toner image. The intermedium belt 360 is cleaned up by the cleaning device (not shown) after the secondary transfer process for the full color image.

In the image forming device, the Y color image, the K color toner image, the M color toner image, and the C color toner image are sequentially formed, and these color toner images are overlapped on the intermedium transfer belt 360. Therefore, by setting the Y color as the first color, the K color as the second color, the M color as the third color, the C color as the fourth color, the exposures corresponding to those colors can be controlled according to the aforementioned embodiments. In addition, in the image forming device, considering a subtle eccentricity of the photosensors 320MY, 320CK, an image with a reserved developing color of the developing device can be used as a reference image.

Furthermore, the present invention is also applicable to either an image forming device to overlap toner images of different colors on the photosensor, or an image forming device to transfer a toner image to a recorded object directly without using an intermedium transfer body. Alternatively, the present invention is also applicable to an image forming device to perform an image formation by an image process other than the electrophotography; for example, toner (including ink) is blown form a rotating nozzle according to image information, and a toner image is formed onto a photosensor, an intermedium transfer belt or a recording paper moving in the sub-scanning direction by performing a scanning corresponding to image information in the main scanning direction. In short, the present invention can also suitable for an image forming device that overlaps a plurality of images, wherein the image is formed by using an optical scanning and writing device capable of forming a latent image or an image.

Figure 25:
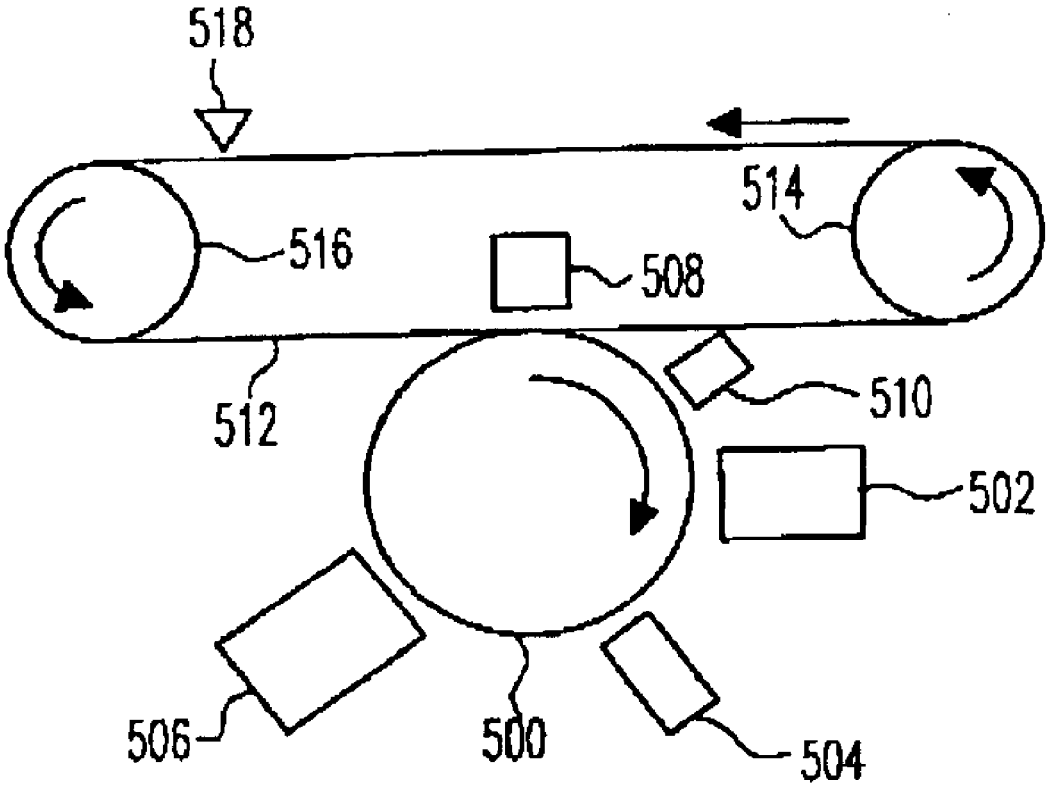
FIG. 25 is a schematic front view of an image forming device according to another embodiment of the present invention.
Figures 26A, 26B, 26C, 26D, 26E, 26F, 26G, 26H:
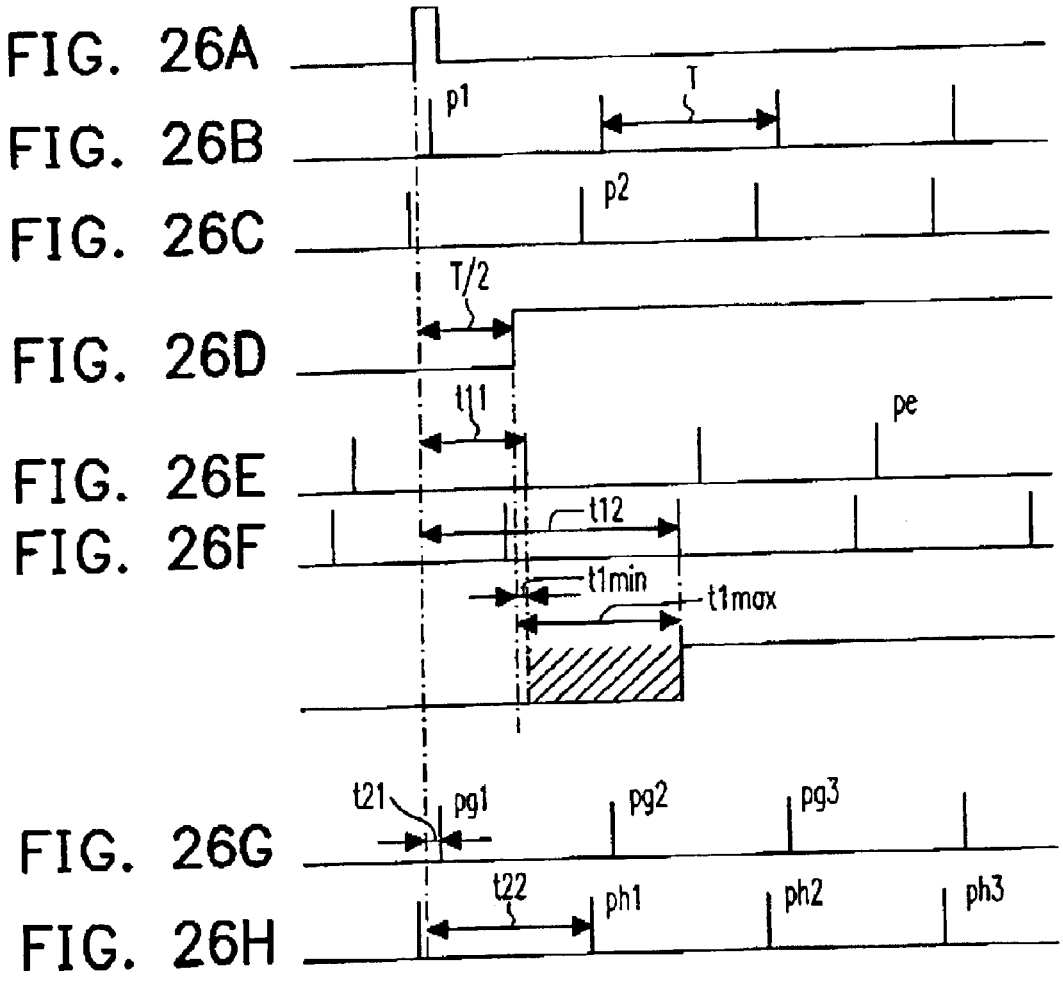
FIGS. 26A to 26H are timing charts showing a relationship between the image forming start signal of the sub-scanning direction and the main scanning synchronizing signal according to another embodiment of the present invention.
Figure 27:
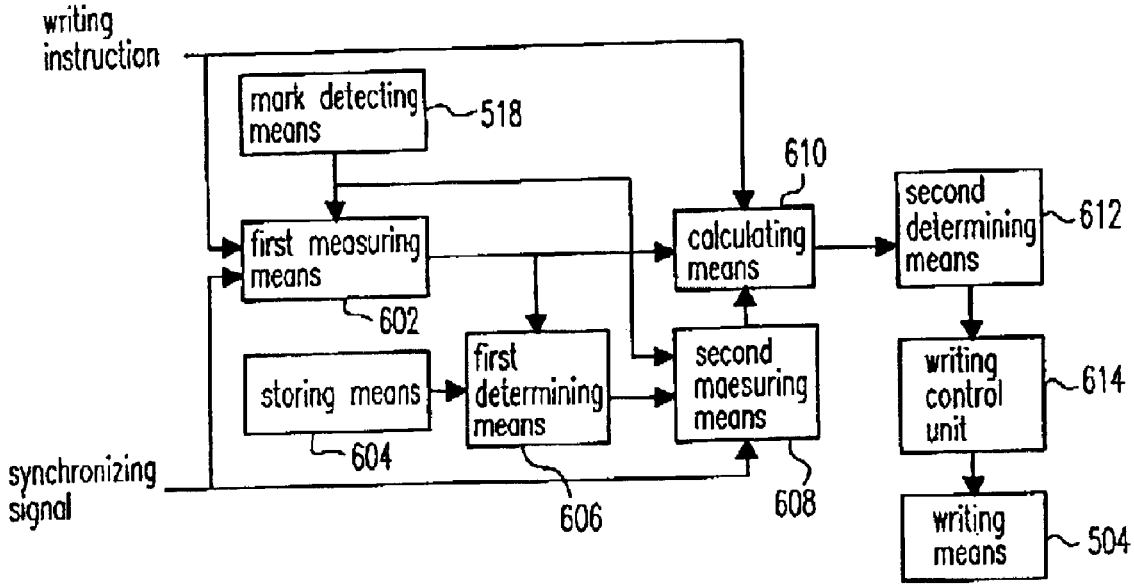
FIG. 27 is control block diagram.

The ninth embodiments is described in detail accompanying with FIGS. 25, 26 and 27. FIG. 25 shows a basic structure of an image forming device. In the image forming device, an image is formed on a scanned body by a scanning type writing means, a process to transfer the image onto an intermedium transfer body is repeatedly performed for each prime color, and then those prime color images are sequentially overlapped to form a full color image.

Referring to FIG. 25, an electrifying means 502, a writing means 504, a developing means 506, a transfer means 508, a cleaning means 510 and a discharging means (not shown) are arranged around a photosensor drum 500 used as an image supporter, i.e., the scanned body. The electrifying means 502 is used to electrify uniformly a surface of the photosensor drum 500. The writing means 504 is used to form an electrostatic latent image based on image information on the electrified surface of the photosensor drum 500. The developing means 506 is used to visualize the electrostatic latent image as a toner image. The transfer means 508 is used to transfer the toner image onto the intermedium transfer body, for example, an intermedium transfer belt 512. The cleaning means 510 is used to remove residual toner remained on the photosensor drum 500 after transfer. The discharging means is used to initialize the potential of the surface of the photosensor drum 500. The intermedium transfer belt 512 is suspended between a driving roller 514 and a driven roller 516 so as to be rotatably driven. A mark (not shown) is formed on the intermedium transfer belt 512 to indicate an image forming start position, and a mark detecting means is arranged at the driven roller 516 side to detect the mark.

A brief operation of the image forming device is described as follows. Referring to FIG. 25, the surface of the photosensor drum 500 rotating in the arrow direction is uniformly electrified by the electrifying means 502. As the mark on the intermedium transfer belt 512 is detected by the mark detecting means 518, the writing means 504 starts an exposure based on image information, so that a latent image is formed on the photosensor drum 500. The latent image is developed as a toner image by the developing means 506, and then the toner image is transferred onto the intermedium transfer belt 512 at a contact point with the intermedium transfer belt 512. After the transfer process, the photosensor drum 500 is cleaned by the cleaning means 510, and thus the residual toner is cleaned.

The developing device 506 has a structure to correspond developing units with a plurality of colors to developing regions. In a case of forming image with different colors (plural colors), the developing units are equally switched, and the above process for developing different colors are repeatedly performed, so as to overlap images of all colors onto the intermedium transfer belt 512.

The image overlapped onto the intermedium transfer belt 512 is transferred onto a recording medium, e.g., a transfer paper, by another transfer means (not shown). The transfer paper having the full color image is fixed by a fixing device (not shown) and then ejected out of the image forming device. In this example, the image formation for each color is started by referring to the mark on the intermedium transfer belt 512. However, when the writing means 504 is a scanning type using a laser scanning optical system, the detection of the mark on the intermedium transfer belt 512 and a main scanning synchronizing signal as a writing reference of the writing means 504 are not synchronized. Therefore, even though the image formation for each color is started by referring to the mark on the intermedium transfer belt 512, a deviation may occur on the image overlapped with the prime colors.

Next, a control configuration and an operation thereof according to the embodiment is described. FIGS. 26A to 26H show an example of a relationship between an image forming start signal of the sub-scanning direction (FIG. 26A) generated by detecting the mark on the intermedium transfer belt 512 and the synchronizing signal of the writing means 504. A maximum time difference between the synchronizing signal and the image forming start signal (FIG. 26A) is a period T of the synchronizing signal as shown in FIGS. 26B and 26C. As a timing of a reference (initial) image formation is performed with the synchronizing signal p1, a correction for the image forming start timing of other than the reference image (the second and its subsequent colors) is not required. In a case shown in FIG. 26C in which the reference (initial) image formation is performed with the synchronizing signal p2, a maximum one line deviation may occur. In this embodiment, after the image forming start signal is detected, the initial (reference) image formation is performed after a certain time lapses.

FIG. 27 shows a block diagram of the control configuration according to the embodiment of the present invention. Referring to FIGS. 25 and 27, a mark detecting means 518 detects the mark on the intermedium, transfer belt 512 to generate the image forming start signal of the sub-scanning direction. The writing means 504 comprises a first measuring means 602, a storing means 604, a first determining means, a second measuring means 608, a calculating means 610 and a second determining means 612. The first measuring means 602 is used to measure a lapsed time after the image forming start signal of the sub-scanning direction. The storing means 604 is used to store a prescribed setting time T/2. The first determining means 606 is used to determine and compare a measured value of the first measuring means 602 with the setting time T/2. The second measuring means 608 is used to measure and store a time from the mark detection to the synchronizing signal after the measured value of the first measuring means 602 reaches the setting time T/2. The calculating means 610 is used to calculate a time difference between a measured result of the second measuring means 608 and a measured time of the first measuring means 602 from the detection of the image forming start signal of the image formation other than the reference image to the synchronizing signal generated by the writing means 504. The second determining means 612 is used to determine as to whether a calculated result of the calculating means 610 is positive or negative.

According to the first determining means 606, after T/2 is lapsed from the detection of the image forming start signal of the sub-scanning direction, the image forming start signal is synchronized with the synchronizing signal, and then the writing of the reference (the first color) image is started. At this time, there is a situation that the start timing of the reference image is like FIG. 26E or FIG. 26F. A maximum deviation amount occurs in the dash line portion shown in FIG. 26F. A time from a time tx1 by adding the setting time T/2 to a detection time of the image forming start signal of sub-scanning direction to a time ty1 at which the synchronizing signal is first detected after the time tx1, i.e., a time (ty1−tx1) is set as t1. In addition, a time from a detection time tx2 of the image forming start signal of sub-scanning direction for the image formation other than the reference image to a detection time ty2 of the main scanning synchronizing signal, i.e., a time (ty2−tx2) is set as t2.

After T/2 is lapsed from the detection of the image forming start signal, the second measuring means 608 measures and keeps a time t1min or a time t1max until the writing is started. In FIGS. 26A to 26H, t11 is equal to T/2+t1min (t11=T/2+t1min) and t12 is equal to T/2+t1max (t12=T/2+t1max). When performing the image formation other than the reference image, there may be a situation that a maximum vibration amplitude of the synchronizing signal of the writing means 504 is shown in FIG. 26G or FIG. 26H.

The first measuring means 602 measures a time t11 or t12 from detecting the image forming start signal to generating the synchronizing signal of the writing means 504. The calculating means 610 calculates a time difference between a time t1min or t1max that is measured by the second measuring means 608 until the writing for the reference image is started, to a time t21 or t22 that is measured until the synchronizing signal of the writing means 504 for the image formation other than the reference image is generated. In the above case, t21 is t2min and t22 is t2max.

The second determining means 612 determines that the result of the calculating means 610 is positive or negative. When a determination result of the second determining means 612 is negative (t1−t2<0); namely, t11−t21=T/2+t1min−t2min<T/2, the dot shift is less than ½. Therefore, the image writing is started from the first synchronizing signal after the image forming start signal of the sub-scanning direction is detected. When the determination result is positive, i.e., T/2+t1min−t2min>T/2, the writing control unit 614 controls the writing means 504 to start the image writing from the second synchronizing signal after the image forming start signal of the sub-scanning direction is detected.

In a case that the reference image formation is started with a timing of the synchronizing signal shown in FIG. 26E, even though the synchronizing signal for the image formation other than the reference image is shown in either FIG. 26G or 26H, (t11−t21) or (t11−t22) is equal to or smaller than T/2, the image formation is started form the first synchronizing signal. At this time, the maximum dot shift is ½. In addition, in a case that the reference image formation is started with a timing of the synchronizing signal shown in FIG. 26F, if the synchronizing signal for the image formation other than the reference image is as shown in FIG. 26G, (t12−t21) is greater than T/2. Therefore, the image formation is started form the second synchronizing signal pg2. For a case that the reference image formation is started with a timing of the synchronizing signal shown in FIG. 26G, if (t12−t22) is smaller than T/2, the image formation is started from the first synchronizing signal ph1. Among the plurality of images, if an image that is first formed is used as the reference image, the position shift of the overlapped image can be easily and simply controlled as small as possible (the same for the other embodiments).

Figures 28A, 28B, 28C, 28D, 28E, 28F, 28G, 28H, 28I, 28J:
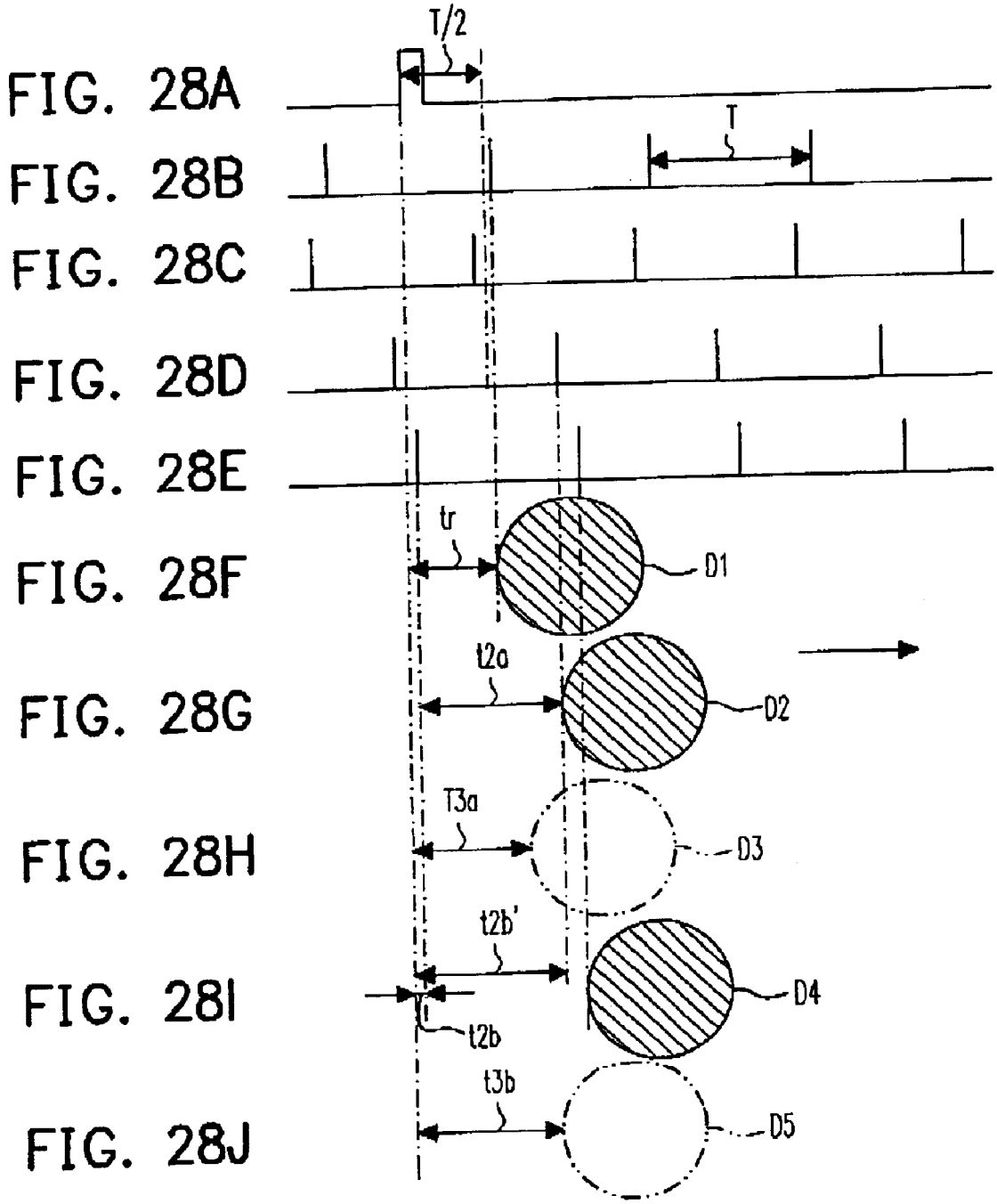
FIGS. 28A to 28J are timing charts showing a relationship between the image forming start signal of the sub-scanning direction and the main scanning synchronizing signal according to another embodiment of the present invention.

Next, the tenth embodiment is described in detail according to FIG. 28. In addition, elements same as the previous embodiment are labeled with the same numbers. If not necessary, descriptions of their structures and functions are omitted and only the main parts are described (the following embodiments are the same). FIGS. 28A to 28H show an example of a relationship between an image forming start signal of the sub-scanning direction (FIG. 28A) and the synchronizing signal of the writing means 504. As a reference image formation is performed with a synchronizing signal shown in FIG. 28B with respect to the image forming start signal of the sub-scanning direction shown in FIG. 28A, a dot D1 of a front line of the image is formed at a position shown in FIG. 28F. The arrow direction is the sub-scanning direction. When the synchronizing signal for an image formation (the second one) other than the reference image is shown in FIG. 28D, its corresponding dot position is D2 as shown in FIG. 28G. At this time, assuming an assumptive image by averaging the reference image and the image other than the reference image, the dot position of the assumptive image is D3 as shown in FIG. 28H. If a time from the image forming start signal in FIG. 28A is ta1, the time ta1 is equal to (tr+t2*a*)/2=(T/2+t1+t2*a*)/2.

If the synchronizing signal for forming the next image (the third one) other than the reference image is as shown in FIG. 28E, t3*a*−t2*b* is larger than T/2. Therefore, forming a dot D4 is started from a position shown in FIG. 28I by delaying one line. If the synchronizing signal for the image formation of the next image (the third one) other than the reference image is as shown in FIG. 28E, ta3−t2*b*>T/2 is not satisfied, so that the image formation is directly started. When forming the next image (the fourth one) other than the reference image, a new time t3*b*, which is from the image forming start signal in FIG. 28A to a dot position D5 (FIG. 28J) of an assumptive image formed by averaging the image in FIG. 28I and the assumptive image in FIG. 28H, is calculated to control a start position of an image formation in the same way. In addition, in a case that the reference image is formed with a synchronizing signal shown in FIG. 28C, when forming the subsequent images other than the reference image, assumptive images are sequentially obtained to perform the image formation in the same way.

Figure 29:
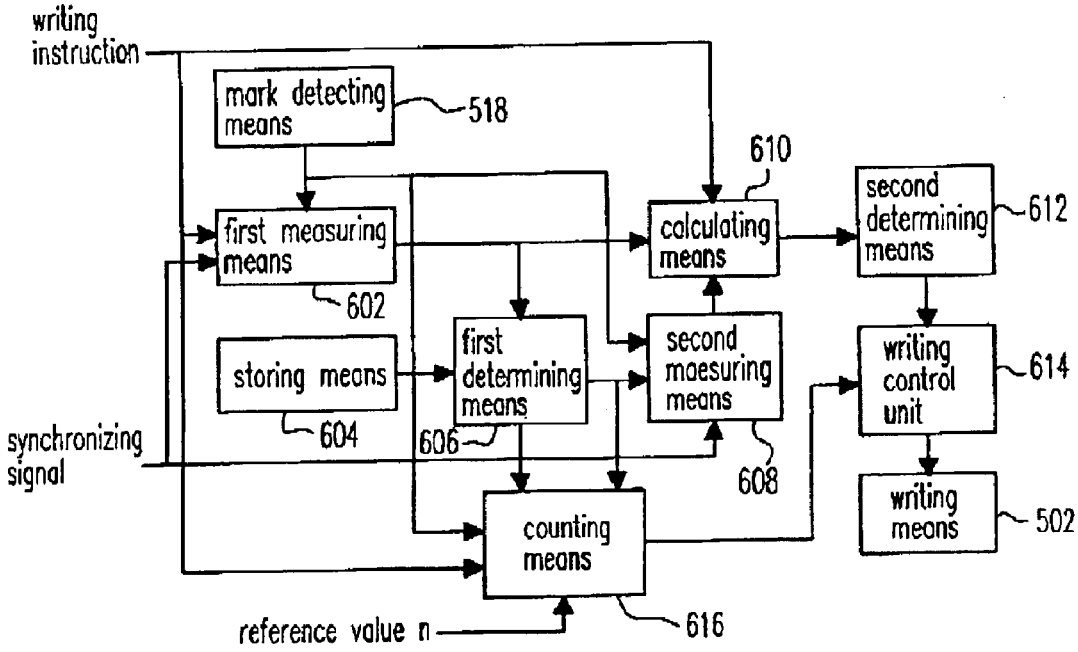
FIG. 29 is control block diagram according to another embodiment of the present invention.

Next, the eleventh embodiment of the present invention is described as follows by referring to FIG. 29. It should be noted first that the reference image formation is started with a synchronizing signal that is appeared immediately after a time T/2 is lapsed from the detection of the image forming start signal of the sub-scanning direction, but it is not a limitation for the present invention. In this embodiment, it features that a reference n is set in such a way that the synchronizing signal of the writing means 504 can be delayed by n periods to start the writing.

When forming the reference image, the number of the synchronizing signal of the writing means 504 is counted, starting from a time point that T/2 has lapsed after the image forming start signal of the sub-scanning direction is detected. A counting means 616 is disposed for counting the number of the synchronizing signal after the image forming start signal of the sub-scanning direction is detected when images other than the reference image are formed.

n is et to the counting means 616. When the counting value reaches n, start the image formation is indicated to the writing control unit 614. For example, when n=3 and if the synchronizing signal for the image formation of the reference image is a timing shown in FIG. 26E, the image formation is started from the synchronizing signal pe. When the synchronizing signal for the image formation other than the reference image is a timing shown in FIG. 26G, the image formation is started from the synchronizing signal pg3 and from the synchronizing signal ph3 for a timing shown in FIG. 26H. In this way, the start position of the image formation can be changed. In addition, degradations, which are caused by a shift of the usable region and by forming an image to a jointed part of the intermedium transfer belt 512, can be avoided.

Figure 30:
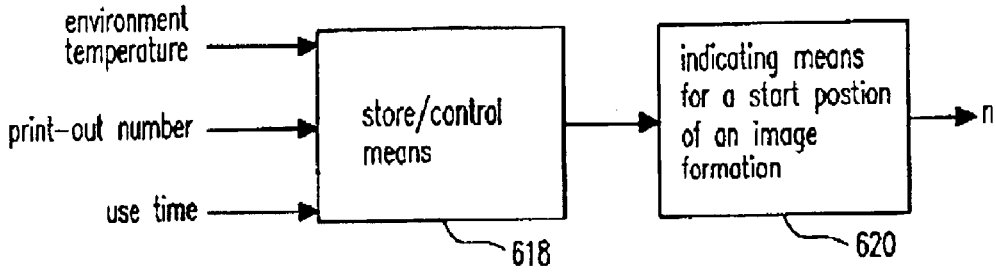
FIG. 30 is control block diagram according to another embodiment of the present invention.

Next, the twelfth embodiment of the present invention is described as follows by referring to FIG. 30. In this embodiment, a storage/control means 618 and an indicating means 620 for indicating a start position of an image formation are set, and the reference n can be stored and kept. For example, the storage/control means 618 controls the indicating means 620 according to an environment temperature, a print-out number, and a use time. A preset reference value n can be set to the counting means 616. In this way, because the image forming position onto the intermedium transfer belt 512 can be changed according to an actual situation, and therefore a degradation of the intermedium transfer belt 512 (the intermedium transfer body) can be avoided.

Figure 31:
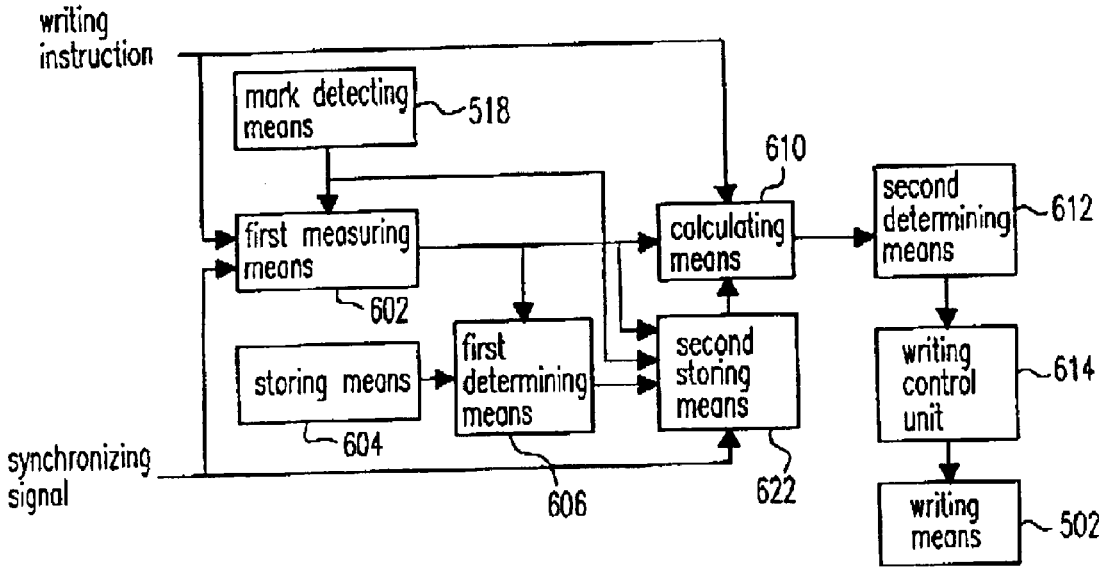
FIG. 31 is control block diagram according to another embodiment of the present invention.

Next, the thirteenth embodiment of the present invention is described as follows by referring to FIG. 31. In this embodiment, the second measuring means 608 in FIG. 27 is replaced by a second storing means 622. The second storing means 622 stores a time measured by the first measuring means 602 until the start of the image formation other than the reference image after time T/2 has lapsed. At this time, the calculating means 610 calculates a time difference between the time stored in the second storing means 622 and the time measured by the first measuring means 602 until the start of the image formation other than the reference image. According to this embodiment, circuit numbers or constructing elements can be selected and controlled according to requirements.

Next, the fourteenth embodiment of the present invention is described as follows by referring to FIG. 32. For simplifying the description, a positive integer m is set to 1. The present embodiment is to control output image information according to a result of the second determining means 612. As a reference image formation is performed with a synchronizing signal shown in FIG. 32B with respect to the image forming start signal of the sub-scanning direction shown in FIG. 32A, a dot of a front line of the image is formed at a position shown in FIG. 32F. The arrow direction is the sub-scanning direction.

Figures 32A, 32B, 32C, 32D, 32E, 32F, 32G, 32H, 32I, 32J:
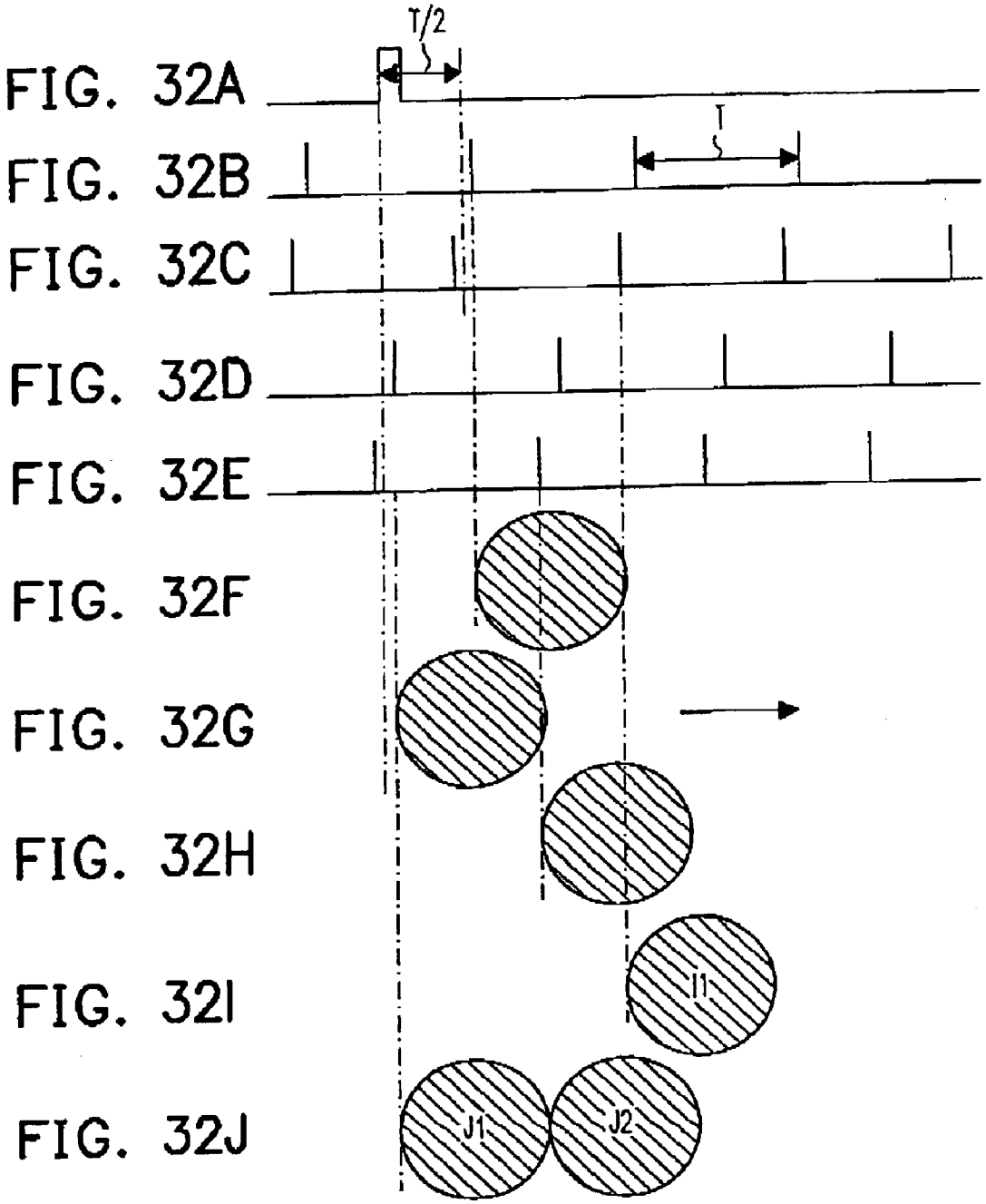
FIGS. 32A to 32J are timing charts showing a relationship between the image forming start signal of the sub-scanning direction and the main scanning synchronizing signal according to another embodiment of the present invention.

When the synchronizing signals for forming images other than the reference image are as shown in FIGS. 32D and 32E, the dot positions are shown in FIGS. 32G and 32H respectively. Even though data of the first line is directly output, the respective dot shifts are converged within ½ dot size with respect to the dot position of the reference image. When the image formation of the reference image is performed with the synchronizing signal in FIG. 32C, the dot position of the front line is as shown in FIG. 32I. When the image formation of the reference image is performed with the synchronizing signal in FIG. 32D, the dot position of the front line is J1 as shown in FIG. 32J. The dot I1 of the front line of the reference image shown in FIG. 32I has a shift above one line in the sub-scanning direction.

At this time, the result of the second determining means 612 is positive, and output data sequence is controlled. When the result of the second determining means 612 is positive, image information of the dot (equivalent to the dot J1) of the front line is output as an empty (not printed). Then, one line is delayed to output data in such a way that data of the front line is formed from the dot J1 that is equivalent to a dot position of the second line. When the image formation of the reference image is performed with the synchronizing signal in FIG. 32E, even though data of the front line is directly output, the dot shift is converged within ½ dot size with respect to the dot position of the reference image.

Next, the fifteenth embodiment is described. This embodiment features that the printing speed is changed by directly reducing the dot shift by changing the frequency of the basic functional blocks that control operation of the whole image forming device. The reference value as a comparative object of the calculating means 610 and the first measuring means mentioned above is set as a counting value of the aforementioned basic functional blocks. By changing the printing speed with the above setting, even though the frequency of the synchronizing signal of the writing means 504 is changed, half of the frequency of the synchronizing signal can be usually set as the reference value. Therefore, even though the recording speed is changed, the position shift (the color deviation) of the overlapped images can be always reduced.

Figures 33A, 33B, 33C, 33D, 33E, 33F, 33G, 33H, 33I, 33J:
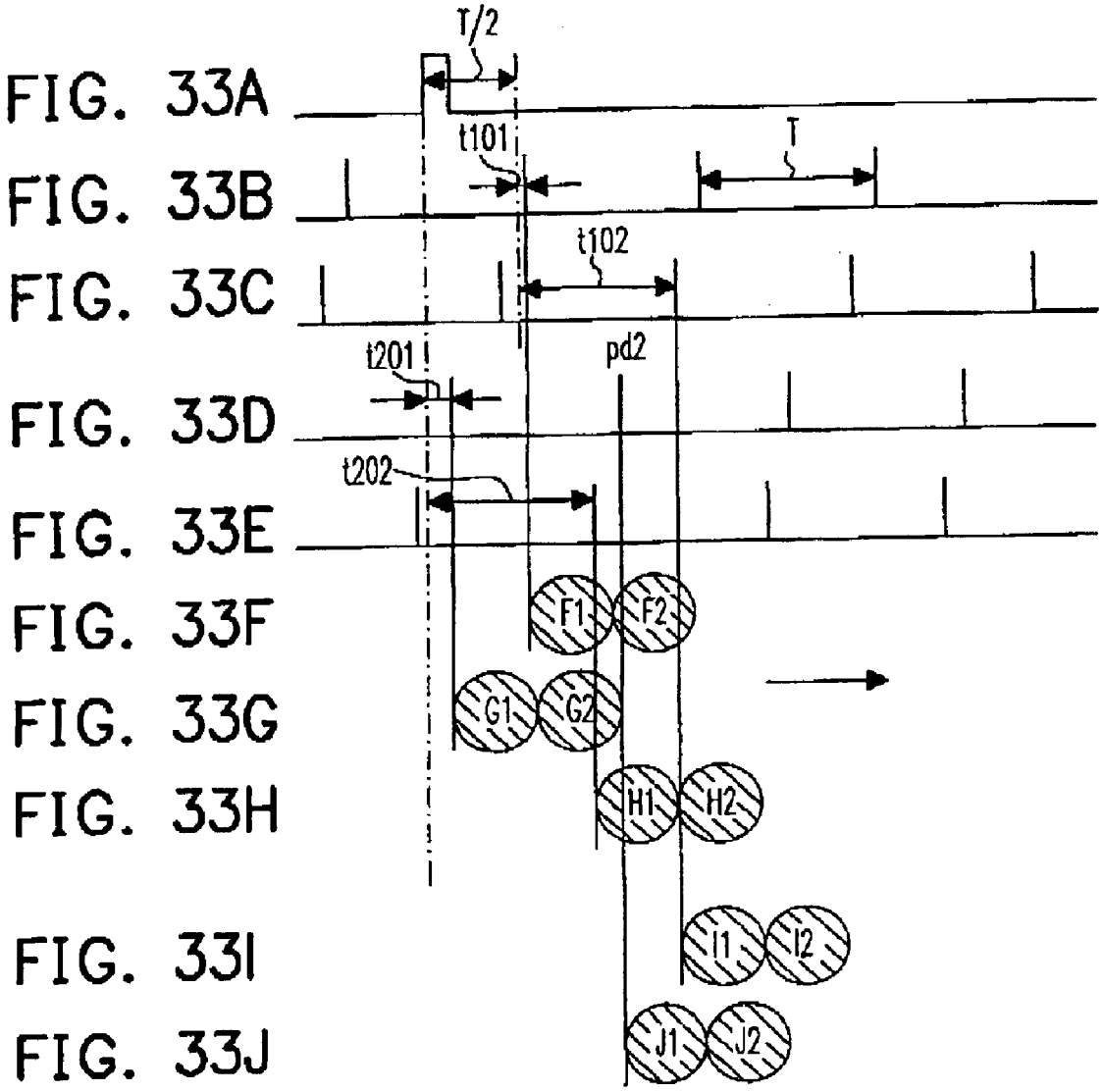
FIGS. 33A to 33J are timing charts showing a relationship between the image forming start signal of the sub-scanning direction and the main scanning synchronizing signal according to another embodiment of the present invention.
Figure 34:
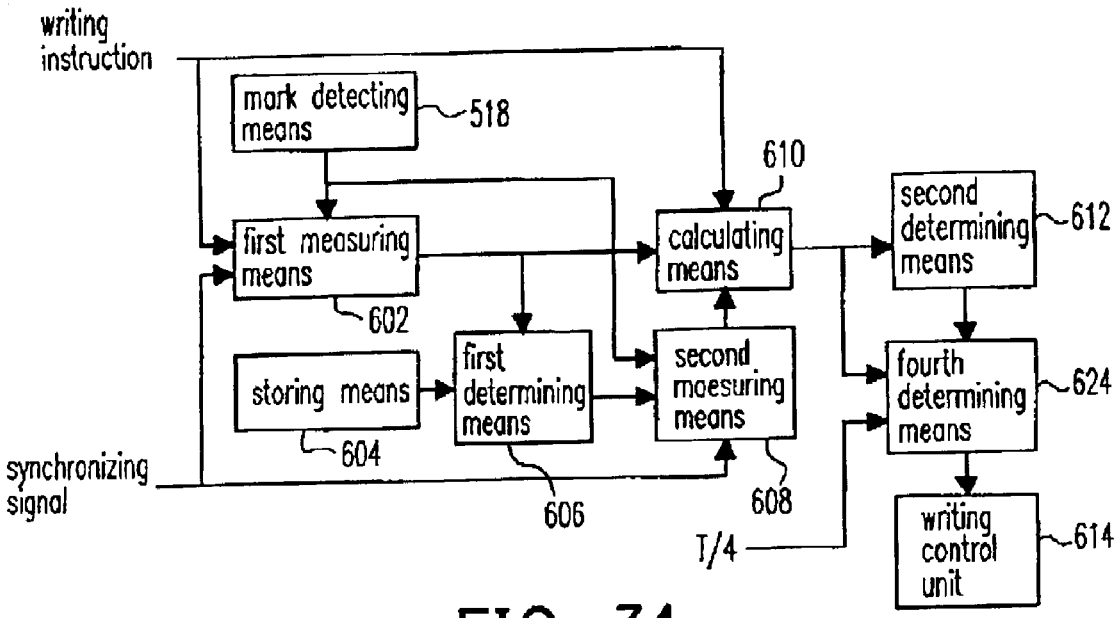
FIG. 34 is control block diagram according to another embodiment of the present invention.

Next, the sixth embodiment is described as follows by referring to FIGS. 33A to 33J and 34. FIG. 33A shows an image forming start signal of the sub-scanning direction, FIGS. 33B to 33E show synchronizing signals of the writing means 504, and FIGS. 33F to 33J show examples of dot positions in the sub-scanning direction that are formed according to the synchronizing signals. FIG. 34 is a block diagram to perform the image formation shown in FIGS. 33A to 33J.

Different features between FIG. 34 and FIG. 27 are as follows. The block diagram in FIG. 37 further comprises a fourth determining means 624 to determine a size by comparing an absolute value of a calculated result of the calculating means 610 with T/4 according to either the result of the calculating means 610 or the result of the second determining means 612. In this embodiment, a time (ty1−tx1), which lapses from a time tx1 that a time T/2 is added to a detection time of the image forming start signal of the sub-scanning direction to a time ty1 at which the synchronizing signal is first detected after the time tx1, is set as t1, and a time (ty2−tx2), which lapses from a detection time tx2 of the image forming start signal of the sub-scanning signal when the image other than the reference image is formed to a detection time ty2 of the synchronizing signal, is set as t2. In a case that (t1−t2) is positive when the image other than the reference image is formed, the writing means 504 delays the start of the image formation by one scanning. When |t1−t2|>T/4 and (t1−t2) is positive, image information is delayed by only one line. When |t1−t2|>T/4 and (t1−t2) is negative, image information is advanced by only one line to perform the image formation.

Because the formation of the reference image is started with a synchronizing signal that is lapsed a time T/2 after the image forming start signal of the sub-scanning direction is generated according to the first determining means 606, the start timing for the reference image is between a timing of FIG. 33B and a timing of FIG. 33C. The writing means 504 forms two lines in the sub-scanning direction simultaneously by scanning one time. The dot positions respectively created with the timings are shown in FIGS. 33F and 33I. The arrow direction indicates the sub-scanning direction. F1 and I1 indicate dot positions of the front (first) lines, and F2 and I2 indicate dot positions of the second lines.

The second measuring means 608 measures and stores a time at which the writing is started by the synchronizing signal after the time T/2 has lapsed, for example, the time t101 or t102. The start timing of the image formation other than the reference image varies to the most between an interval shown in FIGS. 33D and 33E. The first measuring means 602 measures a time (e.g., t201 or t202) from a detection of the image forming start signal of the sub-scanning direction to the generation of the synchronizing signal of the writing means 504. The calculating means 610 calculates a time difference between a time (e.g., t101 or t102) that is measured by the second measuring means 608 until the start of writing the reference image and a time (e.g., t201 or t202) at which the synchronizing signal of the writing means 504 is generated during the image formation other than the reference image. The result of the calculating means 610 is positive or negative is determined by the second determining means 612. When the second determining means 612 determines that the calculated result is negative, the fourth determining means 624 compares the absolute value of the result of the calculating means 610 with T/4. When the absolute value is smaller than T/4, the image formation is directly started. In a case that the absolute value is larger than T/4, if the calculated result of the calculating means 610 is positive, front line data of the beginning of the image other than the reference image is set as empty data, and then image information is output by delaying one line. In addition, when the result of the calculating means 610 is negative, front line data of the beginning of the image other than the reference image is output from image information of the second line, and image information is output by advancing one line only.

In addition, when the determination result of the second determining means 612 is positive, the writing means 504 is controlled to start the image formation from one delayed synchronizing signal. Then, the absolute value of the calculated result is compared with T/4 by using the fourth determining means 624, and then output data is controlled according to the compared result as described above. In a case that the image formation of the reference image is started with the timing shown in FIG. 33B, when the image formations other than the reference image are started with the timings shown in FIGS. 33D and 33E, the result of the second determining means 612 is negative and the image formations are started from the first synchronizing signals shown in FIGS. 33D and 33E.

In a case that the results of fourth determining means 624 for both timings in FIGS. 33D and 33E are large, because the calculated result for the timing shown in FIG. 33D is positive, first line data represented by dot position G1 is set as empty data, and one line data of the image is output to the second line represented by the dot position G2. Because the calculated result for the timing shown in FIG. 33E is negative, image information is output to the front line represented by the dot position H1 from second line data of the image. In a case for a timing of the synchronizing signal shown in FIG. 33D, with respect to the dot position F1 of the front line of the reference image, the front line of the image other than the reference image can be formed at the got position G2. In a case for a timing of the synchronizing signal shown in FIG. 33E, with respect to the dot position F2 of the second line of the reference image, second line data can be formed at the dot position H1 and the dot shift can be reduced.

In addition, in a case that the formation of the reference image is started from the timing shown in FIG. 33C, as the image formation other than the reference image is started from the timing shown in FIG. 33D, the result of the second determining means 612 is positive. Then, the writing is started from the second synchronizing signal after the mark is detected. Following process is as described above. The absolute value of the calculated result is compared with T/4 so as to control output image information. According to the embodiment, even though the writing means in which two lines are scanned at the same time is used, the position shift of the overlapped image can be reduced. In addition, when the result of the fourth determining means 624 is small, the image formation other than the reference image is output from image information with line that is the same as the reference image. When the result of the fourth determining means 624 is large and the difference between the calculated result and the fourth reference value is positive, the front line of the image other than the reference image is output from line data that is delayed by one line as compared with the line of image information of the reference image. When the result of the fourth determining means 624 is large and the difference between the calculated result and the fourth reference value is negative, empty data (dummy data) is output, and start data can be controlled in such a manner that image information of and after the second line is output from image information of the same line as the reference image. In this situation, even though the writing means in which two lines are scanned at the same time is used, the position shift of the overlapped image can be reduced with a simple operation.

Figure 35:
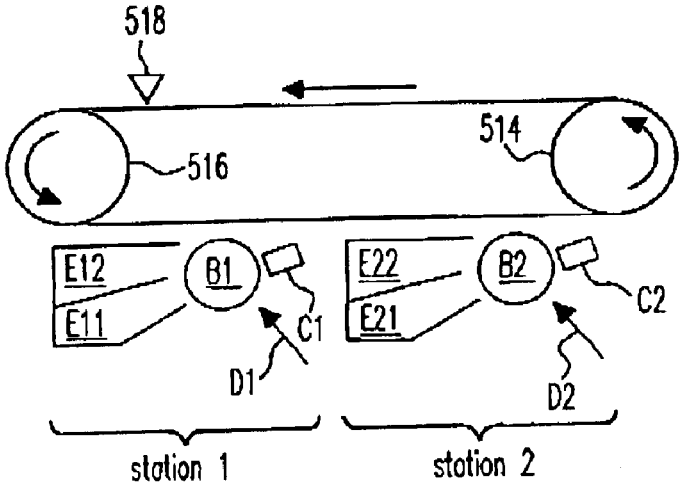
FIG. 35 is a schematic front view of an image forming device according to another embodiment of the present invention.

Next, the seventh embodiment is described by referring to FIG. 35. The present embodiment is an example wherein the aforementioned invention is suitable for an image forming device, a two-station type image forming device. The image forming device comprises a station 1 and a station 2 (as image forming means) under the intermedium transfer belt 512. The station 1 comprises an image supporter B1, a writing means D1, at least two developing means E11, E12 for developing an electrostatic latent image formed on the image supporter B1 by writing means D1, a development switching means (not shown) for selectively driving one of the developing means E11, E12. Similarly, the station 2 comprises an image supporter B2, a writing means D2, at least two developing means E21, E22 for developing an electrostatic latent image formed on the image supporter B2 by writing means D2, a development switching means (not shown) for selectively driving one of the developing means E21, E22.

Images can be formed by the plurality of image forming means according to an image formation start signal generated by the mark detecting means 518 as described above. In this way, an image with plural colors can be easily and accurately overlapped onto the intermedium transfer belt 512. Therefore, a high quality full color image forming device can be achieved.

In addition, according to one advantage of the present invention, even though a time lapsing from detecting the image forming start signal of the sub-scanning direction to detecting the main scanning signal when performing the optical writing other than the reference image is longer than a time lapsing from detecting the image forming start signal of the sub-scanning direction to detecting the main scanning signal when performing the optical writing of the prescribed reference image, the position shift of image other than the reference image can be suppressed below as half as the dot diameter with respect to the reference image. Moreover, a color deviation of the toner image, which is caused by that the main scanning synchronizing signal and image forming start signal of the sub-scanning direction are not synchronized, can be avoided.

In addition, according to one advantage of the present invention, even though a time lapse from detecting the image forming start signal of the sub-scanning direction to detecting the main scanning signal when performing the optical writing other than the reference image is shorter than a time lapse from detecting the image forming start signal of the sub-scanning direction to detecting the main scanning signal when performing the optical writing of the prescribed reference image, the position shift of image other than the reference image can be suppressed to below half as the dot diameter with respect to the reference image. Moreover, a color deviation of the toner image, which is caused by that the main scanning synchronizing signal and image forming start signal of the sub-scanning direction are not synchronized, can be avoided.

According to another advantage of the present invention, the image forming position in the sub-scanning direction can become stable, and the image whose position shift is reduced can be easy to increase to the most. Furthermore, the position shift of the image where the scanning is started from the third line can be further reduced. In addition, either the position shift of the color image is reduced or the position shift of the highly related image is reduced, so that the image quality is highly improved. Additionally, the image with a high correlation can be effectively selected.

According to other advantages of the present invention, the position shift (the color deviation) of the overlapped image can be reduced. In addition, even though the images are overlapped over three times, the position shift (the color deviation) can be reduced with a high accuracy. Furthermore, the position shift (the color deviation) of the overlapped image can be achieved by either using a simple device structure or a simple operation. Because the image forming position on the intermedium transfer body can be changed, a degradation of the intermedium body can be avoided.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What claimed is:

1. An image forming device, comprising:

a body to be scanned that moves in a sub-scanning direction;

a writing means for scanning the body in a main scanning direction with a light beam according to image information to form a reference image on the body and repeating the scanning plural times to form plural images; and a second body on which the plural images are overlaid to form a color image, wherein the writing means starts writing the reference image at a start time ty1 when a main scanning synchronizing signal is firstly generated by the writing means after a time tx1 when a predetermined time has lapsed from detection of an image forming start signal of the sub-scanning direction for the reference image, wherein a start time for an image other than the reference image is changed depending on the start time of the reference image, and wherein the predetermined time is T/2 where T is a period of the main scanning synchronizing signal of the writing means, and wherein the writing means delays starting writing the image other than the reference image by T when the following relationship is satisfied:

$$(t1-t2)>0$$

wherein t1=(ty1−tx1) and t2=(ty2−tx2) where tx2 represents a time when an image forming start signal of the sub-scanning direction for the image other than the reference image is detected, and ty2 represents a start time when the main scanning synchronizing signal is firstly generated by the writing means after the time tx2.

2. The image forming device of claim 1, wherein an assumptive image obtained by averaging start positions in the sub-scanning direction of a plurality of images that have been written is used as the reference image, and wherein the writing means delays starting writing a following image other than the reference image by T when the following relationship is satisfied:

$$(t3-t2)>T/2$$

wherein t3 represents a time from the time when the image forming start signal of the sub-scanning direction for the assumptive image is detected to the time when the writing means starts writing the assumptive image.

3. The image forming device of claim 1, further comprising:

a mark detecting means, wherein the second body is an intermediate transfer body on which the plural images formed on the body are transferred and which has a mark thereon, wherein the image forming start signal of the sub-scanning direction is generated when the mark is detected by the mark detecting means, and wherein the writing means comprises:

a first measuring means for measuring a first lapse time after the image forming start signal is detected;

a storing means for storing the predetermined time T/2;

a first determining means for comparing the first lapse time measured by the first measuring means with the predetermined time T/2 to determine whether the first lapse time is larger than the predetermined time T/2;

a second measuring means for measuring and storing a second lapse time from a time when the lapse time measured by the first measuring means reaches the predetermined time T/2 to a time when the writing means generates a main scanning synchronizing signal;

a calculating means for calculating a time difference between the first lapse time measured by the first measuring means and the second lapse time measured by the second measuring means, when forming the image other than the reference image; and a second determining means for determining as to whether the time difference is positive or negative, and wherein at a time point that the first lapse time is determined to be larger than the predetermined time T/2 by the first determining means, the writing means starts writing the reference image while synchronizing with the main scanning synchronizing signal, and the start time of the image other than the reference image is delayed depending on a result of the second determining means.

4. The image forming device of claim 3, wherein the writing means further comprises:

a counting means for counting a number of the main scanning synchronizing signal after the first lapse time reaches the predetermined time T/2 when forming the reference image, and for counting a number of the main scanning synchronizing signal after the image forming start signal is detected when forming the image other than the reference image, wherein when the number of the main scanning synchronizing signal when forming the reference image is n, the writing means starts writing the reference image, and wherein when the second determining means determines that the time difference is negative, the writing means starts writing the image other than the reference image while synchronizing with the n-th synchronizing signal after the image forming start signal is detected, and when the second determining means determines that the time difference is positive, the writing means starts writing the image other than the reference image while synchronizing with the (n+1)-th synchronizing signal after the image fanning start signal is detected.

5. The image forming device of claim 4, wherein if the image formation of the reference image is performed from m-th (m is a positive integer) line thereof, the image formation of the plural images other than the reference image is output from the m-th line thereof such that the m-th line is output as a first line of the plural images when the second determining means determines that the time difference is negative, and the image formation of the plural images other than the reference image Is output from the m-th line thereof such that the m-th line is output as a second line while outputting empty data in the first line when the second determining means determines that the time difference is positive.

6. The image forming device of claim 1, wherein the reference image is changeable.

7. A writing control device, comprising:

a scanning and writing device for scanning in a main scanning direction a body that moves in a sub-scanning direction with light beams according to image information when a main scanning synchronizing signal generated by the scanning and writing device is detected after an image forming start signal of the sub-scanning direction is detected, to write an image on the body, and repeating the scanning plural times to form plural images including a reference image, which are overlaid on a second body to form a color image thereon, wherein the scanning and writing device performs n (n>0) line scanning per one scanning, wherein in a case of $t1<t2$, in which $t1$ represents a time lapsing from the detection of the image forming start signal to the detection of the main scanning synchronizing signal when the scanning and writing device starts writing the reference image; and $t2$ represents a time lapsing from the detection of the image forming start signal to the detection of the main scanning synchronizing signal when the scanning and writing device starts writing an image other than the reference image, the scanning and writing device starts writing the image other than the reference image from a (i+1)-th line where i represents an integer so as to minimize $|t1+T\times(i/n)-t2|$ where T represents a time interval at which the main scanning synchronizing signal is generated.

8. The writing control device of claim 7, wherein in a case oft $t1>t2$, the scanning and writing device starts writing the image other than the reference image while delaying the scanning by (−m) lines where m represents an integer so as to minimize $|t1+T\times(m/n)-t2|$.

9. The writing control device of claim 8, wherein the scanning and writing device start writing the reference image from a (j+1)-th line where j represents a non-negative integer so as to minimize $|t1-T\times(j/n)|$ and the scanning and writing device starts writing the image other than the reference image from a (k+1)-th line where k represents an integer so as to minimize $|t1-T\times(j/n)+T\times(k/n)-t2|$.

10. The writing control device of claim 7, wherein a first image of the plural images is used as the reference image.

11. The writing control device of claim 7, wherein an assumptive image is used as the reference image, and wherein the assumptive image is obtained by averaging positions in the sub-scanning direction of images of the plural images that have been written.

12. The writing control device of claim 7, wherein when the plural images include at least two chromatic color images, one of the at least two chromatic color images is used as the reference image.

13. The writing control device of claim 7, wherein the plural images include at least three images, and wherein one of two images of the three images, which have a higher correlation with each other than any other combinations of the three images, is used as the reference image.

14. The writing control device of claim 7, wherein the reference image is changeable.

15. A writing control device, comprising:

a scanning and writing device for scanning in a main scanning direction a body that moves in a sub-scanning direction with light beams according to image information when a main scanning synchronizing signal generated by the scanning and writing device is detected after an image forming start signal of the sub-scanning direction is detected, to write an image on the body, and repeating the scanning plural times to form plural images including a reference image, which are overlaid on a second body to form a color image thereon, wherein a time lapsing from the detection of the image forming start signal to the first detection of the main scanning synchronizing signal is $t1$ when the scanning and writing device writes the reference image, and a time lapsing from the detection of the image forming start signal to the first detection of the main scanning synchronizing signal is $t2$ when the scanning and writing device writes an image other than reference image, wherein the scanning and writing device starts writing the reference image at a time when the time $t1$ has lapsed from the detection of the image forming start signal for the reference image, and wherein the scanning and writing device starts writing an image other than the reference image from a first line at a time when the time $t2$ has lapsed from the detection of the image forming start signal for the image when $t1$ is less than a first predetermined time and $|t1-t2|$ is less than a second predetermined time; when $t1$ is less than the first predetermined time and $|t1-t2|$ is not less than the second predetermined time, the scanning and writing device starts writing the image other than the reference image from a second line at the time when $t2$ has lapsed from the detection of the image forming start signal for the image; when $t1$ is not less than the first predetermined time and $|t1-t2|$ is less than the second predetermined time, the scanning and writing device starts writing the image other than the reference image from the first line at the time when $t2$ has lapsed from the detection of the image forming start signal for the image; and when $t1$ is not less than the first predetermined time and $|t1-t2|$ is not less than the second predetermined time, the scanning and writing device starts writing the image other than the reference image from the first line at a time when $t2+T$ has lapsed from the detection of the image forming start signal for the image, where T represents a time interval at which the main scanning synchronizing signal is generated.

16. The writing control device of claim 15, wherein the time t1 is an average time from the detection of the image forming start signals to the write starting times of images of the plural images that have been written.

17. The writing control device of claim 15, wherein a first image of the plural images is used as the reference image.

18. The writing control device of claim 15, wherein an assumptive image is used as the reference image, and wherein the assumptive image is obtained by averaging positions in the sub-scanning direction of images of the plural images that have been written.

19. The writing control device of claim 15, wherein when the plural images include at least two chromatic color images, one of the at least two chromatic color images is used as the reference image.

20. The writing control device of claim 15, wherein the plural images include at least three images, and wherein one of two images of the three images, which have a higher correlation with each other than any other combinations of the three images, is used as the reference image.

21. The writing control device of claim 15, wherein the first predetermined time is T/2.

22. A writing control device, comprising:

a scanning and writing device for scanning in a main scanning direction a body that moves in a sub-scanning direction with light beams according to image information when a main scanning synchronizing signal generated by the scanning and writing device is detected after an image forming start signal of the sub-scanning direction is detected, to write an image on the body, and repeating the scanning plural times to form plural images including a reference image, which are overlaid on a second body to form a color image thereon, wherein a time lapsing from the detection of the image forming start signal to the first detection of the main scanning synchronizing signal is t1 when the scanning and writing device writes the reference image, and a time lapsing from the detection of the image forming start signal to the first detection of the main scanning synchronizing signal is t2 when the scanning and writing device writes an image other theft reference image, wherein the scanning and writing device starts writing the reference image from a first line at a time when the time t1 has lapsed from the detection of the image forming start signal for the reference image when the time t1 is less than a first predetermined time, and the scanning and writing device starts writing the reference image from a second line at the time when the time t1 has lapsed from the detection of the image forming start signal for the reference image when t1 is not less than a first predetermined time, and wherein the scanning and writing device starts writing an image other than the reference image from a first line at a time when the time t2 has lapsed from the detection of the image forming start signal for the image when the time t1 is less than a first predetermined time and |t1−t2| is less than a second predetermined time; when the time t1 is less than the first predetermined time and |t1−t2| is not less than the second predetermined time, the scanning and writing device starts writing the image other than the reference image from a second line at the time when the time t2 has lapsed from the detection of the image forming start signal for the image; and when t1 is not less than the first predetermined time and |t1−t2| is less than the second predetermined time, the scanning and writing device starts writing the image other than the reference image from the second line at the time when the time t2 has lapsed from the detection of the image forming start signal for the 'image; and when t1 is not less than the first predetermined time and |t1−t2| is not less than the second predetermined time, the scanning and writing device starts writing the image other than the reference image from the first line at a time when the time t2 has lapsed from the detection of the image forming start signal for the image.

23. The writing control device of claim 22, wherein the time t1 is an average time from the detection of the image forming start signals to the write starting times of images of the plural images that have been written.

24. The writing control device of claim 22, wherein a first image of the plural images is used as the reference image.

25. The writing control device of claim 22, wherein an assumptive image is used as the reference image, and wherein the assumptive image is obtained by averaging positions in the sub-scanning direction of images of the plural images that have been written.

26. The writing control device of claim 22, wherein when the plural images include at least two chromatic color images, one of the at least two chromatic color images is used as the reference image.

27. The writing control device of claim 22, wherein the plural images include at least three images, and wherein one of two images of the three images, which have a higher correlation with each other than any other combinations of the three images, is used as the reference image.

28. The writing control device of claim 22, wherein the first predetermined time is T/2 where T represents a time interval at which the main scanning synchronizing signal is generated.

29. An image forming device comprising:

a body to be scanned by a scanning and writing device;

the writing control device of claim 7; and a second body on which the color image is formed.

30. An image forming device comprising:

a body to be scanned by a scanning and writing device;

the writing control device of claim 15; and a second body on which the color image is formed.

31. An image forming device comprising:

a body to be scanned by a scanning and writing device;

the writing control device of claim 23; and a second body on which the color image is formed.

32. An image forming device comprising:

the writing control device of claim 13;

a converting means for converting image information in a first color space into image information m a second color space; and a determining means for determining a correlation strength among color images in the second color space depending on an amount of the image information in the first color space, wherein the color image is formed using the image information in the second color space.

33. An image fanning device comprising:

the writing control device of claim 20;

a converting means for converting image information in a first color space into image information in a second color space; and a determining means for determining a correlation strength among color images in the second color space depending on an amount of the image information in the first color space, wherein the color image is formed using the image information in the second color space.

34. An image forming device comprising:

the writing control device of claim 27;

a converting means for converting image information m a first color space into image information in a second color space; and a determining means for determining a correlation strength among color images in the second color space depending on an amount of the image information in the first color space, wherein the color image is formed using the image information in the second color space.

* * * * *